US008309286B2

(12) United States Patent
Yamada et al.

(10) Patent No.: US 8,309,286 B2
(45) Date of Patent: Nov. 13, 2012

(54) ELECTROPHOTOGRAPHIC PHOTORECEPTOR, PROCESS CARTRIDGE, AND IMAGE FORMING APPARATUS

(75) Inventors: Wataru Yamada, Kanagawa (JP); Katsumi Nukada, Kanagawa (JP); Takatsugu Doi, Kanagawa (JP); Akira Hirano, Kanagawa (JP); Hitoshi Takimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 376 days.

(21) Appl. No.: 12/430,731

(22) Filed: Apr. 27, 2009

(65) Prior Publication Data

US 2010/0167192 A1 Jul. 1, 2010

(30) Foreign Application Priority Data

Dec. 25, 2008 (JP) ..... 2008-331464

(51) Int. Cl.
*G03G 5/07* (2006.01)

(52) U.S. Cl. ..... 430/66; 430/58.6; 430/58.65; 430/58.7; 399/159

(58) Field of Classification Search ..... 430/58.6, 430/58.65, 58.7, 66; 399/159
See application file for complete search history.

(56) References Cited

U.S. PATENT DOCUMENTS 5,283,145 A 2/1994 Nukada et al.
5,290,928 A 3/1994 Nukada et al.
5,298,617 A 3/1994 Nukada et al.
5,302,479 A 4/1994 Daimon et al.
5,308,728 A 5/1994 Imai et al.
5,338,636 A 8/1994 Nukada et al.
5,358,813 A 10/1994 Iijima et al.
5,378,569 A 1/1995 Nukada et al.
5,393,629 A 2/1995 Nukada et al.
(Continued)

FOREIGN PATENT DOCUMENTS

CN 101144989 A 3/2008
(Continued)

OTHER PUBLICATIONS

Translation of JP 2001-175016 published Jun. 2001.*
(Continued)

*Primary Examiner* — Peter Vajda
(74) *Attorney, Agent, or Firm* — Oliff & Berridge, PLC

(57) ABSTRACT

The invention provides an electrophotographic photoreceptor having at least a conductive substrate and a photosensitive layer formed on the conductive substrate wherein the outermost surface layer of the photoreceptor is composed of a cured material containing at least one compound represented by the formula (I) and a surfactant that contains, in the molecule thereof, at least one structure selected from (A) a structure that is obtained by polymerizing an acrylic monomer having a fluorine atom, (B) a structure having a carbon-carbon double bond and a fluorine atom, (C) an alkyleneoxide structure, and (D) a structure having a carbon-carbon triple bond and a hydroxy group. In formula (I), Q is an organic group having a valency of n and having hole transportability, R is a hydrogen atom or an alkyl group, L is a divalent organic group, n is 1 or more, and j is 0 or 1.

(I)

9 Claims, 6 Drawing Sheets

U.S. PATENT DOCUMENTS

| | | | | |
|---|---|---|---|---|
| 5,411,827 | A | 5/1995 | Tamura et al. | |
| 5,416,207 | A | 5/1995 | Imai et al. | |
| 5,459,004 | A | 10/1995 | Daimon et al. | |
| 5,463,043 | A | 10/1995 | Nukada et al. | |
| 5,496,671 | A | 3/1996 | Tamura et al. | |
| 5,639,581 | A | 6/1997 | Iwasaki et al. | |
| 5,654,119 | A | 8/1997 | Ishii et al. | |
| 5,695,898 | A | 12/1997 | Go et al. | |
| 5,734,003 | A | 3/1998 | Iwasaki et al. | |
| 6,180,303 | B1 | 1/2001 | Uematsu et al. | |
| 7,341,814 | B2 | 3/2008 | Kami et al. | |
| 2004/0253527 | A1* | 12/2004 | Suzuki et al. | 430/66 |
| 2008/0031642 | A1* | 2/2008 | Yamada et al. | 399/25 |
| 2008/0085459 | A1 | 4/2008 | Kami et al. | |
| 2008/0261135 | A1* | 10/2008 | Yamada et al. | 430/58.1 |

FOREIGN PATENT DOCUMENTS

| | | | |
|---|---|---|---|
| EP | 2 000 855 | A1 | 12/2008 |
| JP | A-4-189873 | | 7/1992 |
| JP | A-5-98181 | | 4/1993 |
| JP | A-5-140472 | | 6/1993 |
| JP | A-5-140473 | | 6/1993 |
| JP | A-5-216249 | | 8/1993 |
| JP | A-5-263007 | | 10/1993 |
| JP | A-5-279591 | | 10/1993 |
| JP | A-8-176293 | | 7/1996 |
| JP | A-8-208820 | | 8/1996 |
| JP | A-2000-19749 | | 1/2000 |
| JP | A-2000-66424 | | 3/2000 |
| JP | 2001-175016 | * | 6/2001 |
| JP | A-2001-175016 | | 6/2001 |
| JP | B2-3287678 | | 6/2002 |
| JP | A-2004-12986 | | 1/2004 |
| JP | A-2004-240079 | | 8/2004 |
| JP | A-2005-215025 | | 8/2005 |
| JP | A-2005-227742 | | 8/2005 |
| JP | A-2005-234546 | | 9/2005 |
| JP | A-2007-178813 | | 7/2007 |
| JP | 2007-248914 | * | 9/2007 |
| JP | A-2007-248914 | | 9/2007 |
| JP | A-2008-15275 | | 1/2008 |

OTHER PUBLICATIONS

Translation of JP 2007-248914 published Sep. 2007.*

Notice of Reasons for Rejection for corresponding Japanese Patent Application No. 2008-331464, mailed on Nov. 16, 2010 (w/English translation).

Partial European Search Report for European Patent Application No. 09163246.3, issued on Jun. 29, 2010.

Chinese Office Action issued on Feb. 13, 2012 in Chinese Patent Application No. 200910140984.2 (with translation).

* cited by examiner

ELECTROPHOTOGRAPHIC PHOTORECEPTOR, PROCESS CARTRIDGE, AND IMAGE FORMING APPARATUS

This application is based on and claims priority under 35 USC 119 from Japanese Patent Application No. 2008-331464 filed Dec. 25, 2008.

BACKGROUND OF THE INVENTION

1. Field of the Invention

The present invention relates to an electrophotographic photoreceptor, a process cartridge and an image forming apparatus.

2. Description of the Related Art

Generally, an electrophotographic image forming apparatus has the following structure and processes. Specifically, an image-formed material is obtained by charging the surface of an electrophotographic photoreceptor by a charging unit in order to impart a desired polarity and a potential to the surface; forming an electrostatic latent image on the charged surface of the electrophotographic photoreceptor by selectively discharging the surface and exposing the surface to light in an image-wise manner; developing the latent image by attaching a toner thereto by a developing unit to form a toner image; and transferring the toner image onto an image-receiving medium by a transfer unit.

In recent years, the electrophotographic photoreceptor has become used more often in the fields of copy machines, laser beam printers and the like, because it has an advantage of providing high speed and high quality printing.

As the electrophotographic photoreceptor used in these image forming apparatuses, an electrophotographic photoreceptor (inorganic photoreceptor) using conventional inorganic photoconductive materials such as selenium, a selenium and tellurium alloy, a selenium and arsenic alloy, and cadmium sulfide has been known. In recent years, an electrophotographic photoreceptor (organic photoreceptor) using an organic photoconductive material, that exhibits excellent advantages in the low-cost productivity and disposability thereof, has become dominating a main stream.

A corona charging method utilizing a corona charging device has been conventionally used as a charging method. In recent years, however, a contact charging method, having such advantages as suppressed amounts of ozone production and electricity consumption, has been put to practical application and actively used. In the contact charging method, the surface of an electrophotographic photoreceptor is charged by bringing a conductive member serving as a charging member into contact with the surface of the electrophotographic photoreceptor, or by bringing the conductive member close to the surface of the electrophotographic photoreceptor, and then applying a voltage to the charging member. As the methods of applying a voltage to the charging member, there are a direct current method in which only a direct current voltage is applied, and an alternating current superposition method in which a direct current voltage is applied while superposing an alternating current voltage thereto. The contact charging method has such advantages as downsizing of the apparatus and suppressed generation of harmful gases such as ozone.

As a transfer method, a method of transferring a toner image onto a recording paper via an intermediate transfer member, which is applicable to a wide variety of recording paper, has been in wide use in place of a conventionally employed method in which a toner image is directly transferred onto a recording paper.

In the related arts described above, degradation and abrasion of the photoreceptor caused by using the contact charging method and also scratching and sticking of the photoreceptor caused by using the contact charging method and the intermediate transfer member have presented problems. In order to prevent these problems, a protective layer has been proposed to be formed on the surface of the electrophotographic photoreceptor so as to improve the strength thereof.

DISCLOSURE OF THE INVENTION

Summary

The present invention has been made in view of the above circumstances and provides an electrophotographic photoreceptor, a process cartridge, and an image forming apparatus.

A first aspect of the present invention provides an electrophotographic photoreceptor having at least a conductive substrate and a photosensitive layer formed on the conductive substrate, and having an outermost surface layer of the electrophotographic photoreceptor being composed of a cured material of a composition that contains at least one of compound represented by the following formula (I) and a surfactant having, in the molecule thereof, at least one of structure selected from (A) a structure obtained by polymerizing an acrylic monomer having a fluorine atom, (B) a structure having a carbon-carbon double bond and a fluorine atom, (C) an alkylene oxide structure, and (D) a structure having a carbon-carbon triple bond and a hydroxy group.

(I)

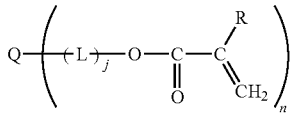

wherein in formula (I), Q is an organic group having a valency of n and having hole transportability; R is a hydrogen atom or an alkyl group; L is a divalent organic group; n is an integer of 1 or more; and j is 0 or 1.

BRIEF DESCRIPTION OF THE DRAWINGS

Exemplary embodiments of the present invention will be described in detail based on the following figures, wherein.

DETAILED DESCRIPTION OF THE INVENTION

Electrophotographic Photoreceptor

Figure 1:
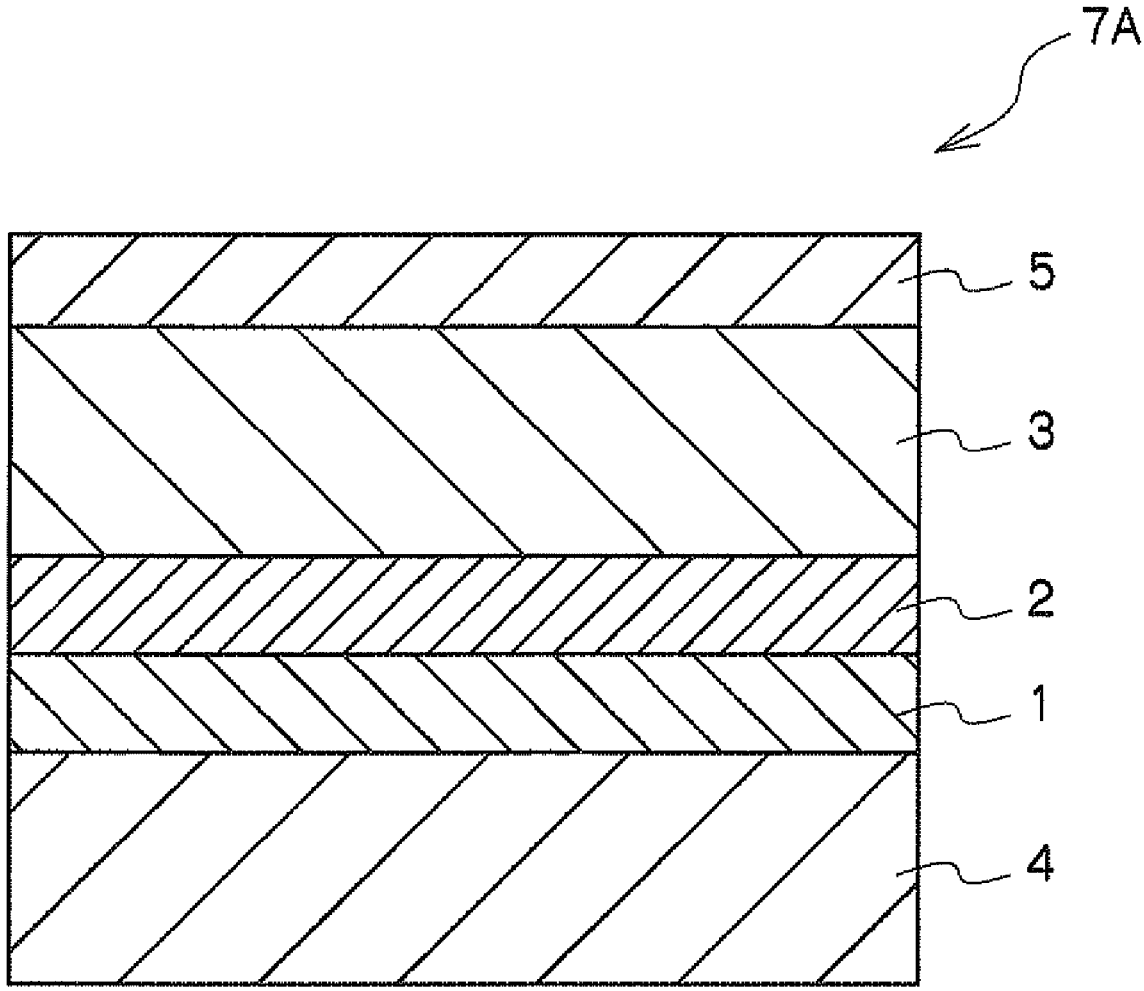
FIG. 1 is a schematic partial cross sectional view showing an electrophotographic photoreceptor according to an exemplary embodiment of the invention.

An electrophotographic photoreceptor according to the exemplary embodiments of the present invention has at least a conductive substrate and a photosensitive layer formed on the conductive substrate, and has an outermost surface layer composed of a cured material of a composition that contains at least one of compound represented by the formula (I) described below and a surfactant. The surfactant has in the molecule, at least one of structure selected from (A) a structure obtained by polymerizing an acrylic monomer having a fluorine atom, (B) a structure having a carbon-carbon double bond and a fluorine atom, (C) an alkylene oxide structure, and (D) a structure having a carbon-carbon triple bond and a hydroxyl group.

In the electrophotographic photoreceptor according to the exemplary embodiments of the present invention, owing to the above configuration, wrinkles and irregularities in the outermost surface layer are suppressed, the outermost surface layer is provided with a high mechanical strength, and degradation of electrical characteristics and image characteristics caused by repeated use over a long time is suppressed, thereby providing stable images.

The reason is not clear, but may be speculated as follows.

In the course of curing a polymerizable compound in a film form, the liquid physical properties thereof such as wettability or surface tension change remarkably. Whereby, aggregation is partially occurs, and wrinkles, irregularities and others are often brought about. In the exemplary embodiments of the present invention, by using a composition that is a combination of a compound represented by formula (I) and having a polymerizable functional group and a surfactant having a structure of (A) to (D) described above, a cured material that keeps electrical characteristics is considered to be obtained while liquid physical properties are prevented from being changed in the curing process when the cured material of the composition is formed.

As a result, wrinkles and irregularities are suppressed in the outermost surface layer that contains the cured material of the composition, the layer is provided with a high mechanical strength, and degradation of electrical characteristics and image characteristics caused by repeated use over a long time is suppressed. In addition, as a result, an electrophotographic photoreceptor having the outermost surface layer described above provides stable images.

As described above, the electrophotographic photoreceptor according to the exemplary embodiments of the present invention has the outermost surface layer containing the cured material of the composition that contains the compound represented by formula (I) and the surfactant having a specific partial structure, however, the outermost surface layer preferably serves to form the top face of the electrophotographic photoreceptor itself, and particularly preferably serves as a layer functioning as a protective layer or a layer functioning as a charge transporting layer.

When the outermost surface layer serves as a layer functioning as a protective layer, there may be mentioned a configuration in which a conductive substrate has a photosensitive layer and a protective layer serving as the outermost surface layer formed thereon, and the protective layer includes the cured material of the composition containing the compound represented by formula (I) and the surfactant having a specific partial structure.

On the other hand, when the outermost surface layer serves as a layer functioning as a charge transporting layer, there may be mentioned a configuration in which a conductive substrate has a charge generating layer and a charge transporting layer serving as the outermost surface layer formed thereon, and the charge transporting layer includes the cured material of the composition containing the compound represented by formula (I) and the surfactant having a specific partial structure.

Hereinafter, concerning the case where the outermost surface layer serves as a protective layer, an electrophotographic photoreceptor according to the exemplary embodiments of the present invention will be described in detail with reference to accompanied figures. Note that, in the figures, the same or equivalent portions are referenced by the same marks, and repeated explanations are abbreviated.

Figure 2:
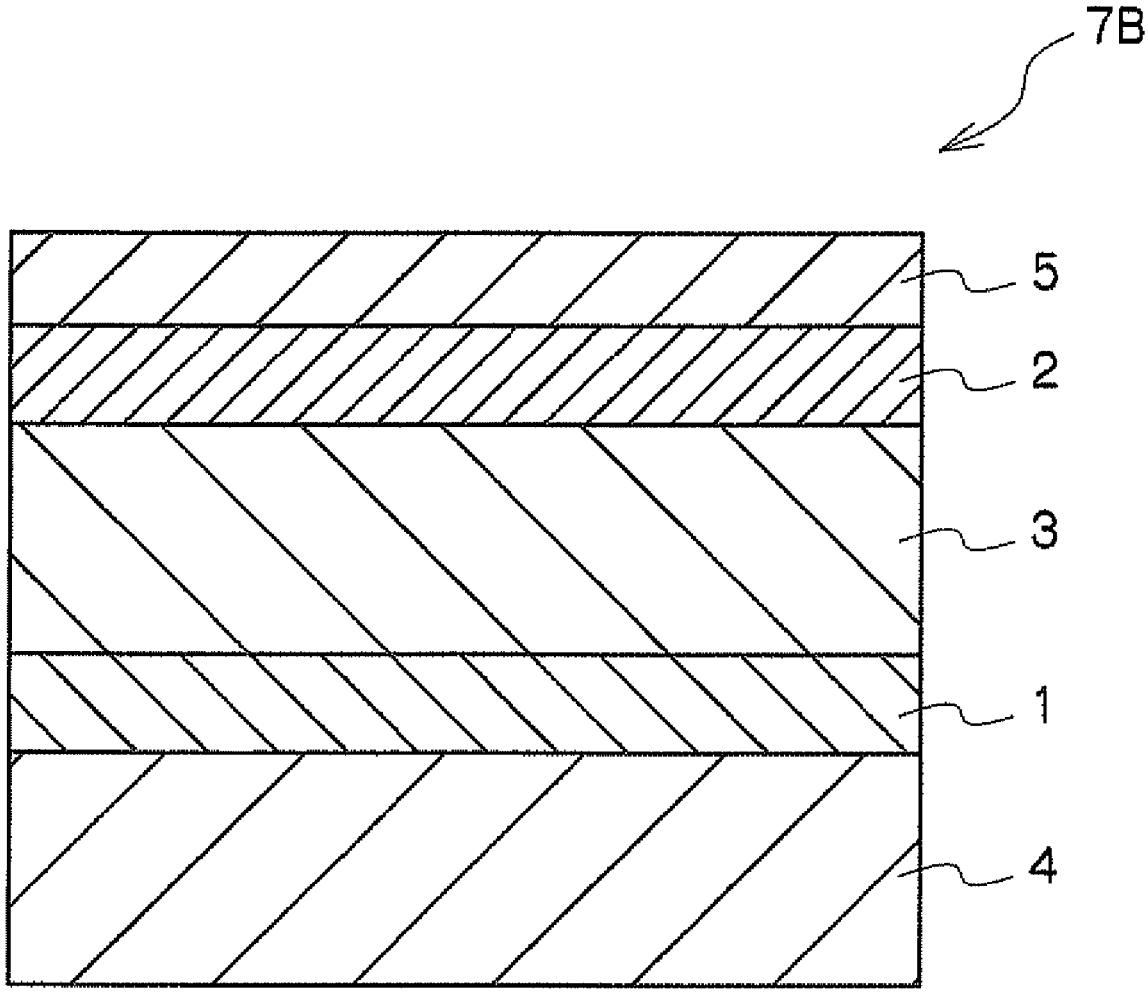
FIG. 2 is a schematic partial cross sectional view showing an electrophotographic photoreceptor according to another exemplary embodiment of the invention.
Figure 3:
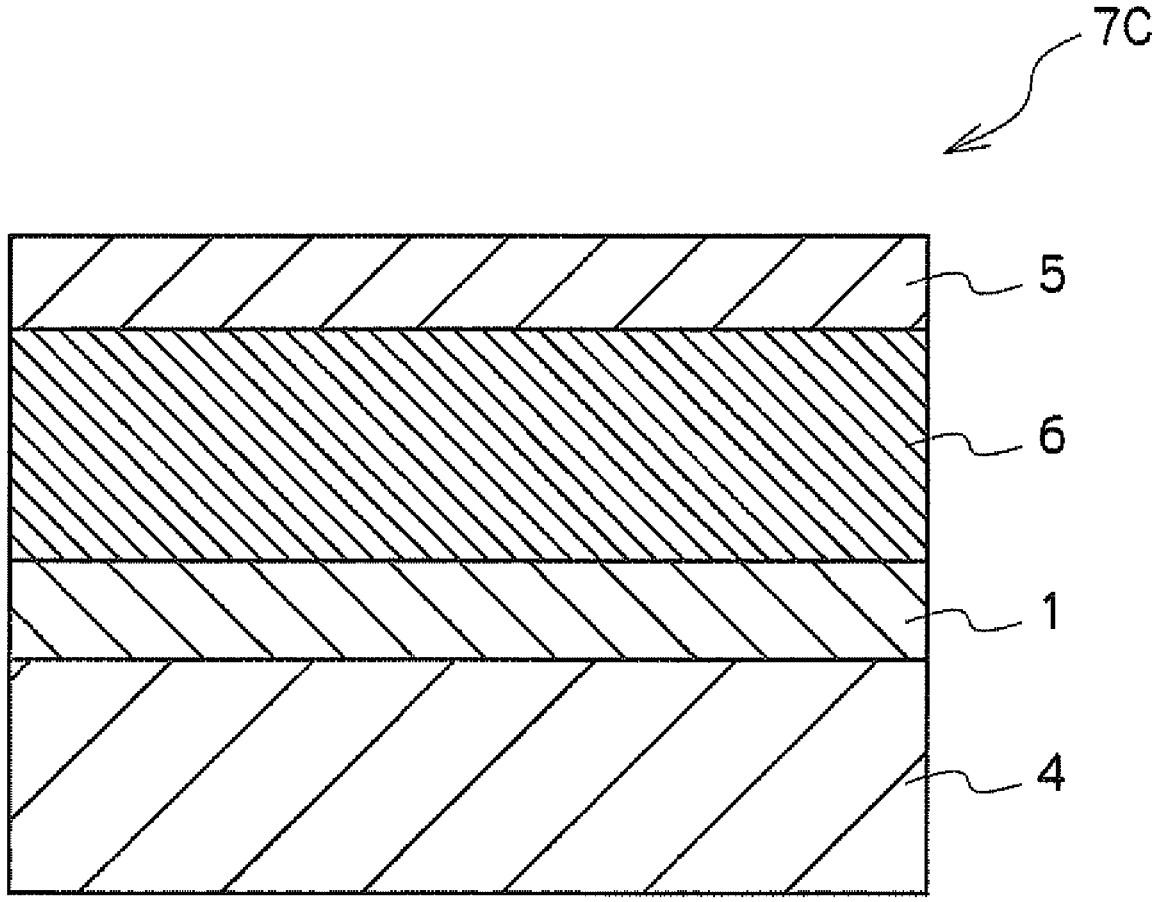
FIG. 3 is a schematic partial cross sectional view showing an electrophotographic photoreceptor according to yet another exemplary embodiment of the invention.

FIG. 1 is a schematic cross-sectional view showing a preferable exemplary embodiment of an electrophotographic photoreceptor according to the exemplary embodiments of the present invention. FIGS. 2 and 3, each is a schematic cross-sectional view showing an electrophotographic photoreceptor according to another exemplary embodiment.

An electrophotographic photoreceptor 7A shown in FIG. 1 is a so-called function-separate type photoreceptor (or multilayer photoreceptor), having a structure in which an undercoating layer 1 is formed on a conductive substrate 4, and a charge generating layer 2, a charge transporting layer 3, and a protective layer 5 are successively formed thereon. In the electrophotographic photoreceptor 7A, a photosensitive layer is composed of the charge generating layer 2 and the charge transporting layer 3.

An electrophotographic photoreceptor 7B shown in FIG. 2 is also a function-separate type photoreceptor in which functions are separated into the charge generating layer 2 and the charge transporting layer 3, similar to the electrophotographic photoreceptor 7A shown in FIG. 1. Further, an electrophotographic photoreceptor 7C shown in FIG. 3 contains a charge generating material and a charge transporting material in the same layer (a single-layer type photosensitive layer 6 (a charge generating and charge transporting layer)).

The electrophotographic photoreceptor 7B shown in FIG. 2 has a structure in which an undercoating layer 1 is formed on a conductive substrate 4, and a charge transporting layer 3, a charge generating layer 2, and a protective layer 5 are successively formed thereon. In the electrophotographic photoreceptor 7B, a photosensitive layer is composed of the charge transporting layer 3 and the charge generating layer 2.

The electrophotographic photoreceptor 7C shown in FIG. 3 has a structure in which an undercoating layer 1 is formed on a conductive substrate 4, and a single-layer type photosensitive layer 6 and a protective layer 5 are successively formed thereon.

In the electrophotographic photoreceptors 7A to 7C shown in FIGS. 1 to 3, the protective layer 5 serves as an outermost surface layer that is formed on the farthest side from the conductive substrate 2, and the outermost surface layer is configured as described above.

Note that, in the electrophotographic photoreceptors shown in FIGS. 1 to 3, the undercoating layer 1 may be formed or not formed.

Hereinafter, based on the electrophotographic photoreceptor 7A that is shown in FIG. 1 as a typical example, each constituent element will be described.

<Conductive Substrate>

Examples of the material for conductive substrate 4 include metal plates, metal drums, and metal belts using metals such as aluminum, copper, zinc, stainless steel, chromium, nickel, molybdenum, vanadium, indium, gold, platinum or alloys thereof; and paper, plastic films and belts which are coated, deposited, or laminated with a conductive compound such as a conductive polymer or indium oxide, a metal such as aluminum, palladium or gold, or alloys thereof. The term "conductive" here means that the volume resistivity is less than $10^{13}$ Ωcm.

When the electrophotographic photoreceptor 7A is used in a laser printer, the surface of the conductive substrate 4 is preferably roughened so as to have a centerline average roughness (Ra) of 0.04 μm to 0.5 μm, in order to prevent interference fringes formed upon irradiation with laser beam. When Ra is less than 0.04 μm, the surface of the electrophotographic photoreceptor is in a state close to a mirror surface and may not exhibit a satisfactory effect of preventing interference. When Ra exceeds 0.5 μm, image quality tends to be rough even if a film is formed. When incoherent light is used as a light source, surface roughening for the purpose of preventing interference fringes is not necessarily required, and therefore occurrence of defects due to surface irregularities of the conductive substrate 4 can be suppressed, which is desirable for achieving a longer operating life.

Preferred examples of the method for surface roughening include wet honing in which a suspension prepared by containing an abrasive in water is sprayed onto a substrate; centerless grinding in which a substrate is continuously ground by pressing the substrate onto a rotating grind stone; and anodic oxidation.

Other preferable methods of surface roughening include a method of forming a layer having a rough surface on the conductive substrate 4 from a resin in which conductive or semiconductive powder is dispersed, namely, obtaining a rough surface of the conductive substrate without subjecting to a roughening treatment.

In the surface-roughening treatment employing anodic oxidation, an oxide film is formed on an aluminum surface by anodic oxidation in an electrolyte solution, using the aluminum as an anode. Examples of the electrolyte solution include a sulfuric acid solution and an oxalic acid solution. However, since the porous anodic oxide film formed by anodic oxidation without any modification is chemically active, the film is prone to be contaminated and variation in resistance thereof due to environmental conditions is large. Therefore, it is preferable to conduct a sealing treatment in which fine pores in the anodic oxide film are sealed by cubical expansion caused by a hydration reaction in pressurized water vapor or boiled water (a metallic salt such as a nickel salt may be added thereto) in order to transform the anodic oxide into a more stable hydrated oxide.

The thickness of the anodic oxide film is preferably from 0.3 μm to 15 μm. When the thickness of the anodic oxide film is less than 0.3 μm, barrier properties against the injection may not be enough and sufficient effects may not be achieved. When the thickness of the anodic oxide film exceeds 15 μm, increase in residual potential may be caused due to repeated use.

The conductive substrate 4 may be subjected to a treatment with an acidic aqueous solution or a boehmite treatment. The treatment using an acidic treatment solution containing phosphoric acid, chromic acid and hydrofluoric acid is carried out by preparing an acidic treatment solution and forming a coating layer using the acidic treatment solution. The composition ratios of phosphoric acid, chromic acid and hydrofluoric acid in the acidic treatment solution are preferably 10% by weight to 11% by weight of phosphoric acid; 3% by weight to 5% by weight of chromic acid; and 0.5% by weight to 2% by weight of hydrofluoric acid. The total concentration of the acid components is preferably in a range of 13.5% by weight to 18% by weight.

The treatment temperature is preferably 42° C. to 48° C. By keeping the treatment temperature high, a thicker film can be obtained at a higher speed, compared with the case when a treatment temperature is lower than the above range. The thickness of the film is preferably 0.3 μm to 15 μm. When the thickness of the film is less than 0.3 μm, barrier properties against the injection may not be enough and sufficient effects may not be achieved.

When the thickness exceeds 15 μm, increase in residual potential may be caused due to repeated use.

The boehmite treatment is carried out by immersing the substrate in pure water at a temperature of 90° C. to 100° C. for 5 minutes to 60 minutes, or by bringing the substrate into contact with heated water vapor at a temperature of 90° C. to 120° C. for 5 minutes to 60 minutes. The film thickness is preferably 0.1 μm to 5 μm. The film may further be subjected to an anodic oxidation treatment using an electrolyte solution, such as a solution of adipic acid, boric acid, borate, phosphate, phthalate, maleate, benzoate, tartrate, or citrate, which is less capable of dissolving the film as compared with other chemical species.

<Undercoating Layer>

The undercoating layer 1 includes, for example, a binder resin containing inorganic particles.

The inorganic particles preferably have a powder resistance (volume resistivity) of from $10^2$Ω·cm to $10^{11}$Ω·cm so that the undercoating layer 1 may obtain adequate resistance in order to achieve enough leak resistance and carrier blocking properties. When the resistance value of the inorganic particles is lower than $10^2$Ω·cm, adequate leak resistance may not be achieved, and when higher than $10^{11}$Ω·cm, increase in residual potential may be caused.

Among these, as the inorganic particle having the foregoing resistance value, inorganic particles (conductive metal oxide) such as particles of tin oxide, titanium oxide, zinc oxide, or zirconium oxide may be used preferably, in particular, particles of zinc oxide is used preferably.

The inorganic particles may be subjected to a surface treatment. Two or more types of particles which have been subjected to different surface treatments, or having different particle diameters, may be used in combination. The volume average particle diameter of the inorganic particles is preferably from 50 nm to 2000 nm, and more preferably from 60 nm to 1000 nm.

The inorganic particles preferably have a specific surface area (as measured by a BET method) of 10 $m^2/g$ or more. When the specific surface area thereof is less than 10 $m^2/g$, decrease in chargeability tends to occur and favorable electrophotographic characteristics may not be obtained.

By including inorganic particles and an acceptor compound, the undercoating layer having excellent long-term stability in electrical characteristics and excellent carrier blocking properties may be obtained. Any acceptor compound with which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds, and diphenoquinone compounds such as 3,3',5,5'-tetra-t-butyl-diphenoquinone. Among these, compounds having an anthraquinone structure are preferable. Still more preferred examples are acceptor compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptor compound may be determined as appropriate within a range at which desired characteristics can be achieved, but preferably in a range of from 0.01% by weight to 20% by weight with respect to the content of the inorganic particles, and more preferably in a range of 0.05% by weight to 10% by weight with respect to the content of the inorganic particles, in terms of preventing accumulation of charges and aggregation of inorganic particles. Aggregation of the inorganic particles may cause irregular formation of conductive channels, deterioration in maintainability upon repeated use such as increase in residual potential, and image defects such as black spots as well.

The acceptor compound may be simply added to a solution for forming an undercoating layer, or may be previously attached to the surface of the inorganic particles. There are a dry method and a wet method as the methods of attaching the acceptor compound to the surface of the inorganic particles.

When the surface treatment is conducted according to a dry method, irregular distribution of the acceptor compound can be avoided by adding the acceptor compound, either directly or in a state being dissolved in an organic solvent, in a drop-wise manner to the inorganic particles and spraying the drip of the acceptor compound onto the inorganic particles with dry air or a nitrogen gas while stirring the inorganic particles with a mixer or the like having a high shearing force. The addition or spraying is preferably carried out at a temperature lower than the boiling point of the solvent. If the spraying is carried out at a temperature of not lower than the boiling point of the solvent, the solvent may evaporate before the inorganic particles are uniformly stirred and the acceptor compound may coagulate locally, making it difficult to conduct the treatment without irregularities, which is not preferable. After the addition or spraying of the acceptor compound, the inorganic particles may further be subjected to baking at a temperature of 100° C. or higher. The baking may be carried out as appropriate at a temperature and a time period at which desired electrophotographic characteristics can be obtained.

When the surface treatment is conducted according to a wet method, the inorganic particles are dispersed in a solvent by apparatuses of a stirrer, ultrasonic wave, a sand mill, an attritor, a ball mill or the like. Thereafter, the acceptor compound is added to the inorganic particles and the mixture is further stirred or dispersed, and then the solvent is removed. In this way, the treatment can be conducted without causing variation. The solvent may be removed by filtration or evaporation. After removing the solvent, the particles may be subjected to baking at a temperature of 100° C. or higher. The baking may be carried out at any temperature and time period at which desired electrophotographic characteristics can be obtained. In the wet method, moisture contained in the inorganic particles may be removed prior to adding the surface treatment agent. The moisture can be removed by, for example, stirring and heating the particles in a solvent used for the surface treatment, or by performing azeotropic removal with the solvent.

The inorganic particles may be subjected to a surface treatment prior to the addition of the acceptor compound. The surface treatment agent may be any agent with which desired characteristics may be obtained, and may be selected from known materials. Examples thereof include silane coupling agents, titanate-based coupling agents, aluminum-based coupling agents and surfactants. Among these, silane coupling agents are preferably used, in view of providing favorable electrophotographic characteristics. Moreover, a silane coupling agent having an amino group is preferably used in view of imparting favorable blocking properties to the undercoating layer 1.

As the silane coupling agent having an amino group, may be used any agent with which desired electrophotographic photoreceptor characteristics are obtained. Specific examples thereof may include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxylethyl)-γ-aminopropyltriethoxysilane, but may not be limited thereto.

The silane coupling agent may be used singly or in a combination of two or more of them. Examples of the silane coupling agent that may be used in combination with the above-described silane coupling agent having an amino group include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but the invention is not limited thereto.

Any known method is usable for the surface treatment method that uses these surface treatment agents, but a dry method or a wet method is preferably used. Addition of the acceptor compound and surface treatment with the surface treatment agents such as coupling agents may be carried out simultaneously.

The amount of the silane coupling agent with respect to the inorganic particles contained in the undercoating layer 1 may be determined as appropriate within a range at which desired characteristics may be achieved, but from the viewpoint of improving dispersibility, the amount is preferably from 0.5% by weight to 10% by weight with respect to the inorganic particles.

A binder resin may be contained in the undercoating layer 1.

As the binder resin contained in the undercoating layer 1, any known resins with which a favorable film can be formed and desired characteristics can be achieved may be used. Examples thereof include known polymer resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having a charge transporting group; and conductive resins such as polyaniline. Among these, resins which are insoluble in a coating solvent for an upper layer are particularly preferably used, and examples thereof include phenolic resins, phenol-formaldehyde resins, melamine resins, urethane resins, epoxy resins and the like. When these resins are used in a combination of two or more, the mixing ratio can be appropriately determined according to the circumstances.

In the coating solution for forming the undercoating layer, the ratio of the inorganic particles having the acceptor compound added on the surface thereof (metal oxide having an acceptor property added thereto) to the binder resin, or the ratio of the inorganic particles to the binder may be determined as appropriate within a range at which desired electrophotographic photoreceptor characteristics are obtained.

Furthermore, in the undercoating layer, various additives may be used so as to improve electrical characteristics, environmental stability, and image qualities.

As the additives, may be used known materials such as polycondensed or azo based electron transporting pigments, zirconium chelate compounds, titanium chelate compounds, aluminum chelate compounds, titanium alkoxide compounds, organic titanium compounds, or silane coupling agents. The silane coupling agents are used for the surface treatment of the inorganic particles as described above, but may be further added, as an additive, to the coating solution for forming the undercoating layer.

Specific examples of the silane coupling agent used as an additive include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra(n-butyl)titanate, butyl titanate dimer, tetra(2-ethylhexyl)titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, ethylacetoacetate aluminum diisopropylate, and aluminum tris(ethylacetoacetate).

These compounds may be used alone, or as a mixture or a polycondensate of two or more of them.

The solvent for preparing the coating solution for forming the undercoating layer may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents may be used alone or as a mixed solvent of two or more of them. Any solvent may be used to prepare the mixed solvent as long as the resultant mixed solvent is capable of dissolving the binder resin.

When the coating solution for forming the undercoating layer is prepared, as a method for dispersing the inorganic particles, may be used known methods using a roll mill, a ball mill, a vibration ball mill, an attritor, a sand mill, a colloid mill, a paint shaker, or the like.

As a coating method used for forming the undercoating layer, may be used conventional methods such as blade coating, wire bar coating, spray coating, dip coating, bead coating, air knife coating, or curtain coating.

The undercoating layer 1 is formed on the conductive substrate by using the thus prepared coating solution for forming the undercoating layer.

The Vickers hardness of the undercoating layer 1 is preferably 35 or more. The thickness of the undercoating layer 1 can be optionally determined as long as desired characteristics can be obtained, but is preferably 15 μm or more, and more preferably from 15 μm to 50 μm.

When the thickness of the undercoating layer 1 is less than 15 μm, sufficient anti-leakage properties may not be obtained, while when the thickness of the undercoating layer 1 exceeds 50 μm, residual potential tends to remain in a long-term operation to cause defects in image density.

The surface roughness of the undercoating layer 1 (ten point average roughness) is adjusted to be in a range of from $\frac{1}{4}\times n\times\lambda$ to $\frac{1}{2}\times\lambda$ ($\lambda$ represents the wavelength of the laser used for exposure, and n represents a refractive index of the upper layer), in order to prevent formation of a moire image. Particles of a resin or the like may also be added to the undercoating layer for adjusting the surface roughness. Examples of the resin particles include silicone resin particles and crosslinked polymethyl methacrylate resin particles.

Here, the undercoating layer 1 contains the binder resin and a conductive metal oxide serving as the inorganic particles, having a light transmission of 40% or less (preferably from 10% to 35% and more preferably from 15% to 30%) with respect to light at a wavelength of 950 nm at a thickness of 20 μm.

The light transmission of the undercoating layer can be measured in accordance with the following method. A coating solution for forming an undercoating layer is applied onto a glass plate to give a thickness of 20 μm after drying. After drying, light transmission to light at a wavelength of 950 nm is measured using a spectrophotometer (U-2000, trade name, manufactured by HITACHI, Ltd.).

The light transmission of the undercoating layer may be regulated by adjusting the dispersing time when the inorganic particles are dispersed with a roll mill, a ball mill, a vibration ball mill, an attritor, a sand mill, a colloid mill, a paint shaker, or the like upon preparing the coating solution for forming the undercoating layer. The dispersing time is not particularly limited, but may be an appropriate time preferably from 5 minutes to 1,000 hours, and more preferably from 30 minutes to 10 hours. When the dispersing time becomes long, the light transmission tends to be lowered.

Further, the undercoating layer may be polished in order to adjust the surface roughness thereof. Methods of polishing include buff polishing, sand blast treatment, wet honing, grinding treatment or the like.

The undercoating layer 1 is obtained by drying the coating solution for forming the undercoating layer that is coated on the conductive substrate 4, and drying is usually carried out at a temperature at which solvent is evaporable and a film is allowed to be formed.

<Charge Generating Layer>

The charge generating layer 2 is a layer that contains a charge generating material and a binder resin.

The charge generating material may include azo pigments such as bis-azo or tris-azo pigments; condensed ring aromatic pigments such as dibromoantanthrone; perylene pigments; pyrrolopyrrole pigments; phthalocyanine pigments; zinc oxide; or trigonal selenium. Among these, in order to provide compatibility with exposure of laser beam having a wavelength in a near infrared region, preferably metal phthalocyanine pigments and metal free phthalocyanine pigments are used as the charge generating material, and in particular, hydroxygallium phthalocyanine disclosed in JP-A Nos. 5-263007 and 5-279591, chlorogallium phthalocyanine disclosed in JP-A No. 5-98181, dichloro tin phthalocyanine disclosed in JP-A Nos. 5-140472 and 5-140473, and titanylphthalocyanine disclosed in JP-A No. 4-189873 are more preferably. In addition, in order to provide compatibility with exposure of laser beam having a wavelength in a near ultraviolet region, condensed ring aromatic pigments such as dibromoantanthrone, thioindigo pigments, porphyrazine compounds, zinc oxide, trigonal selenium, and the like are more preferably used as the charge generating material.

As the charge generating material, in order to provide compatibility with the case where a light source having an exposure wavelength in a range of from 380 nm to 500 nm is used, an inorganic material is preferable. In order to provide compatibility with the case where a light source having an exposure wavelength in a range of from 700 nm to 800 nm is used, metal phthalocyanine pigments and metal free phthalocyanine pigments are preferable.

Further, as the charge generating material, a hydroxygallium phthalocyanine pigment is preferably used, which has a maximum peak wavelength in a range of from 810 nm to 839 nm in a spectral absorption spectrum in a wavelength range of from 600 nm to 900 nm. The hydroxygallium phthalocyanine pigment is different from conventional V-type hydroxygallium phthalocyanine pigments and is preferable because more excellent dispersibility is obtained. In this way, by shifting the maximum peak wavelength of the molecular absorption spectrum to the shorter wavelength side as compared with the conventional V-type hydroxygallium phthalocyanine pigments, a fine hydroxygallium phthalocyanine pigment with pigment particles having a preferably controlled crystal sequence is attained, thereby providing excellent dispersibility, sufficient sensitivity, chargeability and dark decay characteristics when used as an electrophotographic photoreceptor material.

The hydroxygallium phthalozyanine pigment having a maximum peak wavelength in a range of from 810 nm to 839 nm preferably has an average particle diameter and a BET specific surface area in a certain range. Specifically, the average particle diameter is preferably 0.20 μm or less, and more preferably from 0.01 μm to 0.15 μm. The BET specific surface area is preferably 45 $m^2/g$ or more, and more preferably 50 $m^2/g$ or more, and particularly preferably from 55 $m^2/g$ to 120 $m^2/g$. The average particle diameter here is a volume average particle diameter (d50 average particle diameter) measured by a laser diffraction/scattering type particle diameter distribution tester (LA-700, trade name, manufactured by Horiba, Ltd.), and the BET specific surface area is measured by a nitrogen substitution method using a BET specific surface area analyzer (FLOWSORB II 2300, trade name, manufactured by Shimadzu Corporation).

When the average particle diameter is greater than 0.20 μm or the BET specific surface area is less than 45 $m^2/g$, it is considered that the pigment particles are coarse or an aggregate is formed. In such a case, defects in dispersibility, sensitivity, chargeability and dark decay characteristics are prone to occur, increasing the chances of forming image defects.

The maximum particle diameter (maximum primary particle diameter) of the hydroxygallium phthalozyanine pigment is preferably 1.2 μm or less, more preferably 1.0 μm or less, and particularly preferably 0.3 μm or less. When the maximum particle diameter is over the above range, minute black spots tend to generate.

Furthermore, from the viewpoint of more unfailingly suppressing the density unevenness caused by exposing the electrophotographic photoreceptor to a fluorescence lamp or the like, the hydroxygallium phthalocyanine pigment preferably has an average particle diameter of 0.2 μm or less, a maximum particle diameter of 1.2 μm or less, and a specific surface area of 45 $m^2/g$ or more.

Moreover, the hydroxygallium phthalocyanine pigment preferably has diffraction peaks at 7.5°, 9.9°, 12.5°, 16.3°, 18.6°, 25.1° and 28.3° of Bragg angles (20±0.2°) in an X-ray diffraction spectrum obtained using CuKα characteristic X rays.

The hydroxygallium phthalocyanine pigment preferably has a thermogravimetric reduction rate, when a temperature is increased from 25° C. to 400° C., of from 2.0% to 4.0%, and more preferably from 2.5% to 3.8%. The thermogravimetric reduction rate is measured by a thermobalance or the like. When the thermogravimetric reduction rate exceeds 4.0%, impurities contained in the hydroxygallium phthalocyanine pigment may affect the electrophotographic photoreceptor, causing damages in sensitivity characteristics, stability of potential upon repeated use, or image quality. On the other hand, when the thermogravimetric reduction rate is less than 2.0%, reduction in sensitivity may occur. This is thought to be that the hydroxygallium phthalocyanine pigment exerts a sensitization action by interacting with molecules of a solvent that are present in a crystal of the pigment in a small amount.

The hydroxygallium phthalocyanine pigment satisfying the above feature, having an ability of imparting optimal sensitivity and superior photoelectric characteristics to the electrophotographic photoreceptor and having superior dispersibility in a binder resin contained in the photosensitive layer, is particularly preferably used as a charge generating material from the viewpoint of improving image quality characteristics.

The binder resin used in the charge generating layer 2 can be selected from a wide range of insulating resins, and also from organic photoconductive polymers such as poly-N-vinyl carbazole, polyvinyl anthracene, polyvinyl pyrene, and polysilane. Preferable examples of the binder resin include polyvinyl butyral resins, polyarylate resins (polycondensates of bisphenols and aromatic divalent carboxylic acid, or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binder resins may be used alone or in combination of two or more. The mixing ratio of the charge generating material to the binder resin is preferably in a range of from 10/1 to 1/10 by weight ratio.

The term "insulating" here means that the resin has a volume resistivity of $10^{13}$ Ωcm or more.

The charge generating layer 2 is formed by using a coating solution for forming a charge generating layer, in which the charge generating material and binder resin described above are dispersed in a predetermined solvent.

Examples of the solvent used for the dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used alone or in a combination of two or more.

The method of dispersing a charge generating material and a binder resin in a solvent may be any ordinary method such as ball mill dispersion, attritor dispersion or sand mill dispersion. By employing these dispersion methods, deformation of crystals of the charge generating material caused by a dispersion process can be prevented. The average particle diameter of the charge generating material to be dispersed is preferably 0.5 μm or less, more preferably 0.3 μm or less, and further preferably 0.15 μm or less.

The method of forming the charge generating layer 2 may be any conventional methods such as blade coating, Meyer bar coating, spray coating, dip coating, bead coating, air knife coating, or curtain coating.

The film thickness of the charge generating layer 2 obtained by the above-described method is preferably 0.1 μm to 5.0 μm, and more preferably 0.2 μm to 2.0 μm.

<Charge Transport Layer>

The charge transport layer 3 includes a charge transporting material and a binder resin, or includes a polymer charge transporting material.

Examples of the charge transporting material include electron transporting compounds, e.g., quinone-based compounds such as p-benzoquinone, chloranil, bromanil and anthraquinone, tetracyanoquinodimethane-based compounds, fluorenone compounds such as 2,4,7-trinitrofluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in a combination of two or more of them, but are not limited thereto.

As the charge transporting material, from the viewpoint of charge mobility, triarylamine derivatives represented by the following formula (a-1) and benzidine derivatives represented by the following formula (a-2) are preferable.

(a-1)

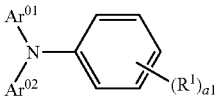

In formula (a-1), $R^1$ is a hydrogen atom or a methyl group; a1 is 1 or 2; $Ar^{01}$ and $Ar^{02}$ are each independently a substituted or unsubstituted aryl group, $—C_6H_4—C(R^2)=C(R^3)(R^4)$, or $—C_6H_4—CH=CH—CH=C(R^5)(R^6)$; and $R^2$ to $R^6$ are each independently a hydrogen atom, a substituted or unsubstituted alkyl group, or a substituted or unsubstituted aryl group.

Here, the substituent for each group may include a halogen atom, an alkyl group having from 1 to 5 carbon atoms, an alkoxy group having from 1 to 5 carbon atoms, and a substituted amino group substituted by an alkyl group having from 1 to 3 carbon atoms.

(a-2)

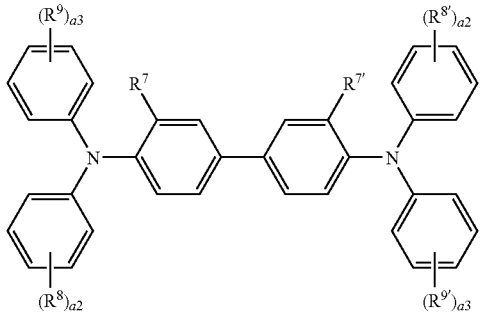

In formula (a-2), $R^7$ and $R^{7'}$ are each independently a hydrogen atom, a halogen atom, an alkyl group having from 1 to 5 carbon atoms, or an alkoxy group having from 1 to 5 carbon atoms; $R^8$, $R^{8'}$, $R^9$, $R^{9'}$ are each independently a hydrogen atom, a halogen atom, an alkyl group having from 1 to 5 carbon atoms, an alkoxy group having from 1 to 5 carbon atoms, an amino group substituted by an alkyl group having 1 or 2 carbon atoms, a substituted or unsubstituted aryl group, $—C(R^{10})=C(R^{11})(R^{12})$, or $—CH=CH—CH=C(R^{13})(R^{14})$; $R^{10}$ to $R^{14}$ are each independently a hydrogen atom, a substituted or unsubstituted alkyl group, or a substituted or unsubstituted aryl group; and a2 and a3 are each independently an integer of from 0 to 2.

Here, among the triarylamine derivatives represented by formula (a-1) and benzidine derivatives represented by formula (a-2), a triarylamine derivative having $—C_6H_4—CH=CH—CH=C(R^5)(R^6)$ and a benzidine derivative having $—CH=CH—CH=C(R^{13})(R^{14})$ are particularly preferable from the viewpoints of charge mobility, adhesion to the protective layer, and image lag (hereinafter, also referred to as "ghost") that is generated by persisting history of previous images.

Examples of the binder resin used in the charge transport layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole, and polysilane. These binder resins may be used alone or in a combination of two or more. The mixing ratio of the charge transporting material to the binder resin is preferably from 10/1 to 1/5 by weight ratio.

The binder resin is not particularly limited, but preferably include at least one selected from a polycarbonate resin having a viscosity-average molecular weight of from 50,000 to 80,000 or a polyarylate resin having a viscosity-average molecular weight of from 50,000 to 80,000, from the viewpoint of forming a favorable film.

Further, as the charge transporting material, a polymer charge transporting material may be used. As the polymer charge transporting material, known materials having charge transportability such as poly-N-vinylcarbazole or polysilane may be used. In particular, the polyester-based polymer charge transporting material disclosed in JP-A Nos. 8-176293 and 8-208820 has a higher charge transportability as compared with the other kinds and is particularly preferable. The polymer charge transporting material is film-formable by itself, but may be mixed with the aforementioned binder resin when it is formed into a film.

The charge transport layer 3 may be formed using the coating solution containing the above-described materials. Examples of the solvent used for the coating solution for forming the charge transport layer include ordinary organic solvents, e.g., aromatic hydrocarbons such as benzene, toluene, xylene and chlorobenzene; ketones such as acetone and 2-butanone; aliphatic hydrocarbon halides such as methylene chloride, chloroform and ethylene chloride; and cyclic or straight-chained ethers such as tetrahydrofuran and ethyl ether. These solvents may be used alone or in combination of two or more kinds. As the method for dispersing the above-described materials, known methods may be used.

As the method for applying the coating solution for forming the charge transport layer onto the charge generating layer 2, ordinary methods such as blade coating, Meyer bar coating, spray coating, dip coating, bead coating, air knife coating and curtain coating may be used.

The film thickness of the charge transport layer 3 is preferably from 5 μm to 50 μm, and more preferably from 10 μm to 30 μm.

<Protective Layer>

The protective layer 5 is a layer that serves as an outermost surface layer of the electrophotographic photoreceptor 7A and is formed so as to provide resistances against abrasion, scratches or the like and to increase toner transferring efficiency.

The protective layer 5 serves as an outermost surface layer, so that the protective layer 5 is composed of a cured material of a compound that contains at least one kind of compound represented by the following formula (I) and a surfactant that has at least one kind of structure selected from (A) a structure obtained by polymerizing an acrylic monomer having a fluorine atom, (B) a structure having a carbon-carbon double bond and a fluorine atom, (C) an alkylene oxide structure, and (D) a structure having a carbon-carbon triple bond and a hydroxyl group.

(I)

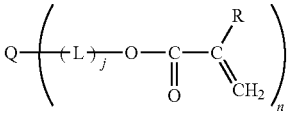

In formula (I), Q is an organic group having a valency of n and hole transportability; R is hydrogen atom or an alkyl group; L is a divalent organic group; n is an integer of 1 or more; and j is 0 or 1.

Compound Represented by Formula (I)

At first, a compound represented by formula (I) is described.

Q in formula (I) is an organic group having a valency of n and hole transportability. The organic group may include an organic group derived from arylamine derivatives, that is, an organic group that is obtained by removing n hydrogen atoms from arylamine derivatives. An organic group having a valency of n, derived from arylamine derivatives such as triphenylamine derivatives or tetraphenylbenzidine derivatives is preferable.

n in formula (I) represents an integer of 1 or more, but preferably 2 or more and more preferably 4 or more from the viewpoints of increasing crosslink density and obtaining a crosslinked film (cured material) with higher strength. Further, as the upper limit of n, 20 is preferable and 10 is more preferably considering stability of coating solution and electrical characteristics.

By selecting n within the above preferable range, particularly, rotational torque of an electrophotographic photoreceptor is reduced when a blade cleaner is used, thereby suppressing damages to the blade and abrasion of the electrophotographic photoreceptor. The details of this reason are not clear, but a cured film with a high crosslink density may be obtained by increasing the number of reactive functional groups, and the interaction between the surface molecules of the blade material and the surface molecules of the electrophotographic photoreceptor may be weakened by suppressing the molecular motion in the outermost surface of the electrophotographic photoreceptor.

Further, R in formula (I) represents a hydrogen atom or an alkyl group. As the alkyl group, a straight chain or branched alkyl group having from 1 to 5 carbon atoms is preferable.

Among these, R is preferably a methyl group. That is, in a compound represented by formula (I), the end group of the substituent in parentheses is preferably methacryloyl group. The reason of this is not necessarily clear, but the present inventors speculate as follows.

Usually, a highly reactive acryl group is often used for curing reactions, but when the highly reactive acryl group is used as the substituent for a bulky charge transporting material such as the compound represented by formula (I), non-uniform curing reaction tends to occur and a microscopic (or macroscopic) sea-island structure is considered to easily form. In the fields other than electronics, such sea-island structure hardly brings about problems in particular, but in the case of an electrophotographic photoreceptor, problems such as wrinkles and irregularities of an outermost surface layer thereof or irregularities of images may occur. Because of this reason, R is preferably a methyl group.

Note that, the sea-island structure is considered to be particularly remarkably formed when plural functional groups are attached to one charge transporting structure (Q in formula (I)).

Further, L in formula (I) represents a divalent organic group. As the divalent organic group, an organic group including an alkylene group having two or more carbon atoms is preferable. Still further, j is preferably 1 in terms of electrical characteristics and mechanical strength. The reasons why such structure is preferable are not necessarily clear, but the present inventors speculate as follows.

When a radical polymerizable substituent is polymerized, in a structure as seen in the compound represented by formula (I) in which generated radicals easily move to a charge transporting structure (Q in formula (I)), the generated radicals lower the charge transporting function, thereby introducing degradation in electrical characteristics, presumably. Regarding mechanical strength, presumably, when a bulky charge transporting structure is positioned close to polymerizable portions in a rigid conformation, the polymerizable portions become difficult to move with each other and reaction opportunities are lowered greatly. From these reasons, it may be preferable that L contains an alkylene group having two or more carbon atoms and j is 1.

Here, when L is an organic group containing an alkylene group having two or more carbon atoms, the organic group may be composed of only an alkylene group having two or more carbon atoms or may be a combination of an alkylene group having two or more carbon atoms and a divalent group such as alkenylene, alkynylene, ether, thioether, ester, or arylene (for example, phenylene). The upper limit of the carbon atom number of the alkylene group is preferably 20 and more preferably 10, from the viewpoint of strength.

The compound represented by formula (I) is preferably a compound represented by the following formula (II). The compound represented by formula (II) exhibits excellent charge mobility or stability against oxidation, in particular.

(II)

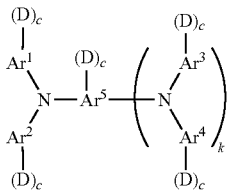

In formula (II), $Ar^1$ to $Ar^4$ are each independently a substituted or unsubstituted aryl group; $Ar^5$ is a substituted or unsubstituted aryl group or a substituted or unsubstituted arylene group; D is $-(L)_j-O-CO-C(R)=CH_2$; five cs, are each independently 0 or 1; k is 0 or 1; the total number of D is 1 or more; and R is a hydrogen atom or a straight-chain or branched alkyl group having from 1 to 5 carbon atoms.

The total number of D in formula (II) corresponds to n in formula (I), and is preferably 2 or more and more preferably 4 or more from the viewpoints of increasing crosslink density and obtaining a crosslinked film (cured material) having higher strength.

Further, as described above, R is preferably a methyl group.

In formula (II), $Ar^1$ to $Ar^4$ are each independently a substituted or unsubstituted aryl group. $Ar^1$ to $Ar^4$ may be the same or different from each other.

Here, the substituent in the substituted aryl group, other than D: $-(L)_j-O-CO-C(R)=CH_2$, may include an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom.

As $Ar^1$ to $Ar^4$, any one of the following formulae (1) to (7) is preferable. Note that, the following formulae (1) to (7) are shown along with "$-(D)_C$" that is linkable to each of $Ar^1$ to $Ar^4$. Here, "$-(D)_C$" has the same meaning as "$-(D)_C$" in formula (II) and includes similar preferable examples.

(1)

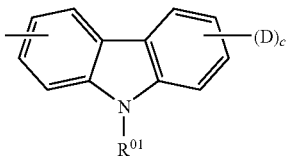

(2)

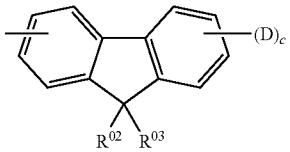

(3)

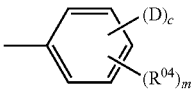

(4)

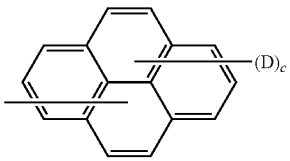

(5)

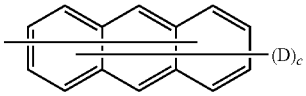

(6)

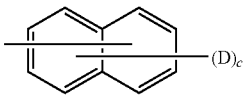

(7)

$$-Ar-(Z')_p-Ar-(D)_c$$

In formula (I), $R^{01}$ is one selected from the group consisting of a hydrogen atom, an alkyl group having from 1 to 4 carbon atoms, a phenyl group substituted by an alkyl group having from 1 to 4 carbon atoms or an alkoxy group having from 1 to 4 carbon atoms, an unsubstituted phenyl group, and an aralkyl group having from 7 to 10 carbon atoms.

In formulae (2) and (3), $R^{02}$ to $R^{04}$ are each independently a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, or a halogen atom. m is an integer of from 1 to 3.

In formula (7), Ar is a substituted or unsubstituted arylene group.

Here, as Ar in formula (7), the one represented by the following formulae (8) or (9) is preferable.

(8)

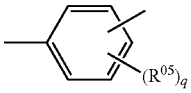

(9)

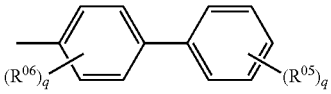

In formulae (8) and (9), $R^{05}$ and $R^{06}$ are each independently one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom; and q is an integer of from 1 to 3.

In formula (7), Z' is a divalent organic linking group, and is preferably the one represented by any one of the following formulae (10) to (17). Further, p is 0 or 1.

(10)

$$-(CH_2)_r-$$

(11)

$$-(CH_2CH_2O)_s-$$

(12)

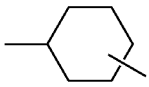

(13)

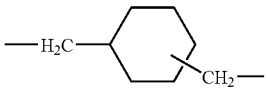

(14)

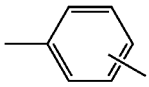

-continued (15)

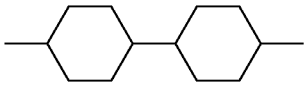

(16)

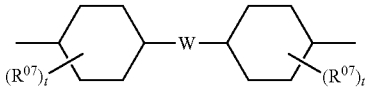

(17)

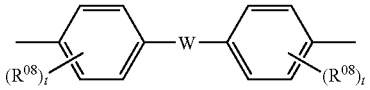

In formulae (10) to (17), $R^{07}$ and $R^{08}$ are each independently one selected from the group consisting of a hydrogen atom, an alkyl group having from 1 to 4 carbon atoms a phenyl group substituted by an alkyl group having from 1 to 4 carbon atoms or an alkoxy group having from 1 to 4 carbon atoms, an unsubstituted phenyl group, an aralkyl group having from 7 to 10 carbon atoms, and a halogen atom; W is a divalent group; r and s are each independently an integer of from 1 to 10; and t is an integer of from 1 to 3.

In formulae (16) and (17), W is preferably a divalent group represented by any one of formulae (18) to (26). In formula (25), u represents an integer of from 0 to 3.

(18) $-CH_2-$

(19) $-C(CH_3)_2-$

(20) $-O-$

(21) $-S-$

-continued

(22) $-C(CF_3)_2-$

(23) $-Si(CH_3)_2-$ (24)

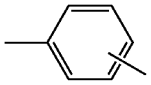

(25)

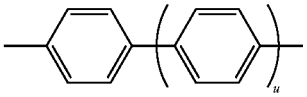

(26)

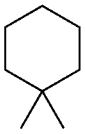

In formula (II), $Ar^5$ is a substituted or unsubstituted aryl group when k is 0. The aryl group may include similar aryl groups exemplified in the explanation of $Ar^1$ to $Ar^4$. Further, $Ar^5$ is a substituted or unsubstituted arylene group when k is 1. The arylene group may include an arylene group that is obtained by removing one hydrogen atom at a predetermined position from the aryl group exemplified in the explanation of $Ar^1$ to $Ar^4$.

Specific examples of the compound represented by formula (I) are shown below. Note that, the compound represented by formula (I) is not limited to these examples.

At first, specific examples (compound iv-1 to iv-18) of the compound that is obtained by selecting 4 as n in formula (I), a specific example (compound v-1) of the compound that is obtained by selecting 5 as n in formula (I), and specific examples (compound vi-1 and vi-2) of the compound that is obtained by selecting 6 as n in formula (I) are described.

| No. |
|---|
| iv-1 |

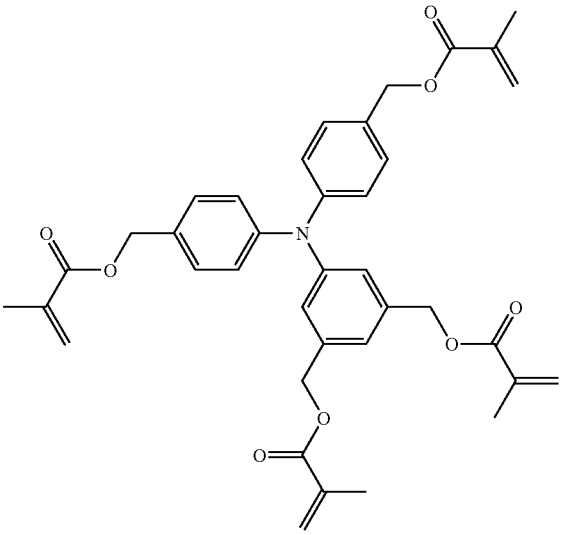

-continued
| No. | |
|---|---|
| iv-2 | 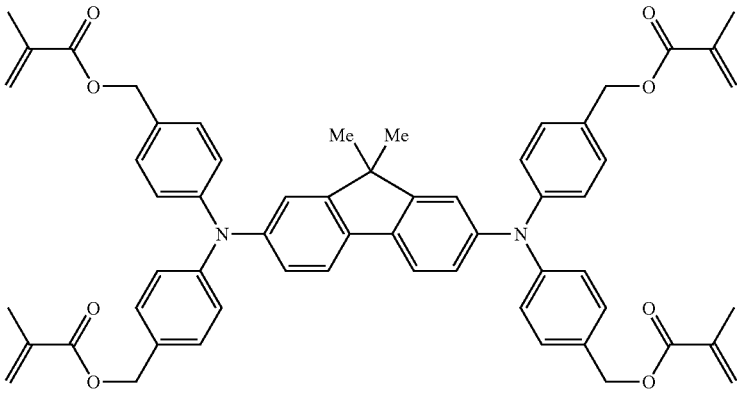 |
| iv-3 | 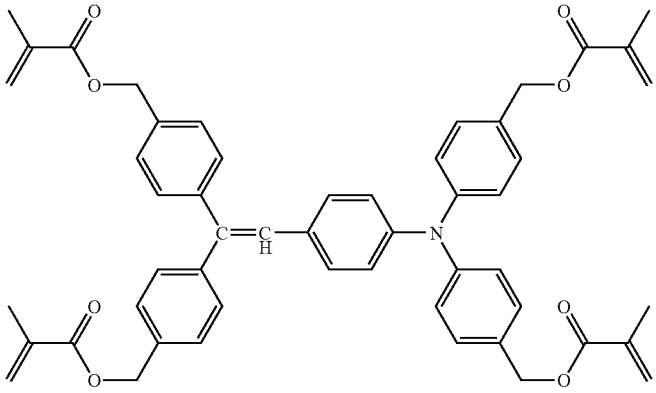 |
| iv-4 | 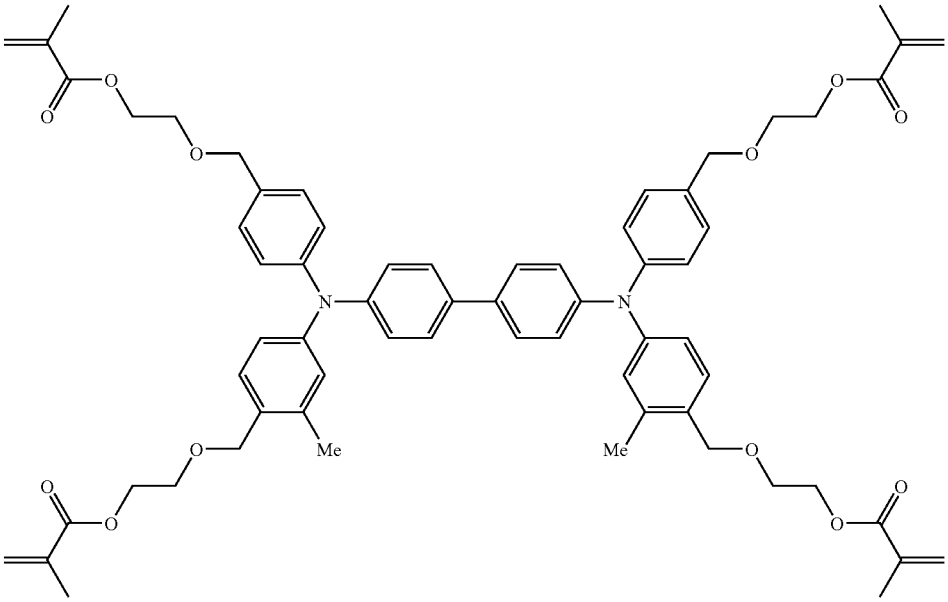 |

-continued
| No. | |
|---|---|
| iv-5 | 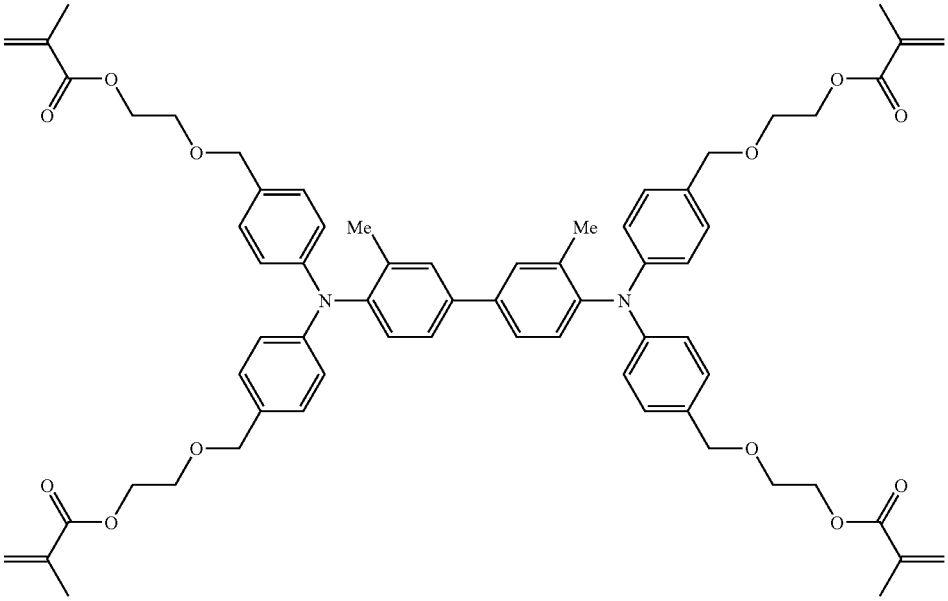 |
| iv-6 | 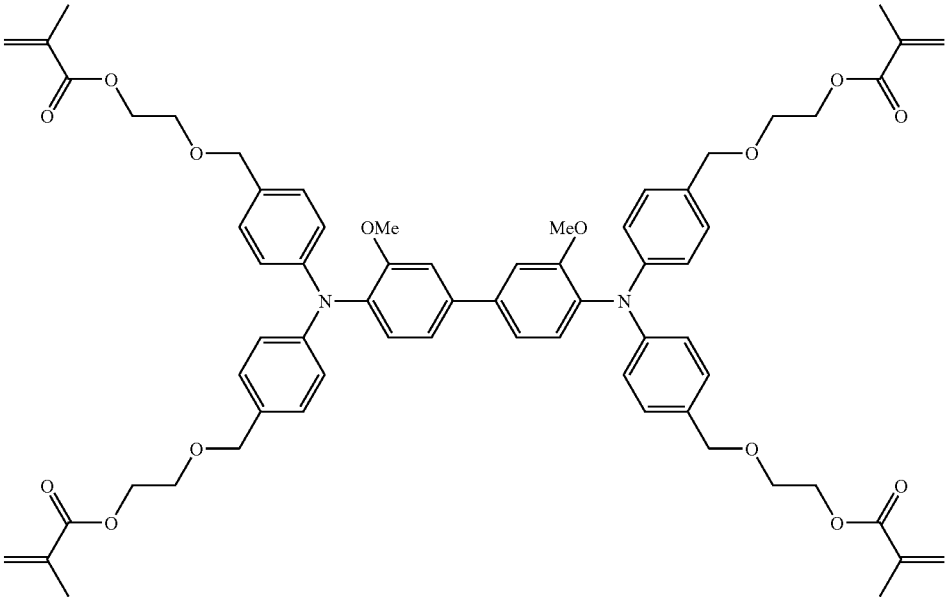 |

-continued
| No. | |
|---|---|
| iv-7 | 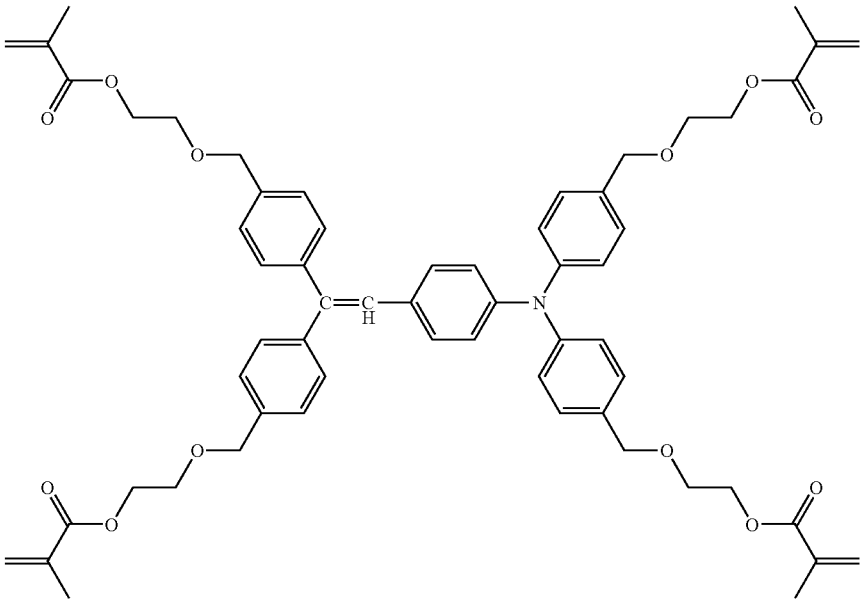 |
| iv-8 | 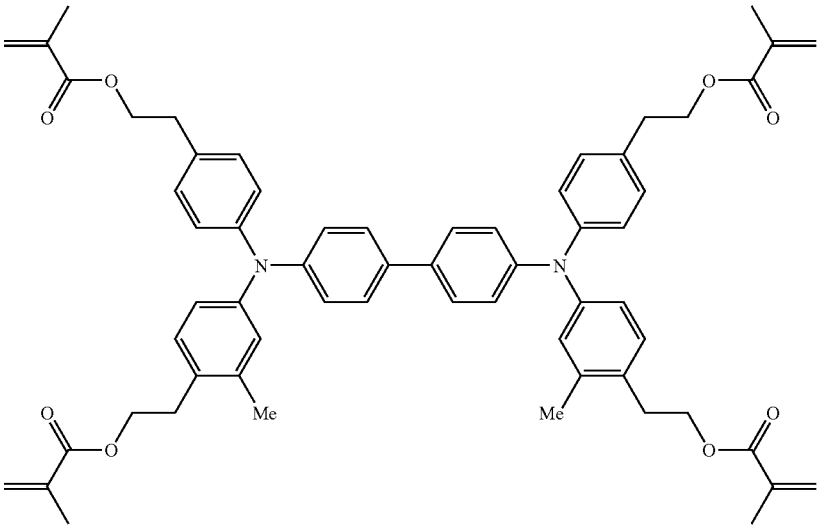 |
| iv-9 | 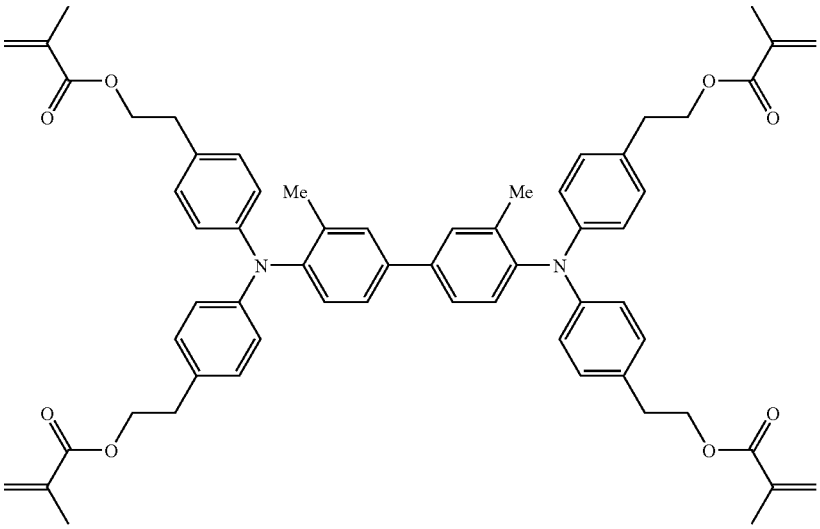 |

-continued
No.
iv-10
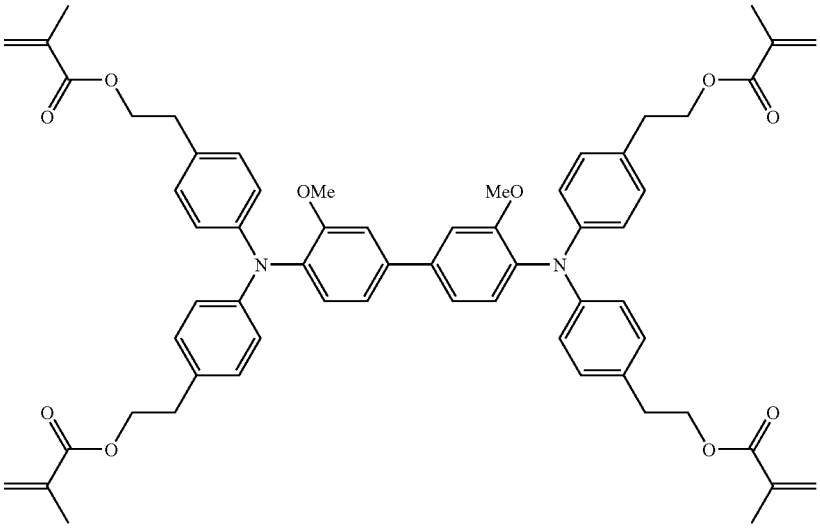
iv-11
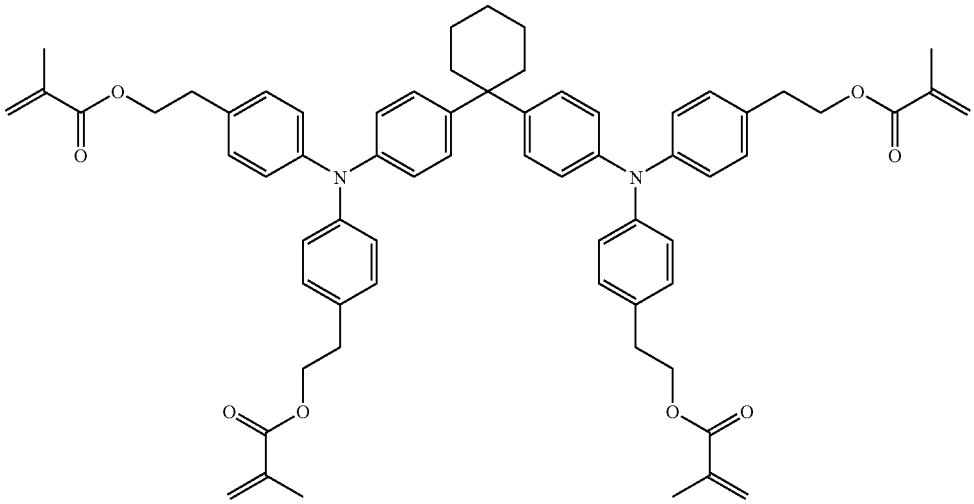
iv-12
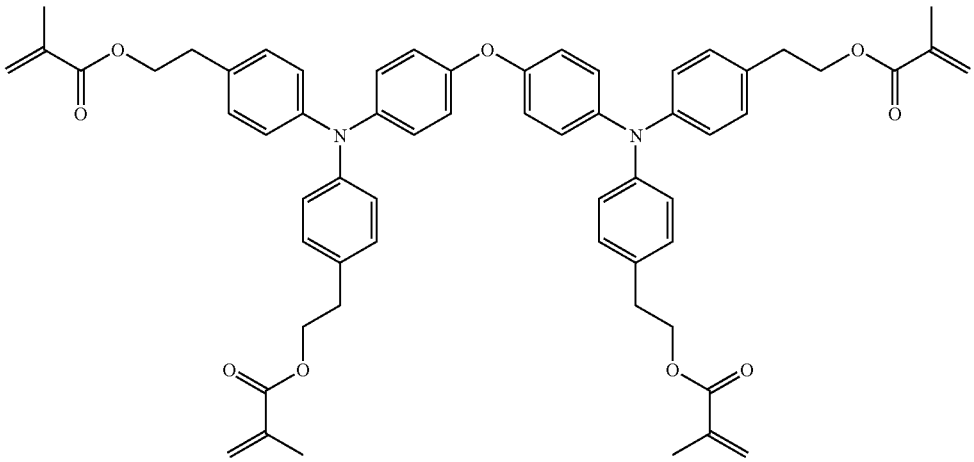

-continued
| No. | |
|---|---|
| iv-13 | 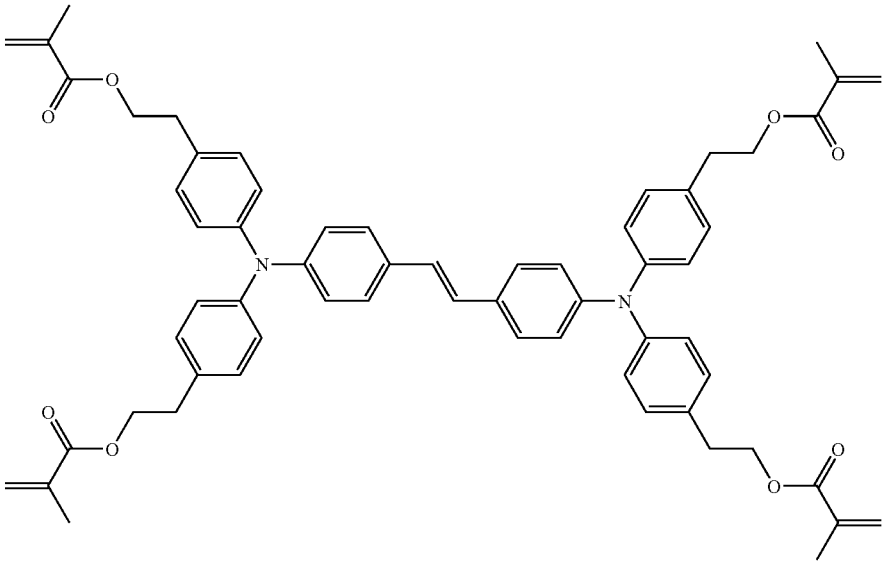 |
| iv-14 | 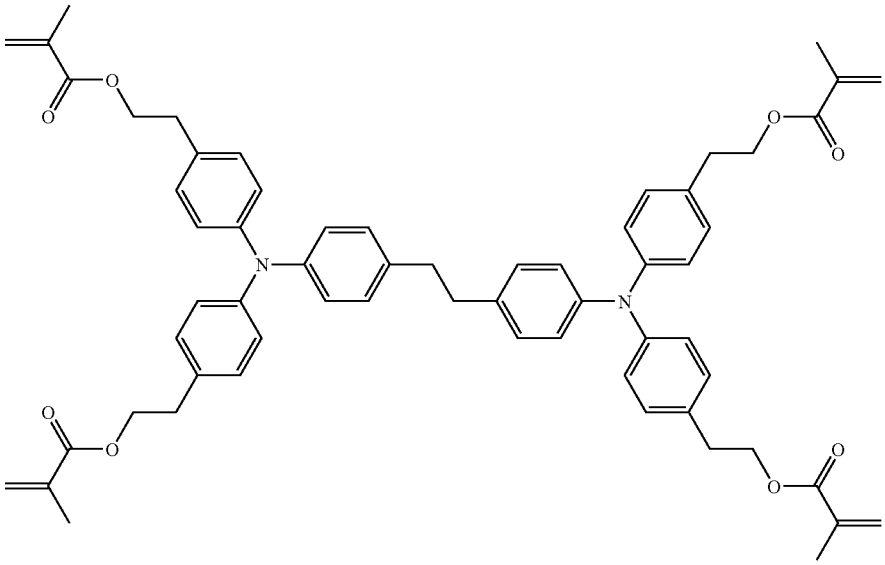 |
| iv-15 | 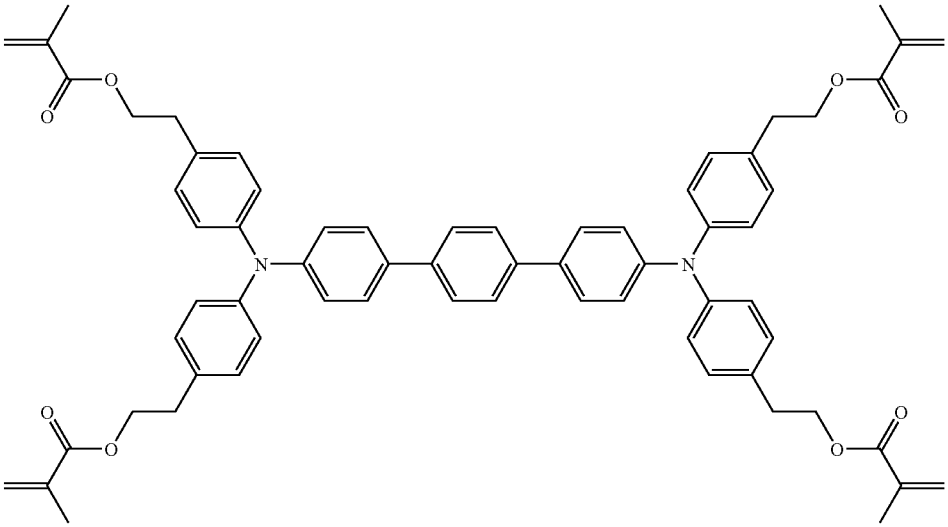 |

-continued
| No. | |
|---|---|
| iv-16 | 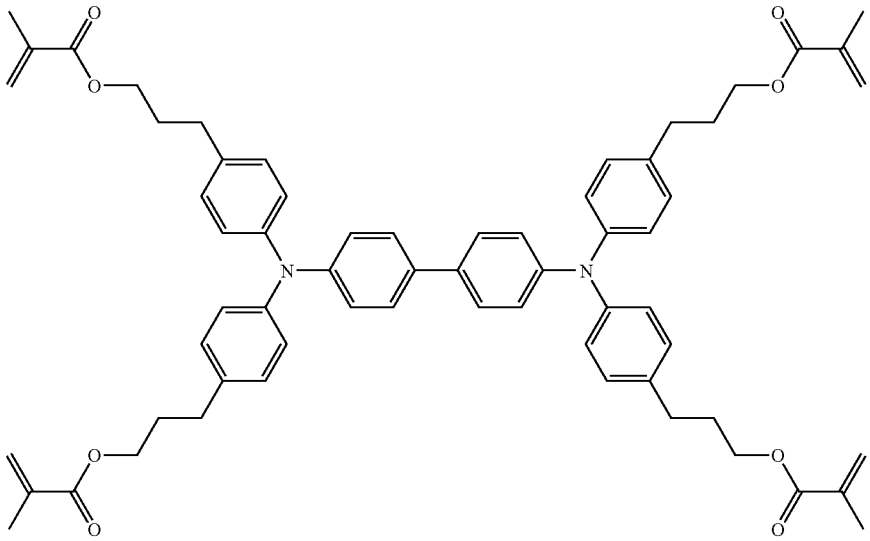 |
| iv-17 | 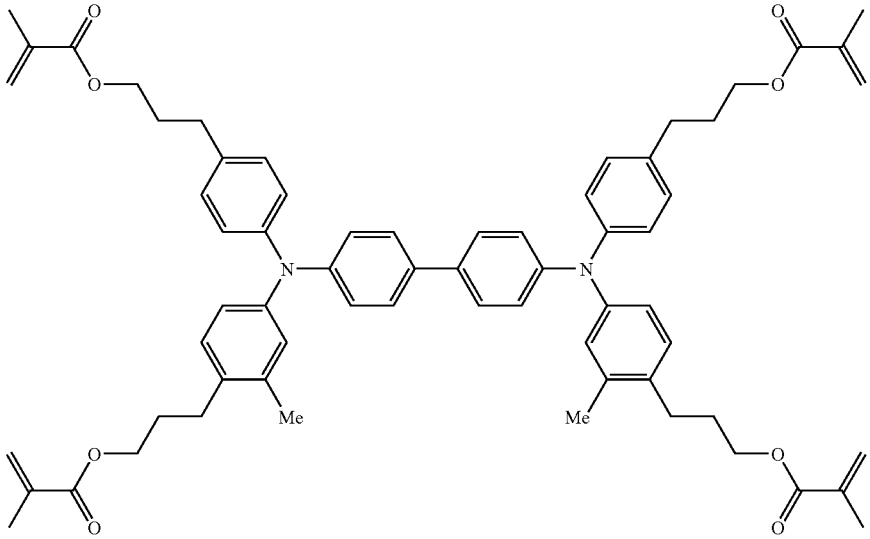 |
| iv-18 | 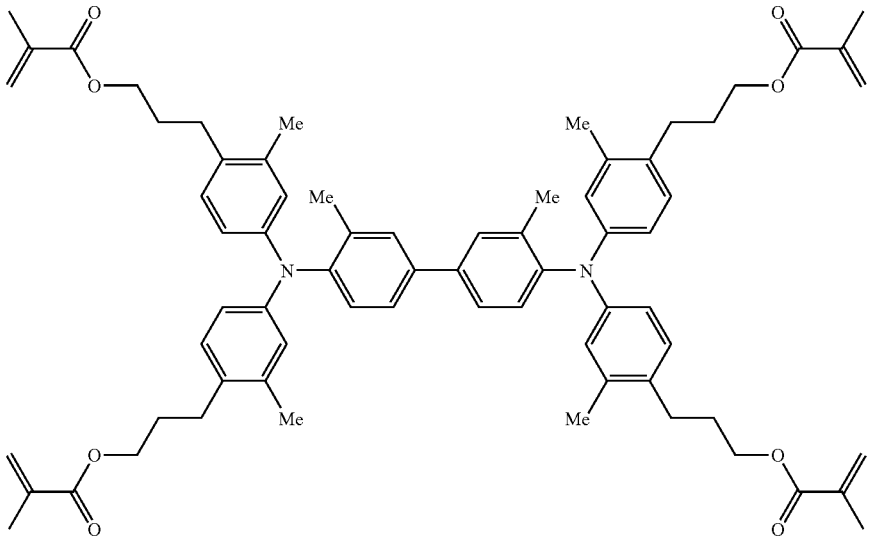 |

-continued
| No. |
| --- |
| v-1 |
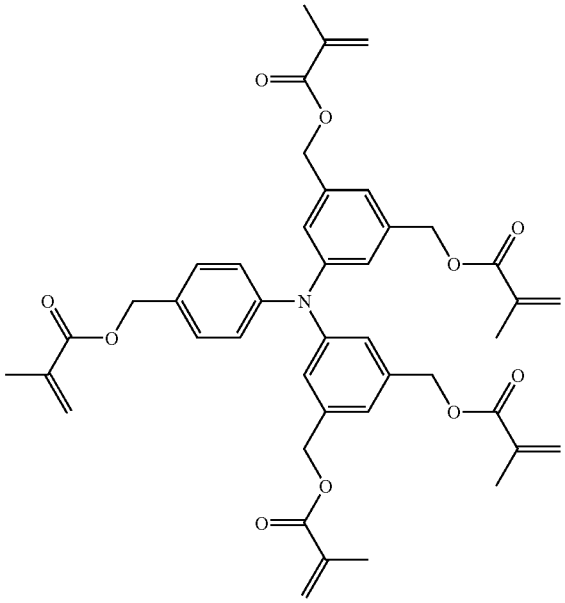
vi-1
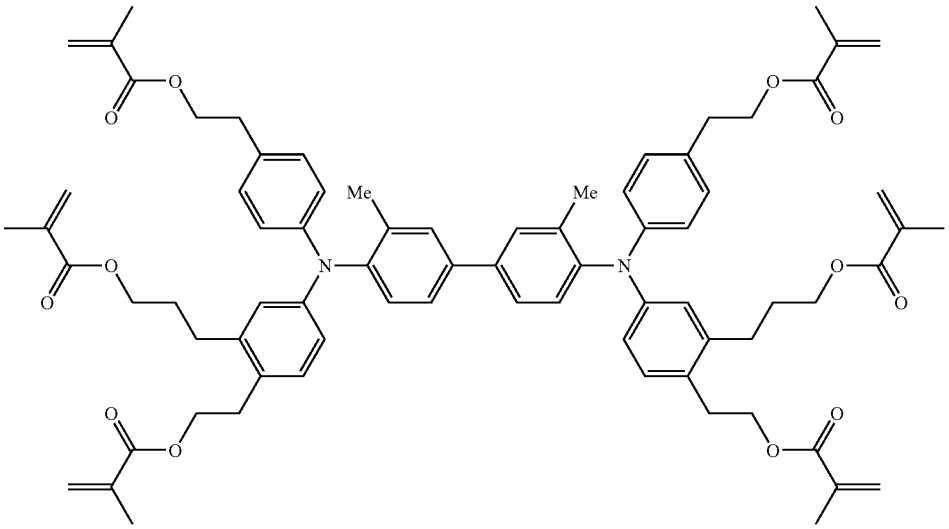

-continued
| No. | |
|---|---|
| vi-2 | 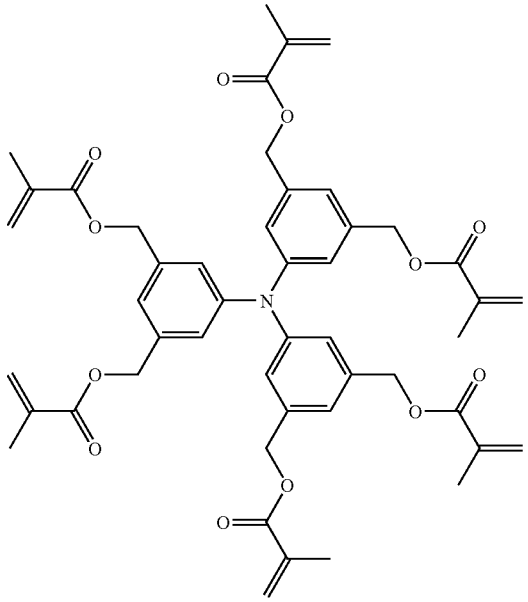 |
A compound that is obtained by selecting 4 or more as n in formula (I) may be synthesized through a process similar to the synthesis paths of a compound A-4 and a compound A-17 that are described later.
As an example, the synthesis path of the compound A-4 and the synthesis path of the compound A-17 are described below.
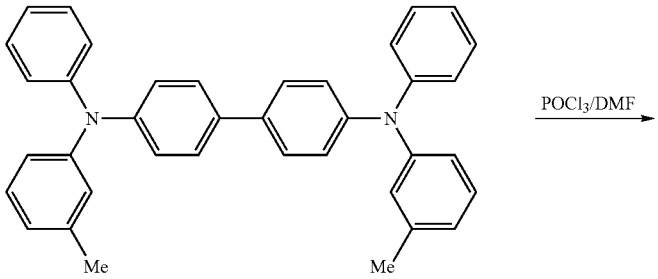
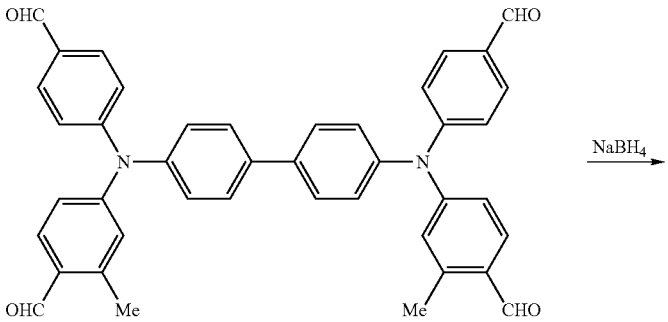

-continued
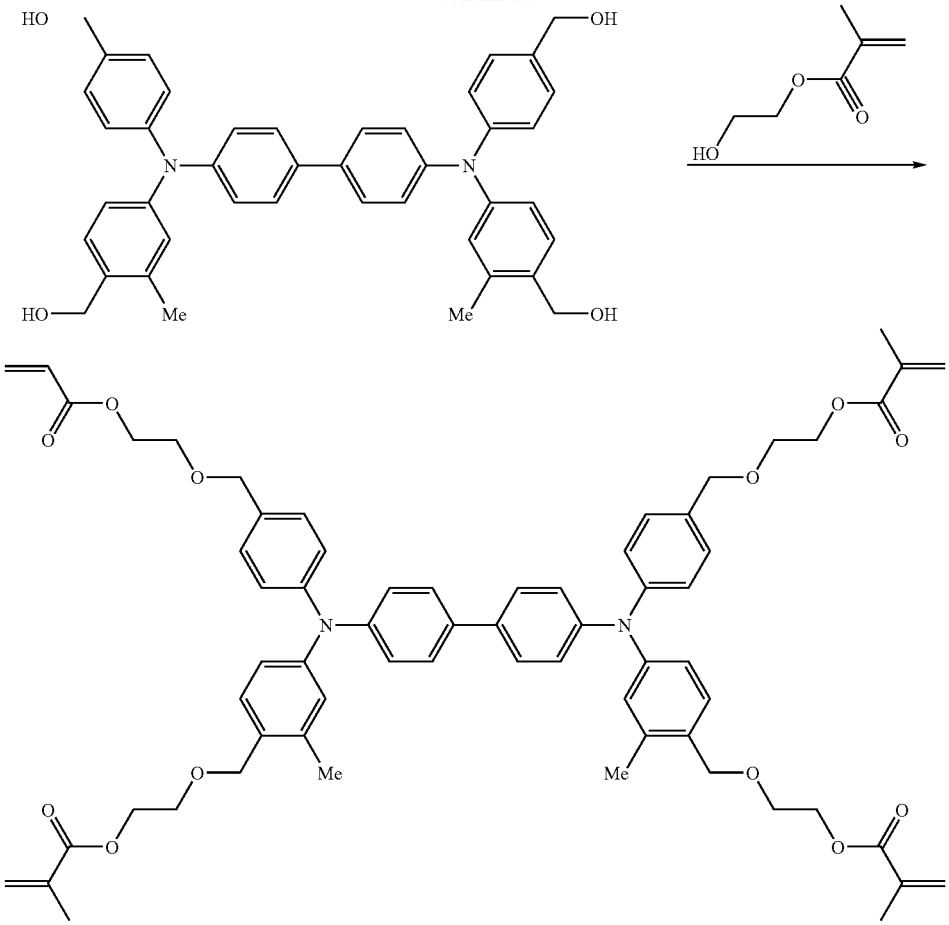
Compound A-4
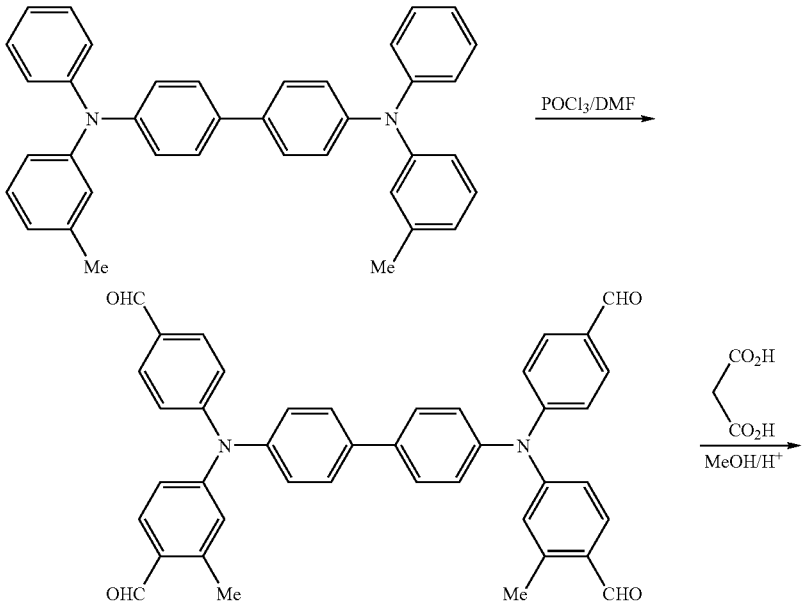

-continued
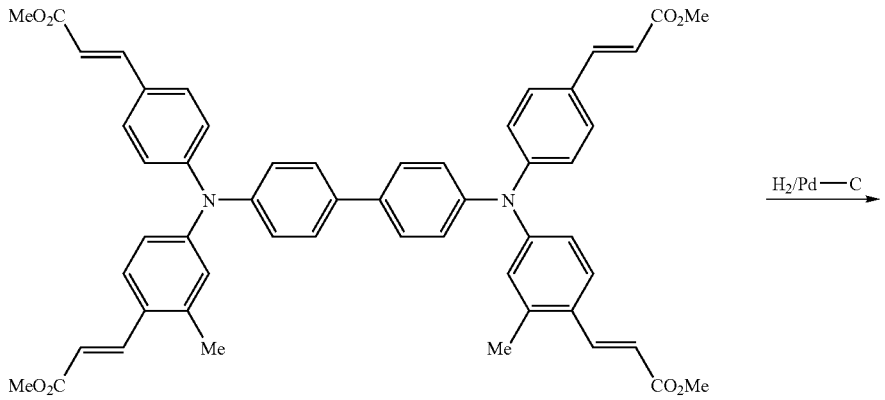
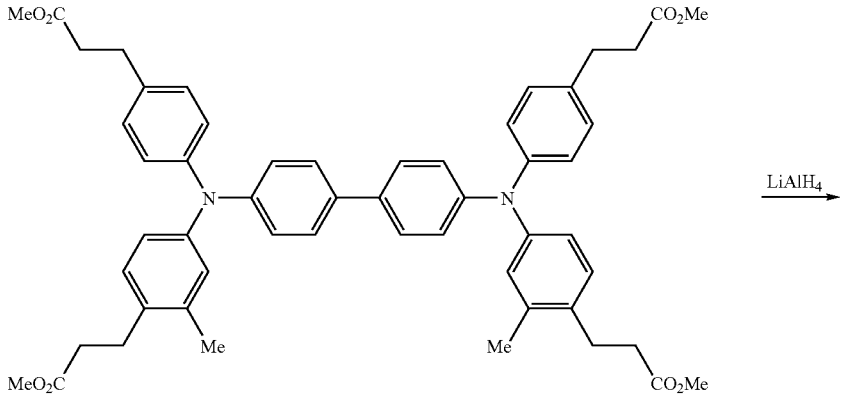
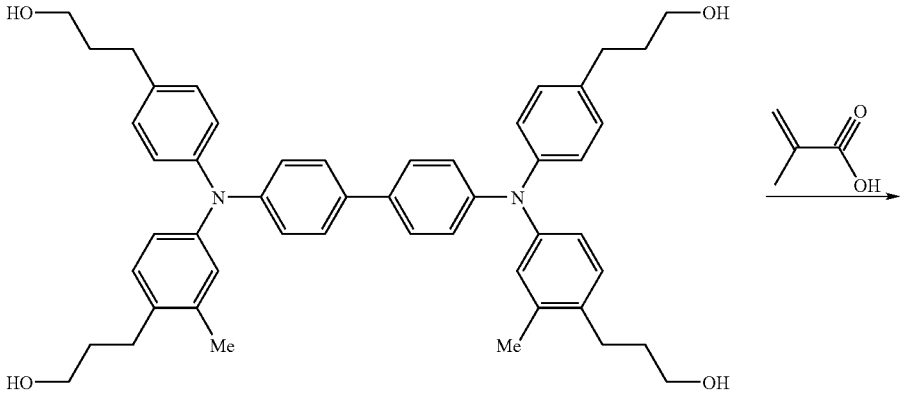

-continued
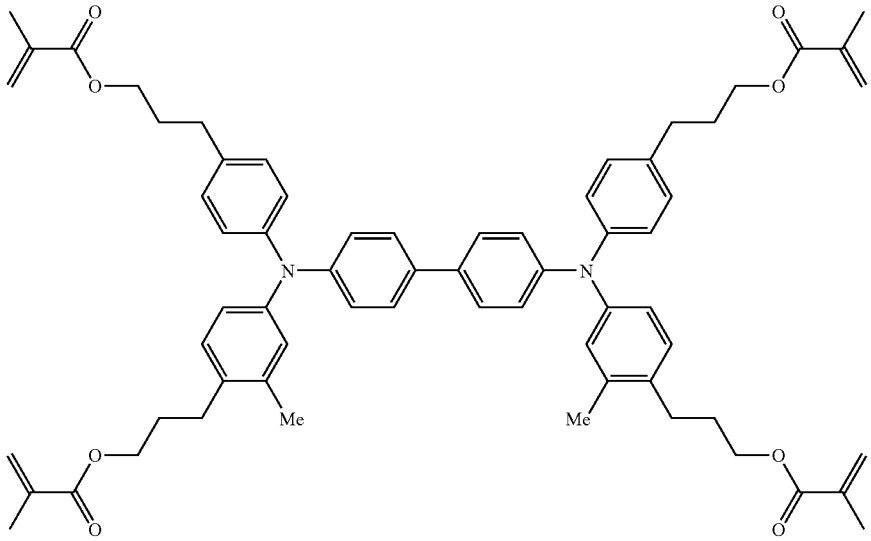
Compound A-17
Next, specific examples (compounds i-1 to i-13) of a compound that is obtained by selecting 1 as n in formula (I) are described, but they are not limitative.
| No. |
|---|
| i-1 |
| i-2 |
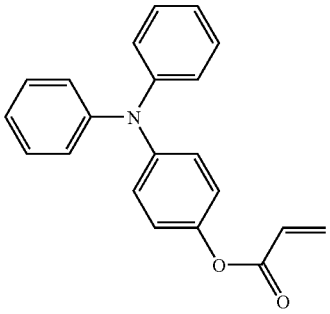
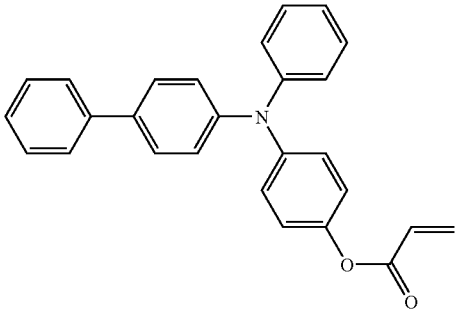
-continued
| No. |
|---|
| i-3 |
| i-4 |
| i-5 |
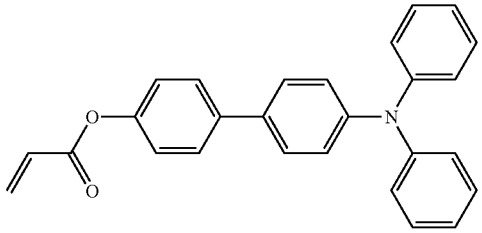
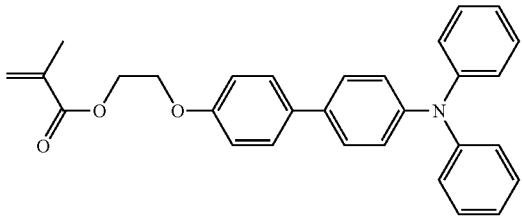
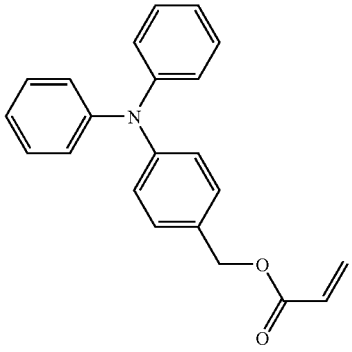

-continued
No.
i-6
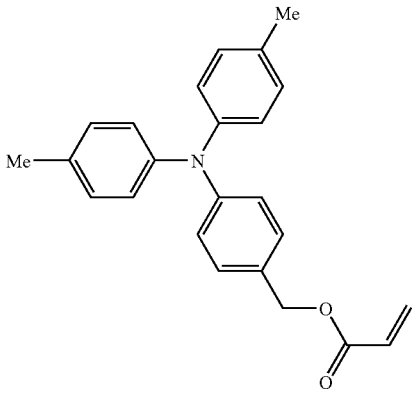
i-7
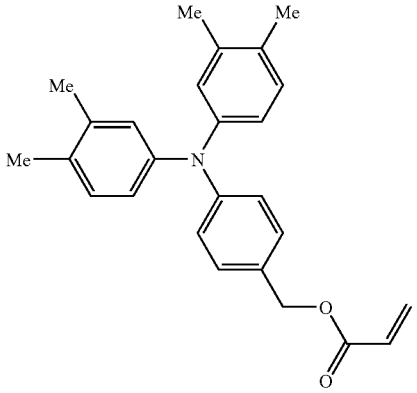
i-8
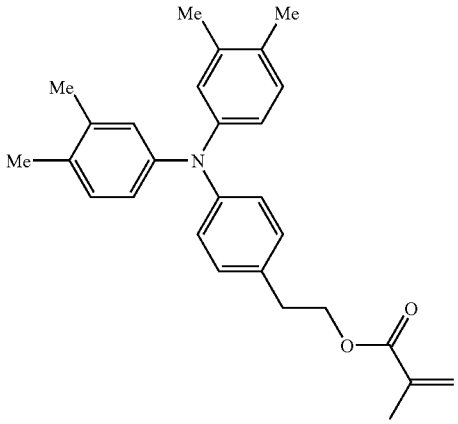
i-9
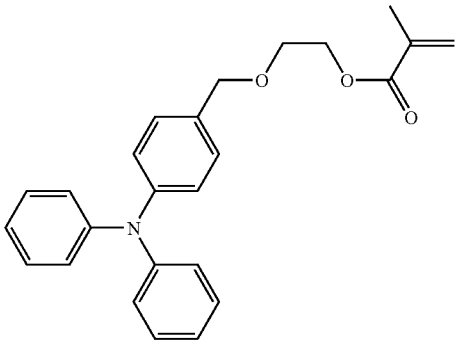
-continued
No.
i-10
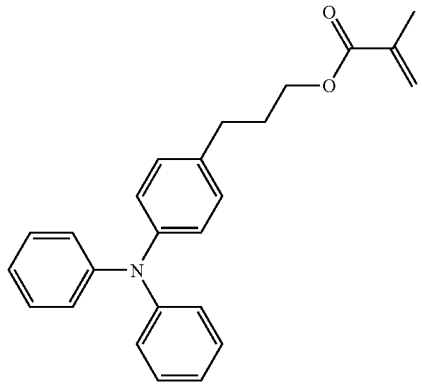
i-11
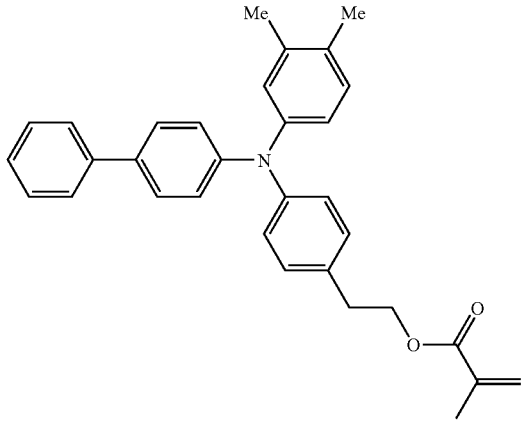
i-12
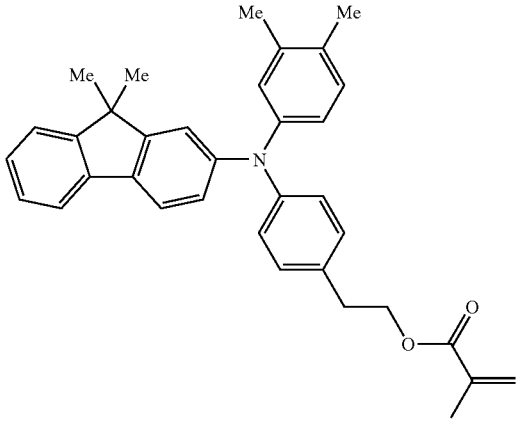
i-13
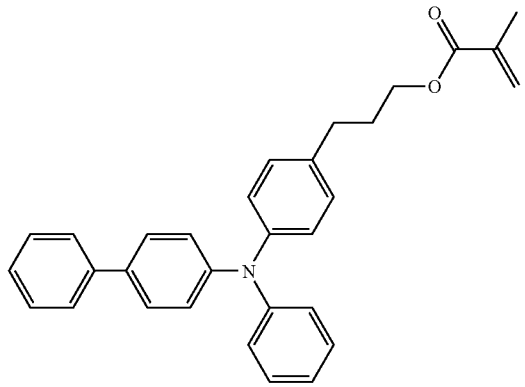

Specific examples (compounds ii-1 to ii-23) of a compound that is obtained by selecting 2 as n in formula (I) are described below, but they are not limitative.
| No. | |
|---|---|
| ii-1 | 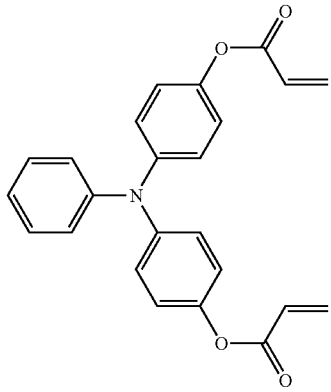 |
| ii-2 | 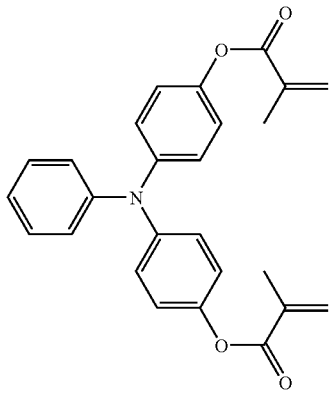 |
| ii-3 | 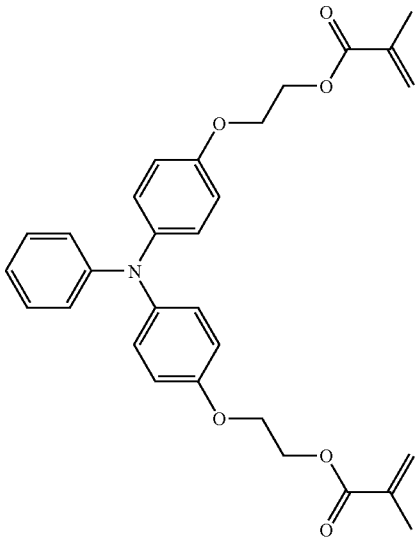 |

-continued
| No. | |
|---|---|
| ii-4 | 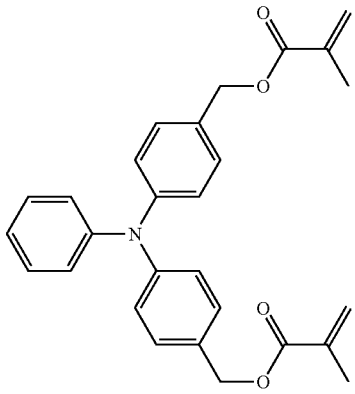 |
| ii-5 | 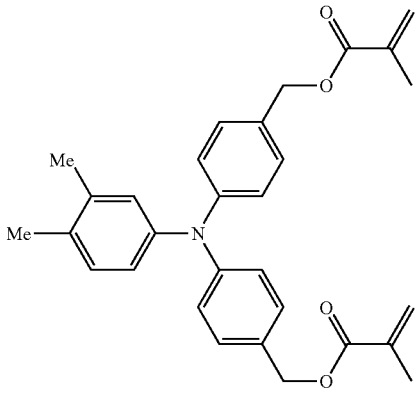 |
| ii-6 | 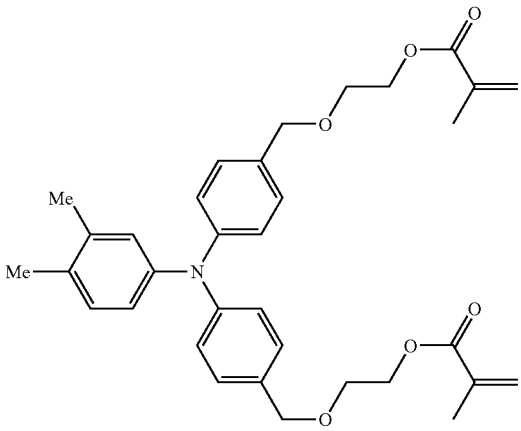 |

-continued
| No. | |
|---|---|
| ii-7 | 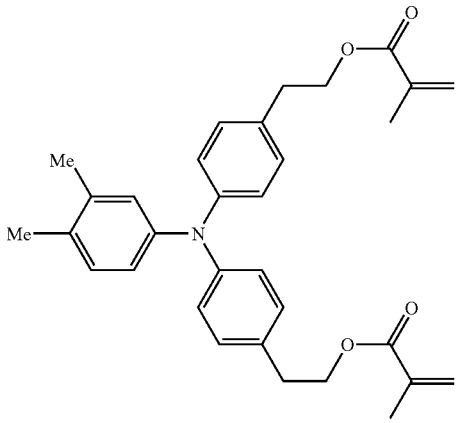 |
| ii-8 | 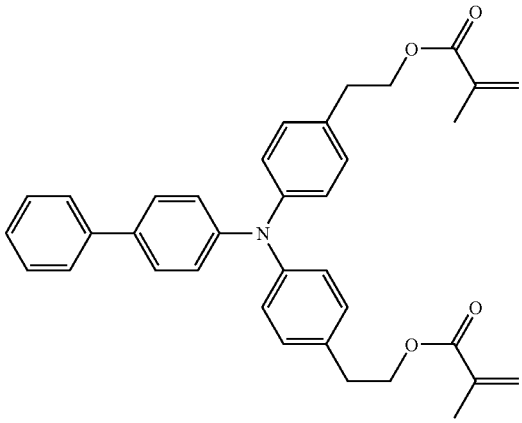 |
| ii-9 | 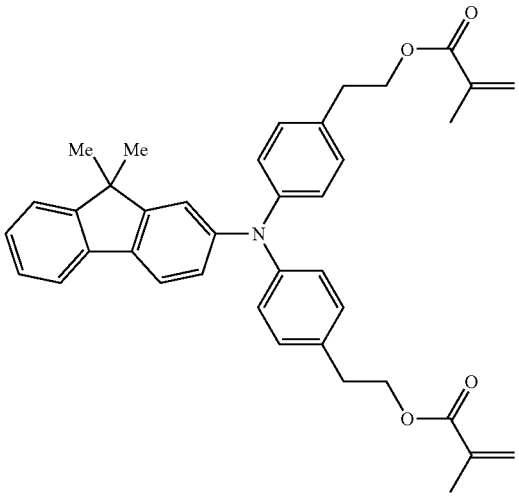 |

-continued
No.
ii-10
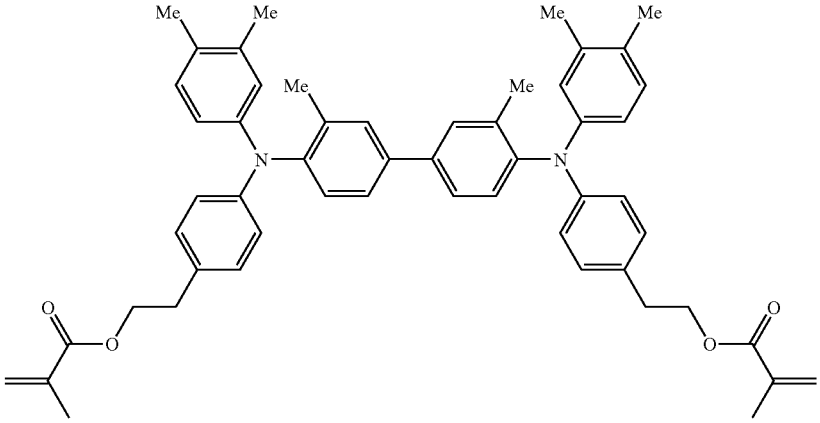
ii-11
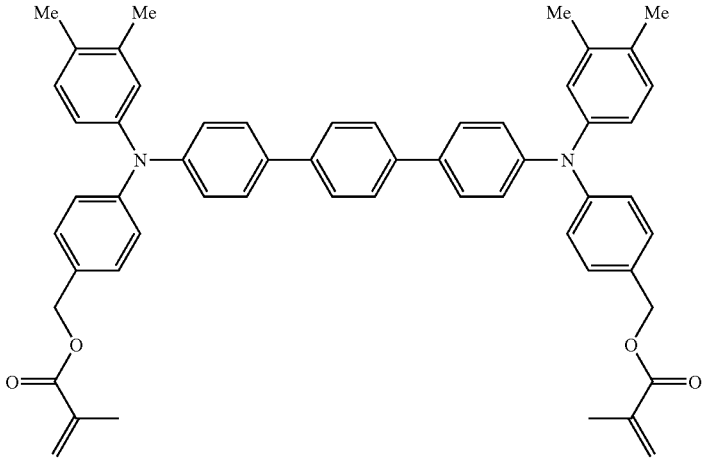
ii-12
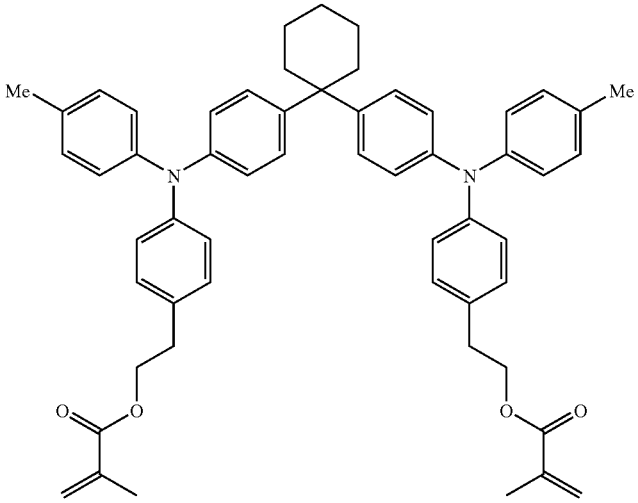

-continued
No.
ii-13
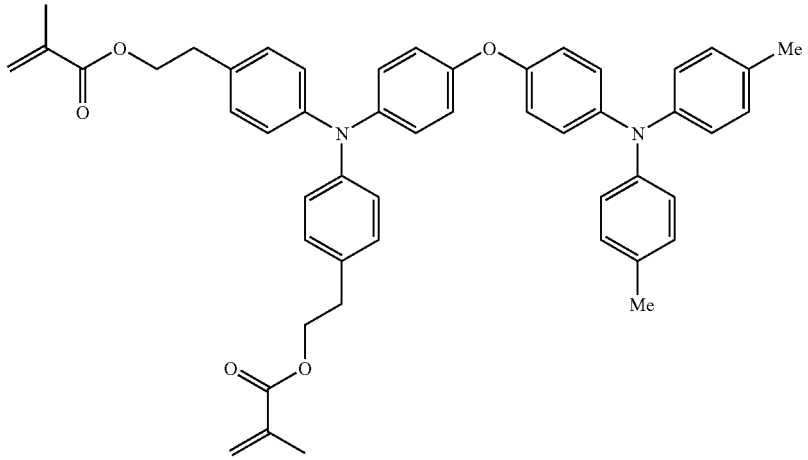
ii-14
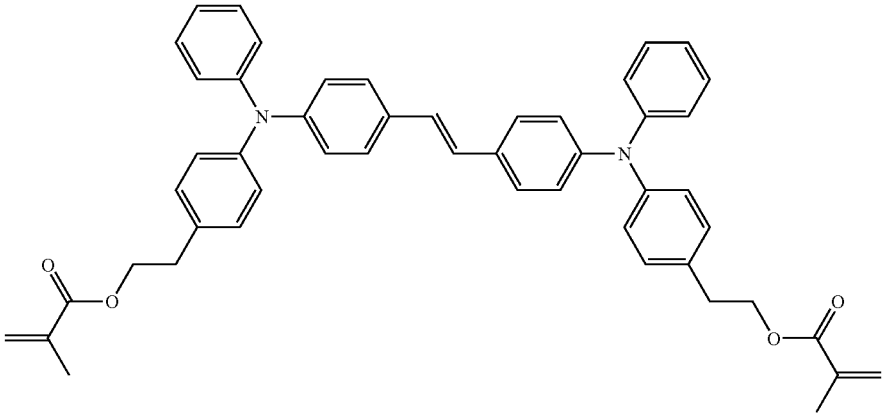
ii-15
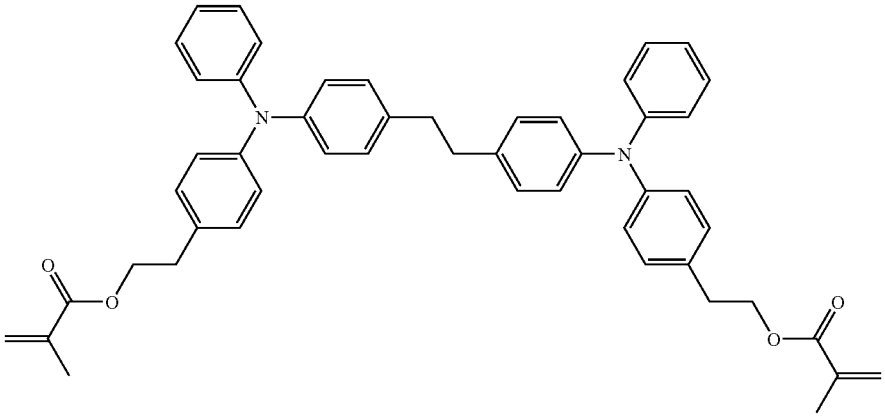

-continued
No.
ii-16
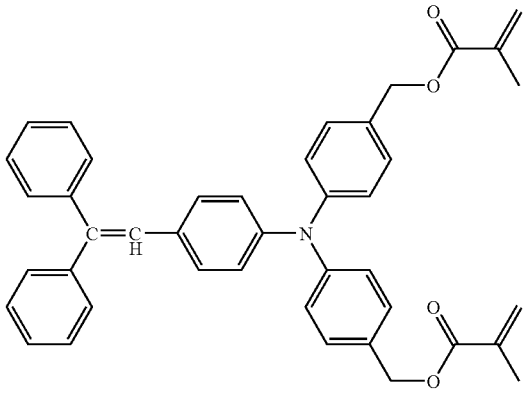
ii-17
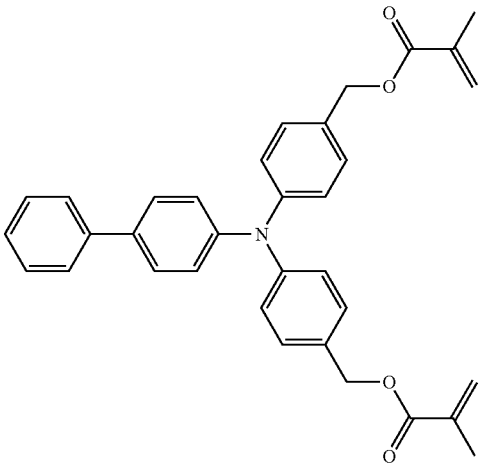
ii-18
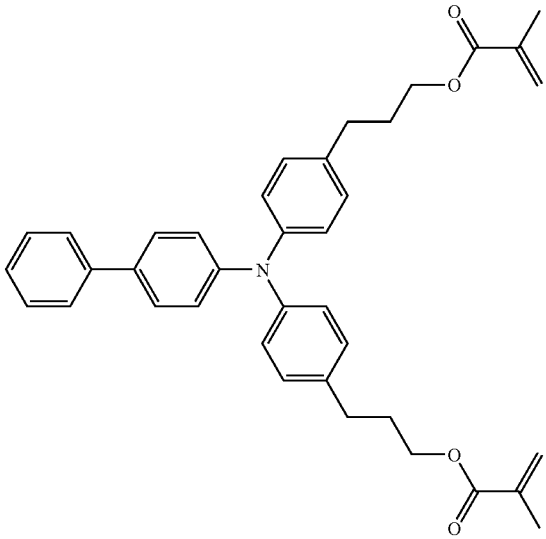

-continued
No.
ii-19
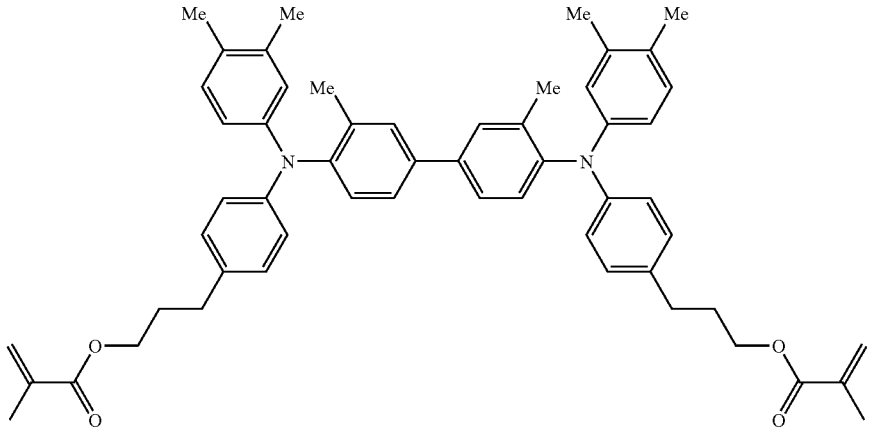
ii-20
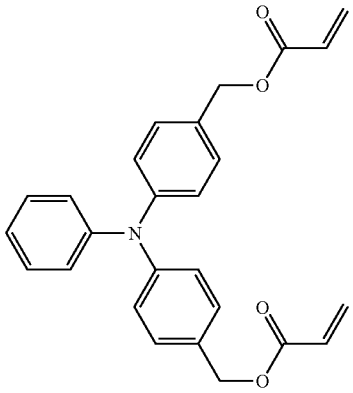
ii-21
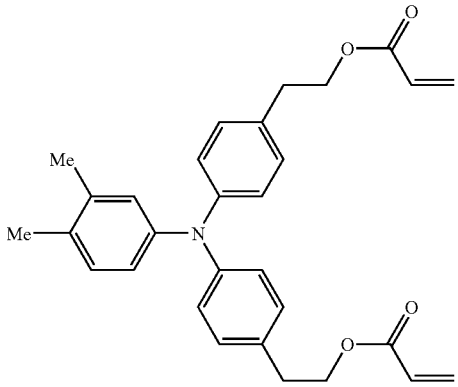

-continued
| No. | |
|---|---|
| ii-22 | 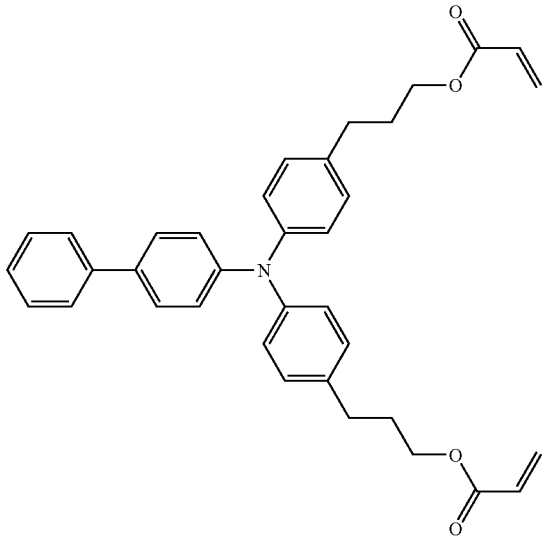 |
| ii-23 | 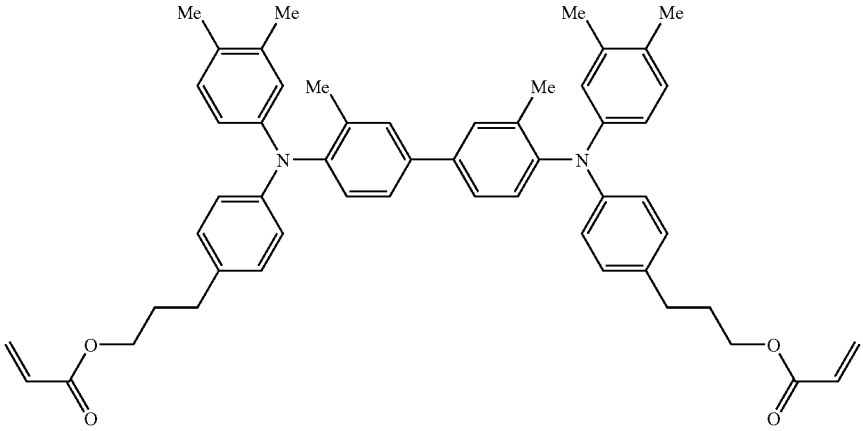 |
Next, specific examples (compounds iii-1 to iii-11) of a compound that is obtained by selecting 3 as n in formula (I) are described, but they are not limitative.
| No. | |
|---|---|
| iii-1 | 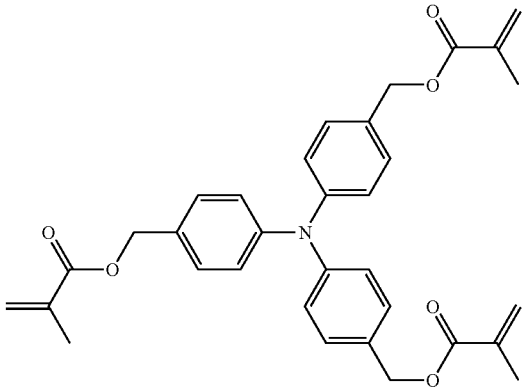 |

-continued
| No. |
| --- |
| iii-2 |
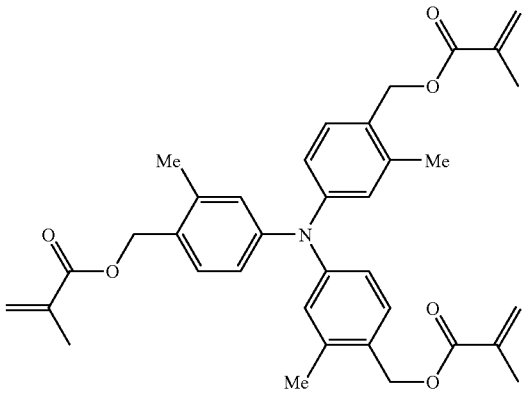
iii-3
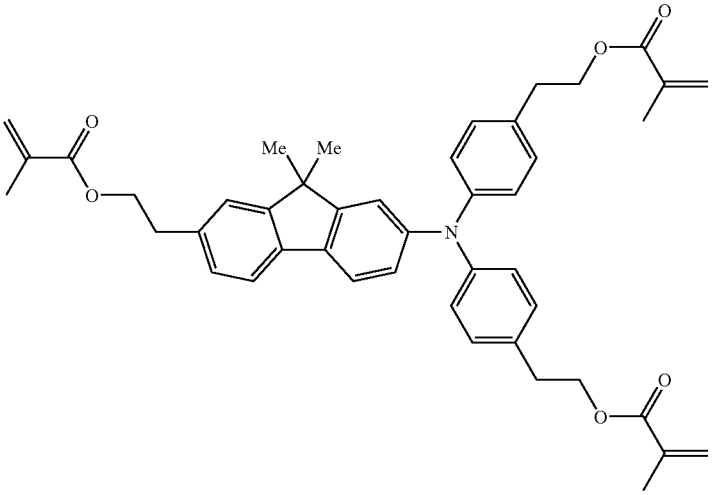
iii-4
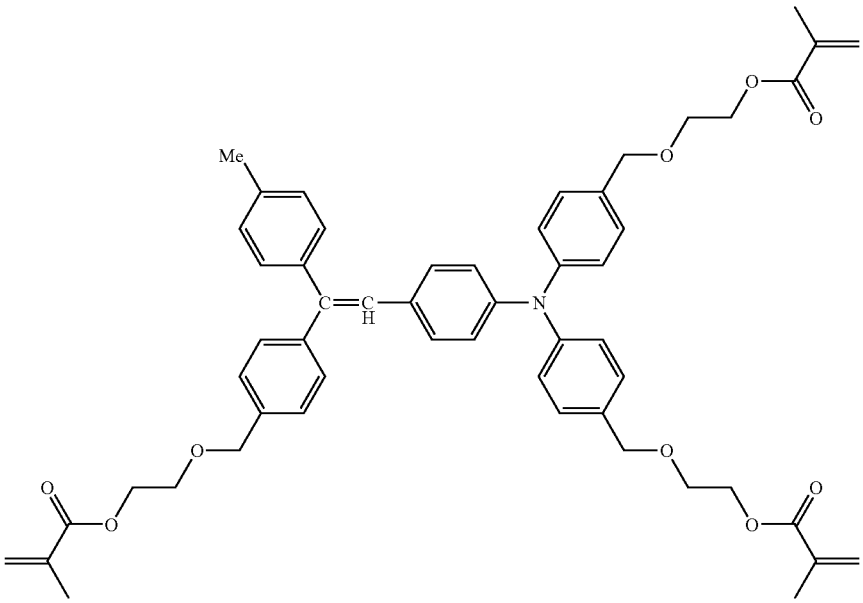

-continued
| No. |
| --- |
| iii-5 |
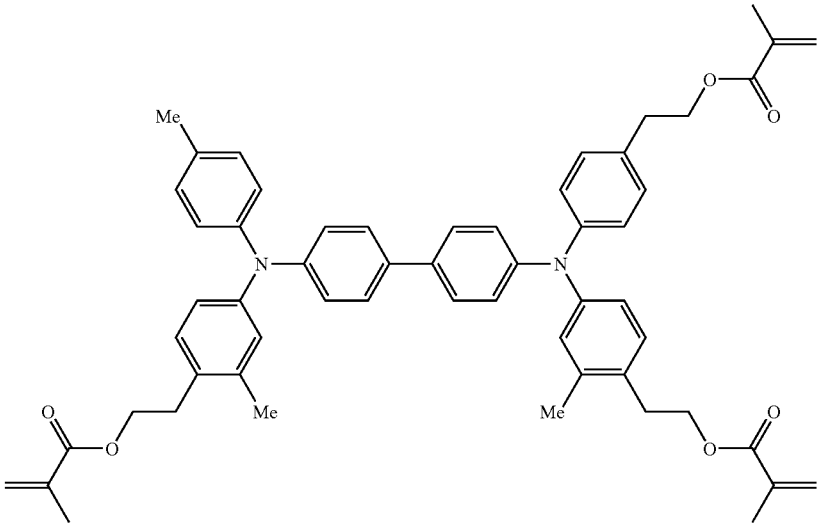
iii-6
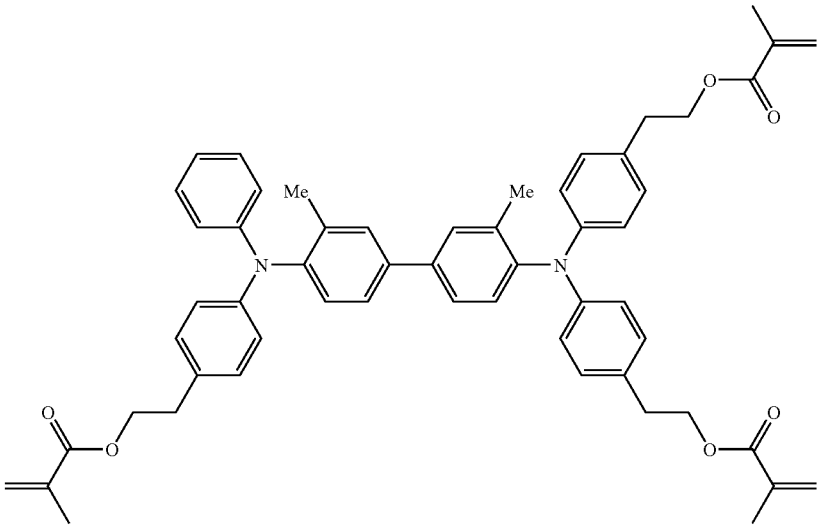
iii-7
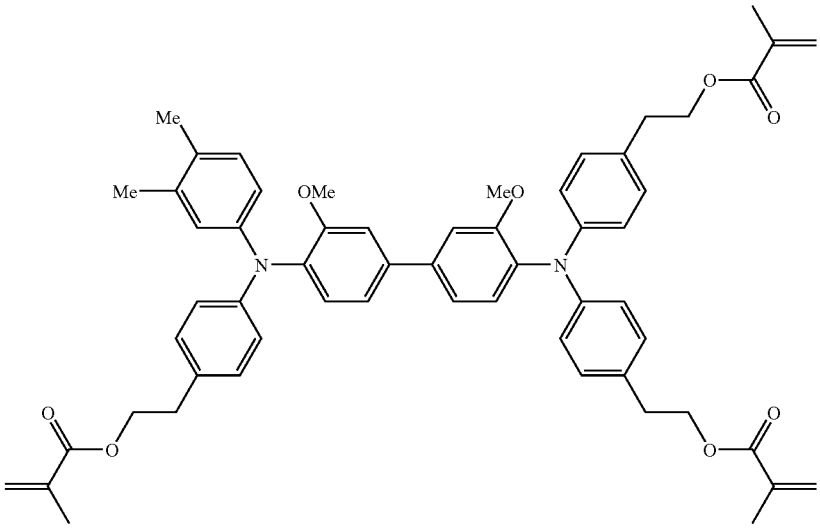

-continued
No.
iii-8
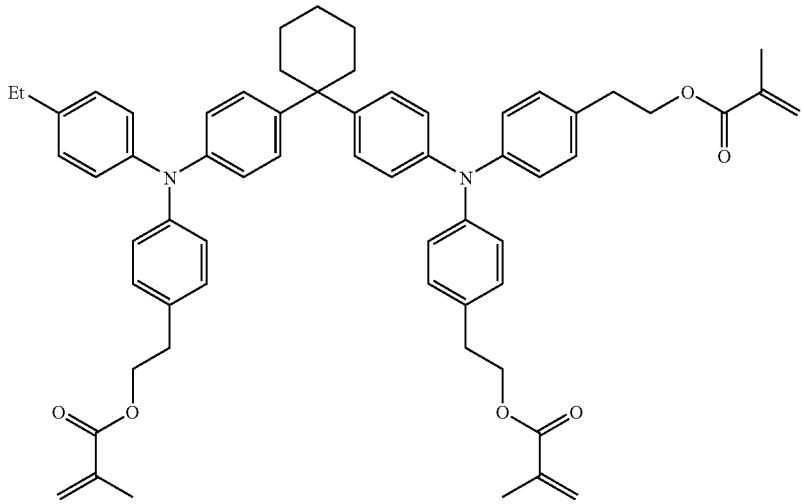
iii-9
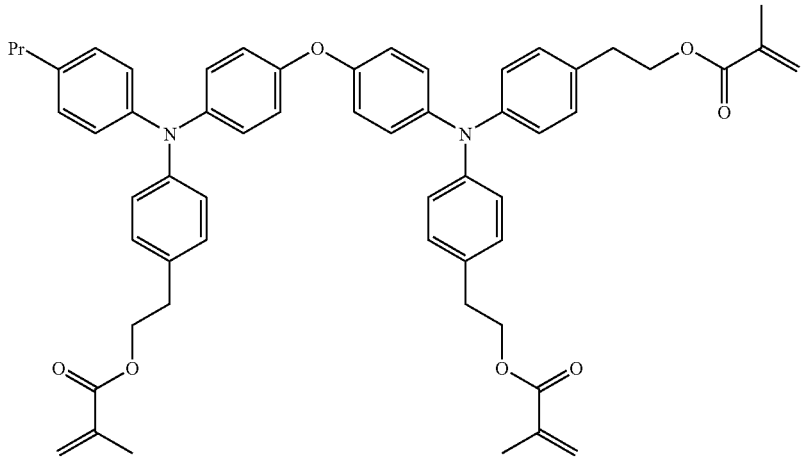
iii-10
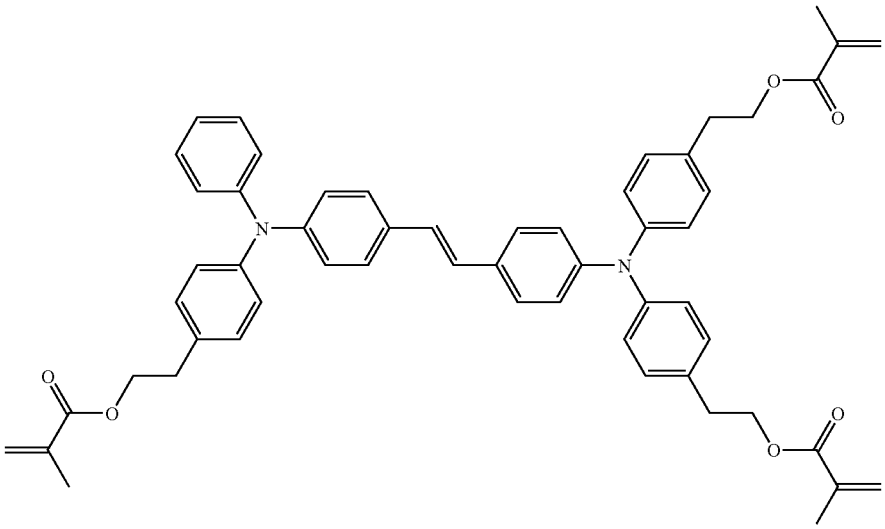

-continued

| No. | |
|---|---|
| iii-11 | 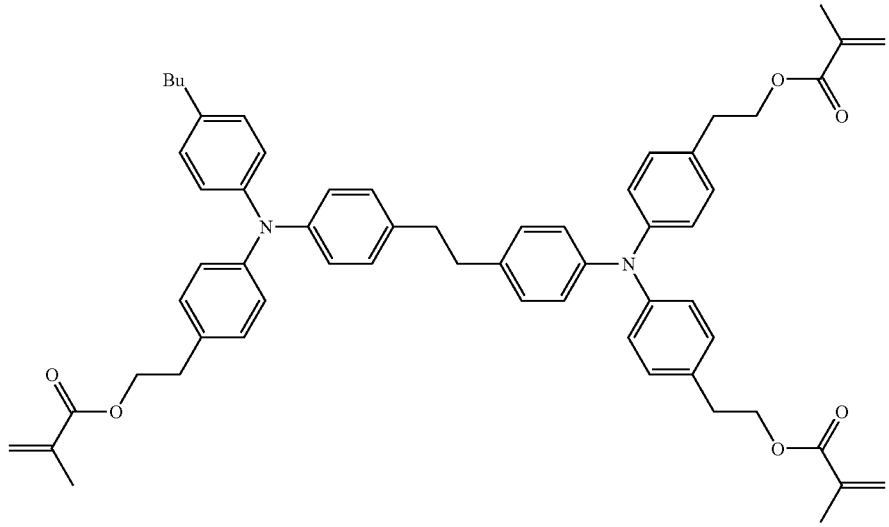 |

In the exemplary embodiments of the present invention, as the compound represented by formula (I), as described above, it is preferable to use a compound that is obtained by selecting 2 or more as n, and it is more preferable to use a compound that is obtained by selecting 4 or more as n.

Further, as the compound represented by formula (I), a compound that is obtained by selecting 4 or more as n and a compound that is obtained by selecting 1 to 3 as n may be used in combination. By use of this combination, the strength of a cured material is controllable without lowering the charge transporting performance thereof.

When the compound that is obtained by selecting 4 or more as n and the compound that is obtained by selecting 1 to 3 as n are used in combination as the compound represented by formula (I), the compound that is obtained by selecting 4 or more as n is preferably 5% by weight or more and more preferably 20% by weight or more with respect to the total content of the compound represented by formula (I).

The total content of the compound represented by formula (I) is preferably 40% by weight or more, more preferably 50% by weight or more, and still more preferably 60% by weight or more with respect to the composition that is used when the protective layer 5 is formed.

Within this range, excellent electrical characteristics may be obtained and a cured material may be formed into a thick film.

Furthermore, in the exemplary embodiments of the present invention, the compound represented by formula (I) and a known charge transporting material having no reactive groups may be used in combination. The known charge transporting material having no reactive groups increases substantially the constituent concentration of the charge transporting material and is effective on improving electrical characteristics because it has no reactive groups that do not serve for charge transport.

The known charge transporting material may include the one that is included in the charge transporting material composing the charge transporting layer 3.

Next, the specific surfactant that is used in the exemplary embodiments of the present invention is described.

The surfactant used in the exemplary embodiments of the present invention has, in the molecule, at least one of structure selected from (A) a structure obtained by polymerizing an acrylic monomer having a fluorine atom, (B) a structure having a carbon-carbon double bond and a fluorine atom, (C) an alkylene oxide structure, and (D) a structure having a carbon-carbon triple bond and a hydroxy group.

The surfactant may have at least one kind of structure selected from the structures (A) to (D) in the molecule and may have two or more.

Hereinafter, the structures (A) to (D) and the surfactant that has these structures are described.

(A) Structure Obtained by Polymerizing Acrylic Monomer Having Fluorine Atom

The structure (A) that is obtained by polymerizing an acrylic monomer having a fluorine atom is not particularly limited, but is preferably a structure that is obtained by polymerizing an acrylic monomer having a fluoroalkyl group, and is more preferably a structure that is obtained by polymerizing an acrylic monomer having a perfluoroalkyl group.

Specific examples of the surfactant having the structure (A) may include POLYFLOW-KL-600 (trade name, manufactured by KYOEISHA CHEMICAL Co., Ltd.), and EFTOP EF-351, EF-352, EF-801, EF-802 and EF-601 (trade names, manufactured by Mitsubishi Materials Electronic Chemicals Co., Ltd.).

(B) Structure Having Carbon-Carbon Double Bond and Fluorine Atom

The structure (B) having a carbon-carbon double bond and a fluorine atom is not particularly limited, but is preferably either one of groups that are represented by the following formulae (B1) or (B2).

(B1)

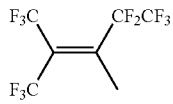

-continued (B2)

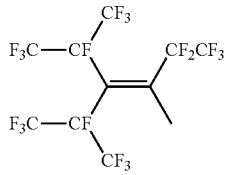

The surfactant having the structure (B) is preferably a compound that has a at least group represented by either one of formulae (B1) or (B2) on the side chain of an acrylic polymer or a compound represented by either one of the following formulae (B3) to (B5).

When the surfactant having the structure (B) is the compound that has at least a group represented by either one of formulae (B1) and (B2) on the side chain of an acrylic polymer, a uniform outermost surface layer may be formed because the acrylic structure has good affinity to the other constituents of the composition.

Further, when the surfactant having the structure (B) is the compound represented by any one of the formulae (B3) to (B5), film defects may be suppressed because repelling upon coating is likely to be prevented.

(B3)

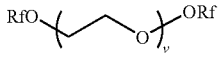

(B4)

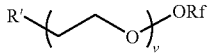

(B5)

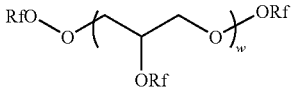

In formulae (B3) to (B5), v and w are each independently an integer of 1 or more; R' is a hydrogen atom or a monovalent organic group; Rfs are each is independently a group represented by formula (B1) or (B2).

In the formulae (B3) to (B5), the monovalent organic group represented by R' may include, for example, an alkyl group having from 1 to 30 carbon atoms and a hydroxyalkyl group having from 1 to 30 carbon atoms.

The commercially available products of the surfactant having the structure (B) may include the followings.

Examples of the compound represented by any one of formulae (B3) to (B5) may include FTERGENT 100, 100C, 110, 140A, 150, 150CH, A-K, 501, 250, 251, 222F, FTX-218, 300, 310, 400SW, 212M, 245M, 290M, FTX-207S, FTX-211S, FTX-220S, FTX-230S, FTX-209F, FTX-213F, FTX-222F, FTX-233F, FTX-245F, FTX-208G, FTX-218G, FTX-230G, FTX-240G, FTX-204D, FTX-280D, FTX-212D, FTX-216D, FTX-218D, FTX-220D, and FTX-222D (trade names, manufactured by NEOS COMPANY LIMITED.).

Further, example of the compound that has at least a group represented by either one of formula (B1) or (B2) on the side chain of an acrylic polymer may include KB-L82, KB-L85, KB-L97, KB-L109, KB-L110, KB-F2L, KB-F2M, KB-F2S, KB-F3M, and KB-FaM (trade names, manufactured by NEOS COMPANY LIMITED.).

(C) Alkylene Oxide Structure

The alkylene oxide structure (C) includes an alkylene oxide and a polyalkylene oxide. Specific examples of the alkylene oxide may include ethylene oxide and propylene oxide. Polyalkylene oxide that has from 2 to 10,000 repeating units of these alkylene oxides may be also included.

The surfactant having the alkylene oxide structure (C) may include polyethylene glycol, a polyether defoaming agent, and a polyether modified silicone oil.

Polyethylene glycol having a weight average molecular weight of 2,000 or less is preferable. Examples of the polyethylene glycol having a weight average molecular weight of 2,000 or less may include polyethylene glycol 2000 (weight average molecular weight of 2,000), polyethylene glycol 600 (weight average molecular weight of 600), polyethylene glycol 400 (weight average molecular weight), and polyethylene glycol 200 (200 of weight average molecular weight of 200).

In addition, preferable examples may include a polyether defoaming agent such as PE-M, PE-L (trade names, manufactured by Wako Pure Chemical Industries, Ltd.), Defoaming Agent No. 1, or Defoaming Agent No. 5 (trade names, manufactured by Kao Corp.).

As a surfactant having a fluorine atom in the molecule thereof in addition to the alkylene oxide structure (C) in the molecule, a surfactant having an alkylene oxide or a polyalkylene oxide on the side chain of a polymer having a fluorine atom and a surfactant that is characterized by substituting the end of an alkyleneoxide or a polyalkyleneoxide with a substitution group having a fluorine atom may be include.

Specific examples of the surfactant having a fluorine atom in the molecule thereof in addition to the alkyleneoxide structure (C) may include MEGAFAC F-443, F-444, F-445, and F-446 (trade names, manufactured by Dainippon Ink & Chemicals Inc.), FTERGENT 250, 251, and 222F (trade names, manufactured by NEOS COMPANY LIMITED.), and POLY FOX PF636, PF6320, PF6520, and PF656 (trade names, manufactured by Kitamura Chemicals Co., Ltd.).

Specific examples of a surfactant having a silicone structure in the molecule thereof in addition to the alkyleneoxide structure (C) in the molecule may include KF351 (A), KF352 (A), KF353(A), KF354(A), KF355(A), KF615(A), KF618, KF945(A) and KF6004 (trade names, manufactured by Shin-Etsu Chemical Co., Ltd.), TSF4440, TSF4445, TSF4450, TSF4446, TSF4452, TSF4453 and TSF4460 (trade names, manufactured by GE Toshiba Silicone Corp.), and BYK-300, 302, 306, 307, 310, 315, 320, 322, 323, 325, 330, 331, 333, 337, 341, 344, 345, 346, 347, 348, 370, 375, 377, 378, UV3500, UV3520 and UV3570 (trade names, manufactured by Bigchemi Japan Corp.).

(D) Structure Having Carbon-Carbon Triple Bond and Hydroxy Group

The structure (D) having a carbon-carbon triple bond and a hydroxy group is not particularly limited. The surfactant having this structure may include the following compounds.

The surfactant having the structure (D) having a carbon-carbon triple bond and a hydroxy group may include a compound having a triple bond and a hydroxy group in the molecule thereof. Specific examples thereof may include 2-propyne-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadyn-5-ol, 4,6-nonadecadiyn-1-ol, 10,12-pentacosadiyn-1-ol, 2-butyne-1,4-diol, 3-hexyne- 2,5-diol, 2,4-hexadiyne-1,6-diol, 2,5-dimethyl-3-hexyne-2,5-diol, 3,6-dimethyl-4-octyne-3,6-diol, 2,4,7,9-tetramethyl-5-decyne-4,7-diol, (+)-1,6-bis(2-chlorophenyl)-1,6-diphenyl-2,4-hexadiyne-1,6-diol, (−)-1,6-bis(2-chlorophenyl)-1,6-diphenyl-2,4-hexadiyne-1,6-diol, 2-butyne-1,4-diol bis(2-hydroxyethyl), 1,4-diacetoxy-2-butyne, 4-diethylamino-2-butyn-1-ol, 1,1-diphenyl-2-propyn-1-ol, 1-ethynyl-1-cyclohexanol, 9-ethynyl-9-fluorenol, 2,4-hexadiynediyl-1,6-bis(4-phenylazobenzene sulfonate), 2-hydroxy-3-butynoic acid, 2-hydroxy-3-butynoic acid ethyl ester, 2-methyl-4-phenyl-3-butyn-2-ol, methyl proparagyl ether, 5-phenyl-4-pentyn-1-ol, 1-phenyl-1-propyn-3-ol, 1-phenyl-2-propyn-1-ol, 4-trimethylsilyl-3-butyn-2-ol, and 3-trimethylsilyl-2-propyn-1-ol.

In addition, compounds (for example, SURFYNOL 400 series (trade name, manufactured by Shin-Etsu Chemical Co., Ltd.) that are obtained by adding an alkylene oxide such as ethyleneoxide to a part or all of hydroxy groups of the above compounds may be included.

The surfactant having the structure (D) having a carbon-carbon triple bond and a hydroxy group is preferably a compound represented by any one of the following formulae (D1) or (D2).

(D1)

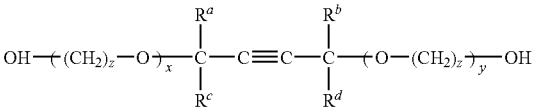

(D2)

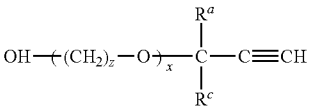

In formulae (D1) and (D2), $R^a$, $R^b$, $R^c$, and $R^d$ are each independently a monovalent organic group; and x, y, and z are each independently an integer of 1 or more.

Among the compounds represented by formula (D1) or (D2), a compound that is obtained by selecting an alkyl group as $R^a$, $R^b$, $R^c$, and $R^d$ is preferable. Further, a compound that is obtained by selecting a branched alkyl group as at least either of $R^a$ and $R^b$ and at least either of $R^c$ and $R^d$ is preferable. x and y are each preferably from 1 to 500.

A commercially available product of the compound represented by formula (D1) or (D2) may include SURFYNOL 400 series (trade name, manufactured by Shin-Etsu Chemical Co., Ltd.).

The surfactants having the structure (A) to (D) may be used alone or as a mixture of plural types. When a mixture of plural types is used, a surfactant having a structure different from the structures of the surfactants that have the structures (A) to (D) may be used in combination, as long as it does not damage the effects.

The surfactant usable in combination may include a surfactant having a fluorine atom or a surfactant having a silicone structure as described below.

Namely, a surfactant that is usable in combination with the surfactants having the structures (A) to (D) may include preferably perfluoroalkyl sulfonic acids (for example, perfluorobutane sulfonic acid, perfluorooctane sulfonic acid, or the like), perfluoroalkyl carboxylic acids (for example, perfluorobutane carboxylic acid, perfluorooctane carboxylic acid, or the like), and perfluoroalkyl group-containing phosphoric acid esters. The perfluoroalkyl sulfonic acids and perfluoroalkyl carboxylic acids may include salts thereof and amide modified bodies thereof.

Examples of a commercially available product of the perfluoroalkyl sulfonic acids may include MEGAFAC F-114 (trade name, manufactured by Dainippon Ink & Chemicals Inc.), EFTOP EF-101, EF-102, EF-103, EF-104, EF-105, EF-112, EF-121, EF-122A, EF-122B, EF-122C and EF-123A (trade names, manufactured by Mitsubishi Materials Electronic Chemicals Co., Ltd), and FTERGENT 100, 100C, 110, 140A, 150, 150CH, A-K, and 501 (trade names, manufactured by NEOS COMPANY LIMITED.).

Examples of a commercially available product of the perfluoroalkyl carboxylic acids may include MEGAFAC-410 (trade name, manufactured by Dainippon Ink & Chemicals Inc.) and EFTOP EF-201 and EF-204 (trade names, manufactured by Mitsubishi Materials Electronic Chemicals Co., Ltd).

Examples of a commercially available product of the perfluoroalkyl-group containing phosphoric acid esters may include MEGAFAC F-493 and F494 (trade names, manufactured by Dainippon Ink & Chemicals Inc.) and EFTOP EF-123A, EF-123B, EF-125M and EF-132 (trade names, manufactured by Mitsubishi Materials Electronic Chemicals Co., Ltd).

Note that, the surfactant that is usable in combination with the surfactants having the structures (A) to (D) is not limited to those described above, but a fluorine atom containing betain structure compound (for example, FTARGENT 400SW (trade name, manufactured by NEOS COMPANY LIMITED.)) and a surfactant having an amphoteric group (for example, FTARGENT SW (trade name, manufactured by NEOS COMPANY LIMITED.)) are also usable preferably.

The surfactant that has a silicone structure and is usable in combination with the surfactants having the structures (A) to (D) may include conventional silicone oils such as dimethyl silicone, methyl phenyl silicone, diphenyl silicone, or derivatives thereof.

The content of the surfactants is, with respect to the total solid content of the protective layer (outermost surface layer) 5, preferably from 0.01% or about 0.01% by weight to 1% or about 1% by weight and more preferably from 0.02% by weight to 0.5% by weight. When the content of the surfactant is less than about 0.01% by weight, the effect of preventing a coating film from having defects tends to be insufficient. When the content of the surfactant exceeds about 1% by weight, the strength of the resultant cured material tends to be lowered because of the separation of a specific surfactant from a curing component (such as the compound represented by formula (I) or the other monomers or oligomers).

Further, with respect to the total content of the surfactants, the content of a surfactant having the structures (A) to (D) is preferably 1% by weight or more and more preferably 10% by weight or more.

Hereinafter, the other components that compose the composition used for forming the protective layer 5 are described.

In addition to the compound represented by formula (I) and the specific surfactant, radical polymerizable monomers, oligomers, and the like that have no charge transportability may be added to the composition so as to control the viscosity of the composition, and the strength, flexibility, smoothness and cleaning property of resultant films.

Examples of a mono-functional radical polymerizable monomer may include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethyleneglycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxypolyethyleneglycol acrylate, methoxypolyethyleneglycol methacrylate, phenoxypolyethyleneglycol acrylate, phenoxypolyethyleneglycol methacrylate, hydroxyethyl-o-phenylphenol acrylate, and o-phenylphenolglycidylether acrylate.

Examples of a bi-functional radical polymerizable monomer may include 1,4-butanediol diacrylate, 1,6-hexanediol diacrylate, 1,9-nonanediol diacrylate, 2-n-butyl-2-ethyl-1,3-propanediol diacrylate, tripropyleneglycol diacrylate, tetraethyleneglycol diacrylate, dioxaneglycol diacrylate, polytetramethyleneglycol diacrylate, ethoxized bisphenol A diacrylate, ethoxized bisphenol A dimethacrylate, tricyclodecanemethanol diacrylate, and tricyclodecanemethanol dimethacrylate.

Examples of a tri- or higher functional radical polymerizable monomer may include trimethylolpropane triacrylate, trimethylolpropane trimethacrylate, pentaerythritol acrylate, EO adduct trimethylolpropane triacrylate, PO adduct glycerin triacrylate, trisacryloyloxyethyl phosphate, pentaerythritol tetraacrylate, and ethoxized isocyanuric triacrylate.

Further, examples of a radical polymerizable oligomer may include epoxy acrylate, urethane acrylate, and polyester acrylate oligomers.

The radical polymerizable monomers and oligomers that have no charge transportability are preferably contained in an amount of from 0% by weight to 50% by weight, preferably from 0% by weight to 40% by weight, and still more preferably from 0% by weight to 30% by weight, with respect to the total solid content of the composition.

In the exemplary embodiments of the present invention, the cured material (crosslinked film) that composes the outermost surface layer is obtained by curing the composition containing the compound represented by formula (I) and the specific surfactant with heat, light, electron beam, or the other various methods, but heat curing is preferable from the viewpoint of balancing the properties of the cured material including electrical characteristics and mechanical strength. Usually, when a conventional acrylic paint or the like is cured, electron beam that allows curing without a catalyst and photopolymerization that allows short time curing are preferably used. However, as the result of extensive studies by the present inventors, it is found that, because, in an electrophotographic photoreceptor, a photosensitive layer on which the outermost surface layer is formed contains a photoreceptor material, heat curing that allows mild reaction is preferable in order to bring about less damage to the photoreceptor material and to enhance the surface properties of the resultant cured material.

Heat curing may be performed without a catalyst, but as described below, a heat radical initiator is preferably used as a catalyst.

Namely, it is preferable that a heat radical initiator is added to the composition for forming the protective layer 5.

The heat radical initiator is not particularly limited, but preferably has a 10 hour half-life temperature of from 40° C. or about 40° C. to 110° C. or about 110° C. so as to prevent damages of the photoreceptor material contained in the photosensitive layer when the protective layer 5 is formed.

A commercially available heat radical initiator may include an azo-based initiator such as V-30 (10 hour half-life temperature (10HLT): 104° C.), V-40 (10HLT: 88° C.), V-59 (10HLT: 67° C.), V-601 (10HLT: 66° C.), V-65 (10HLT: 51° C.), V-70 (10HLT: 30° C.), VF-096 (10HLT: 96° C.), Vam-110 (10HLT: 111° C.) and Vam-111 (10HLT: 111° C.) (all of them are trade names and are manufactured by Wako Pure Chemical Industries Ltd.); $OT_{AZO}$-15 (10HLT: 61° C.), $OT_{AZO}$-30, AMBN (10HLT: 65° C.), AMBN (10HLT: 67° C.), ADVN (10HLT: 52° C.) and ACVA (10HLT: 68° C.) (all of them are trade names and are manufactured by Otsuka Chemical Co., Ltd);

PERTETRA A, PERHEXA HC, PERHEXA C, PERHEXA V, PERHEXA 22, PERHEXA MC, PERBUTYL H, PERCUMYL H, PERCUMYL P, PERMENTA H, HPEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT and PERBUTYL Z (all of them are trade names and are manufactured by NOF Corp.);

KAYAKETAL AM-C55, TRIGONOX 36-C75, LAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGONOX 117 and KAYARENE 6-70 (all of them are trade names and are manufactured by KAYAKU AKZO CO., LTD.); and LUPEROX LP (10HLT: 64° C.), LUPEROX 610 (10HLT: 37° C.), LUPEROX 188 (10HLT: 38° C.), LUPEROX 844 (10HLT: 44° C.), LUPEROX 259 (10HLT: 46° C.), LUPEROX 10 (10HLT: 48° C.), LUPEROX 701 (10HLT: 53° C.), LUPEROX 11 (10HLT: 58° C.), LUPEROX 26 (10HLT: 77° C.), LUPEROX 80 (10HLT: 82° C.), LUPEROX 7 (10HLT: 102° C.), LUPEROX 270 (10HLT: 102° C.), LUPEROX P (10HLT: 104° C.), LUPEROX 546 (10HLT: 46° C.), LUPEROX 554 (10HLT: 55° C.), LUPEROX 575 (10HLT: 75° C.), LUPEROX TANPO (10HLT: 96° C.), LUPEROX 555 (10HLT: 100° C.), LUPEROX 570 (10HLT: 96° C.), LUPEROX TAP (10HLT: 100° C.), LUPEROX TBIC (10HLT: 99° C.), LUPEROX TBEC (10HLT: 100° C.), LUPEROX JW (10HLT: 100° C.), LUPEROX TAIC (10HLT: 96° C.), LUPEROX TAEC (10HLT: 99° C.), LUPEROX DC (10HLT: 117° C.), LUPEROX 101 (10HLT: 120° C.), LUPEROX F (10HLT: 116° C.), LUPEROX DI (10HLT: 129° C.), LUPEROX 130 (10HLT: 131° C.), LUPEROX 220 (10HLT: 107° C.), LUPEROX 230 (10HLT: 109° C.), LUPEROX 233 (10HLT: 114° C.) and LUPEROX 531 (10HLT: 93° C.) (all of them are trade names and are manufactured by ARKEMA YOSHITOMI, LTD.).

The heat radical initiator is contained in an amount of preferably from 0.001% by weight to 10% by weight, more preferably from 0.01% by weight to 5% by weight, and still more preferably from 0.1% by weight to 3% by weight, with respect to the reactive compounds contained in the composition.

Further, to the composition for forming the protective layer 5, the other thermosetting resins such as phenol resin, melamine resin, or benzoguanamine resin may be added so as to prevent excess absorption of discharge product gases and to prevent effectively oxidation caused by the discharge product gases.

Also, to the composition for forming the protective layer 5, a coupling agent, a hardcoat agent, or a fluorine-containing compound may be further added for the purpose of controlling film-forming property, flexibility, lubricity, and adhesive property of the resultant film, and others. As these additives, specifically, various silane coupling agents and commercially available silicone-based hardcoat agents may be used.

The silane coupling agents may include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl) γ-aminopropyl triethoxysilane, tetramethoxysilane, methyltrimethoxysilane, and dimethyldimethoxysilane.

Commercially available hardcoat agent may include: KP-85, X-40-9740 and X-8239 (trade names, manufactured by Shin-Etsu Silicones); and AY42-440, AY42-441 and AY49-208 (trade names, manufactured by Dow Corning Toray Co., Ltd.).

Further, in order to provide water-repellency or the like, a fluorine-containing compound may be added, which may include (tridecafluoro-1,1,2,2-tetrahydrooctyl) triethoxysilane, (3,3,3-trifluoropropyl) trimethoxysilane, 3-(heptafluoroisopropoxy) propyltriethoxysilane, 1H, 1H, 2H, 2H-perfluoroalkyltriethoxysilane, 1H, 1H, 2H, 2H-perfluorodecyltriethoxysilane, and 1H, 1H, 2H, 2H-perfluorooctyltriethoxysilane.

The silane coupling agents are used in any amount, but the amount of the fluorine-containing compound is preferably 0.25 times or less time of the weight of the compounds free of fluorine. When the used amount exceeds this value, possibly there may bring about a problem on the film-forming property of a crosslinked film.

In addition, to the composition for forming the protective layer 5, a thermoplastic resin may be added for the purpose of providing the protective layer with resistance against discharge product gases, mechanical strength, scratch resistance, torque reduction, and control of abrasion amount, and also for the purpose of extending pot-life and controlling particle dispersibility and viscosity.

The thermoplastic resin may include polyvinyl butyral resin, polyvinyl formal resin, polyvinyl acetal resin (for example, S-LEC B, K, or the like (trade names, manufactured by SEKISUI CHEMICAL CO., LTD.) such as partially acetalized polyvinyl acetal resin, polyamide resin, cellulose resin, and polyvinyl phenol resin. In particular, considering electrical characteristics, polyvinyl acetal resin and polyvinyl phenol resin are preferable. The weight average molecular weight of the resin is preferably from 2,000 to 100,000 and more preferably from 5,000 to 50,000. When the molecular weight of the resin is less than 2,000, the effect of resin addition tends to be insufficient. When more than 100,000, the solubility lowers, whereby the addition amount is limited and also failures in film formation is likely to be brought about upon coating. The addition amount of the resin is preferably from 1% by weight to 40% by weight, more preferably from 1% by weight to 30% by weight, and still more preferably from 5% by weight to 20% by weight. When the addition amount of the resin is less than 1% by weight, the effect of resin addition tends to be insufficient. When more than 40% by weight, images become to be easily blurred under high temperature and high humidity conditions (for example, 28° C. and 85% RH).

To the composition for forming the protective layer 5, for the purpose of preventing degradation caused by oxidative gases such as ozone generated in a charging device, an antioxidant is preferably added. When the mechanical strength of the photoreceptor surface is increased and the durability of the photoreceptor is improved, still stronger oxidation resistance as compared before is requested because the photoreceptor is exposed to oxidative gases over a long time.

As the antioxidant, hindered phenol antioxidants or hindered amine antioxidants are preferable. Known antioxidants such as organic sulfur-based antioxidants, phosphite-based antioxidants, dithiocarbamate-based antioxidants, thiourea-based antioxidants, or benzimidazole-based antioxidants may be also used. The addition amount of the antioxidant is preferably 20% by weight or less and more preferably 10% by weight or less.

Examples of the hindered phenol-based antioxidant include 2,6-di-t-butyl-4-methylphenol, 2,5-di-t-butylhydroquinone, N,N'-hexamethylene bis(3,5-di-t-butyl-4-hydroxyhydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate, and 4,4'-butylidenebis(3-methyl-6-t-butylphenol).

In order to decrease the residual potential or improve the strength, the composition forming the protective layer 5 may include particles of various kinds. One example of the particles is silicon-containing particles. The silicon-containing particles include silicon as a constituent element, and specific examples thereof include colloidal silica and silicone particles. The colloidal silica used as silicon-containing particles is a dispersion in which silica particles having an average particle diameter of from 1 nm to 100 nm, preferably from 10 nm to 30 nm are dispersed in an acidic or alkaline aqueous solvent, or in an organic solvent such as alcohol, ketone or ester. The colloidal silica may be a commercially available product. The solid content of the colloidal silica in the protective layer 5 is not particularly limited, but preferably from 0.1% by weight to 50% by weight, and more preferably from 0.1% by weight to 30% by weight, with respect to the total solid content of the protective layer 5 from the viewpoints of film-forming ability, electrical characteristics, and strength.

The silicone particles that are used as silicon-containing particles are selected from silicone resin particles, silicone rubber particles, and silica particles surface-treated with silicone, and silicone particles generally available in the market are used. These silicone particles are spherical in shape, having an average particle diameter of preferably from 1 nm to 500 nm and more preferably from 10 nm to 100 nm. The silicone particles are chemically inactive and are minute diameter particles having excellent dispersibility in resins. In addition, the content of the silicone particles required to have sufficient characteristics is so low that the surface properties of electrophotographic photoreceptors are improved without blocking crosslinking reactions. That is, the silicone particles improve the surface lubricity and water-repellency of electrophotographic photoreceptors while they are incorporated without any irregularity in a strong cross-linked structure, so that adequate resistances against abrasion and deposition of staining impurities are kept over a long time.

The content of the silicone particles in the protective layer 5 is, on the basis of the total solid content of the protective layer 5, preferably from 0.1% by weight to 30% by weight and more preferably from 0.5% by weight to 10% by weight.

Other examples of the particles include fluorine particles such as ethylene tetrafluoride, ethylene trifluoride, propylene hexafluoride, vinyl fluoride and vinylidene fluoride, particles of resin obtained by copolymerizing a fluorine resin and a monomer having a hydroxy group, such as those described on page 89 of "the proceeding of 8th Polymer Material Forum Lecture", and particles of semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Oils such as silicone oil may be added for similar purposes. Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The composition used for forming the protective layer 5 may further include a metal, a metal oxide, carbon black or the like. Examples of the metal include aluminum, zinc, copper, chromium, nickel, silver and stainless steel, and plastic particles onto which a metal such as above is vapor-deposited. Examples of the metal oxide include zinc oxide, titanium oxide, tin oxide, antimony oxide, indium oxide, bismuth oxide, tin-doped indium oxide, antimony-doped or tantalum-doped tin oxide, and antimony-doped zirconium oxide. These metals, metal oxides and carbon black may be used alone or in a combination of two or more kinds. When two or more of them are used in combination, these may be simply mixed, or made into a solid solution or a fused product. The average particle diameter of the conductive particles is preferably 0.3 μm or less, particularly preferably 0.1 μm or less, from the viewpoint of transparency of the protective layer.

The composition for forming the protective layer 5 is preferably prepared in the form of a coating solution for forming the protective layer. The coating solution for forming the protective layer may be free of solvent, or if necessary, may contain a solvent such as alcohols including methanol, ethanol, propanol, butanol, cyclopentanol and cyclohexanol; ketones including acetone and methyl ethyl ketone; or ethers including tetrahydrofuran, diethyl ether, and dioxane.

The solvent may be used alone or as a mixture of two or more kinds, but the solvent has a boiling point of preferably 100° C. or lower. As the solvent, in particular, a solvent having at least one hydroxy group (for example, alcohols) is preferably used.

The coating solution composed of the composition for forming the protective layer 5 is coated on the charge transporting layer 3 with a conventional method such as blade coating, wire bar coating, spray coating, dip coating, bead coating, air knife coating, or curtain coating, then if necessary, the resultant coating is cured by, for example, heating at a temperature of from 100° C. to 170° C. In this way, a cured material is obtained. As a result, the protective layer (outermost surface layer) 5 that is composed of the cured material is obtained.

Note that, the oxygen concentration during curing of the coating solution for forming the protective layer is preferably 1% by weight or less, more preferably 1000 ppm or less, and still more preferably 500 ppm or less.

The coating solution for forming the protective layer may be used for, besides photoreceptors, for example, a fluorescent paint, an antistatic film for glass surface, plastic surface or the like, and others. By using this coating solution, a film having an excellent adhesion to an underlying layer is formed, thereby preventing performance degradation caused by repeated use over a long time.

An example of a function-separate type electrophotographic photoreceptor is described above, but the content of the charge generating material in a single-layer type photosensitive layer 6 (a charge generating and transporting layer) as shown in FIG. 2 is from 10% by weight to 85% by weight and preferably from 20% by weight to 50% by weight. The content of the charge transporting material is preferably from 5% by weight to 50% by weight. The method for forming the single-layer type photosensitive layer 6 (a charge generating and charge transporting layer) is similar to the method for forming the charge generating layer 2 or the charge transporting layer 3. The thickness of the single-layer type photosensitive layer (a charge generating and charge transporting layer) 6 is preferably from 5 μm to 50 μm and more preferably from 10 μm to 40 μm.

In the exemplary embodiments described above, an embodiment where the outermost surface layer that is composed of a cured material of the composition containing the compound represented by formula (I) and the specific surfactant serves as the protective layer 5 is described. In the case of a configuration of layers where the protective layer 5 is not included, a charge transporting layer that is positioned on the outermost surface in the configuration of layers serves as the outermost surface layer.

Image Forming Apparatus and Process Cartridge

Figure 4:
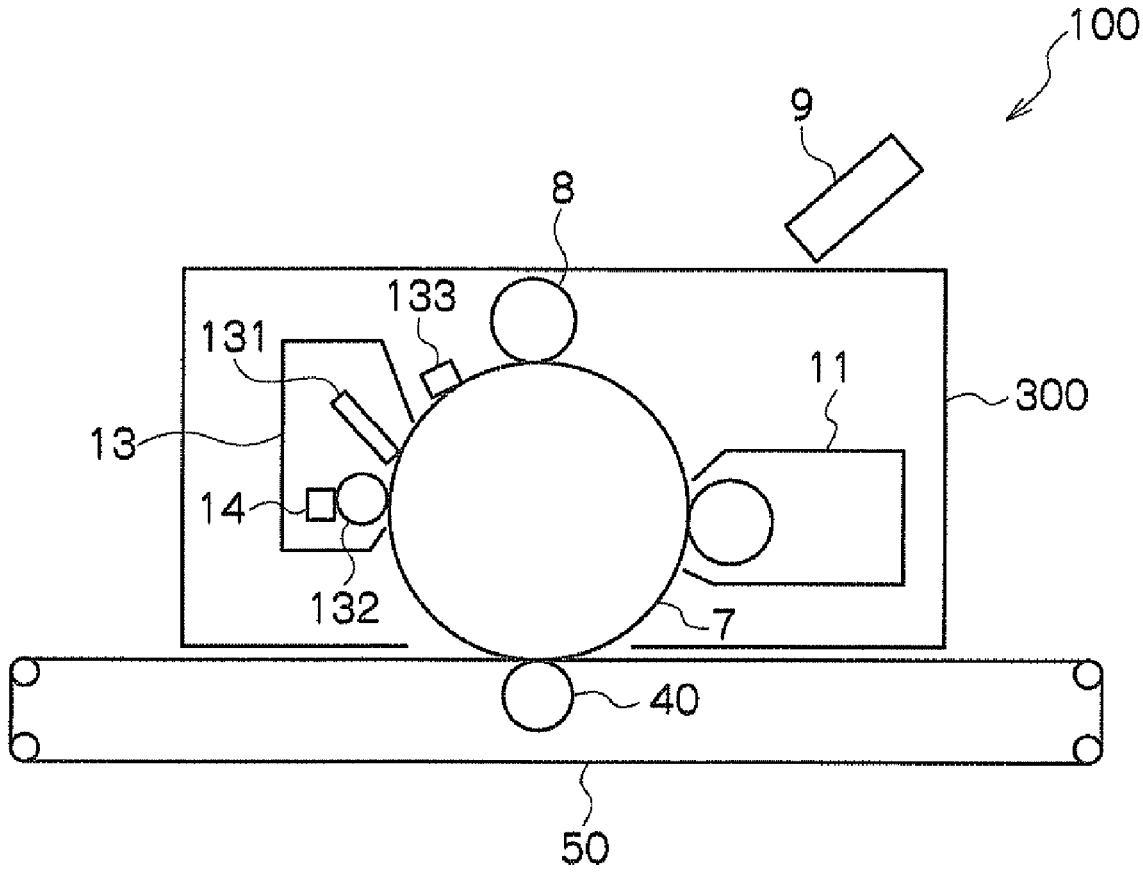
FIG. 4 is a schematic view showing an image forming apparatus according to an exemplary embodiment of the invention.

FIG. 4 is a schematic view showing an image forming apparatus according to an exemplary embodiment of the invention.

An image forming apparatus 100 shown in FIG. 4 is equipped with a process cartridge 300 that has an electrophotographic photoreceptor 7, an exposure device (electrostatic latent image forming device) 9, a transfer device (transfer unit) 40, and an intermediate receiving body 50. Note that, in the image forming apparatus 100, the exposure device 9 is placed at a position where the electrophotographic photoreceptor 7 is allowed to be exposed to light through an opening of the process cartridge 300, the transfer device 40 is placed at a position where it faces to the electrophotographic photoreceptor 7 via the intermediate receiving body 50, and the intermediate receiving body 50 is placed in a manner that a part of the intermediate receiving body 50 is brought into contact with the electrophotographic photoreceptor 7.

The process cartridge 300 in FIG. 4 supports and integrates, in the housing thereof, the electrophotographic photoreceptor 7, a charging device (charging unit) 8, a developing device (developing unit) 11, and a cleaning device 13. The cleaning device 13 has a cleaning blade (cleaning member).

The cleaning blade 131 is placed in a manner that it is brought into contact with the surface of the electrophotographic photoreceptor 7.

FIG. 4 shows an example of the cleaning device 13 in which a fibrous member 132 (in a roll shape) that supplies a lubrication material 14 to the surface of the photoreceptor 7 and another fibrous member 133 (in a flat brush shape) that assists cleaning are equipped, but these members are optionally used.

As the charging device 8, for example, a contact-type charging device employing a conductive or semiconductive charging roller, a charging brush, a charging film, a charging rubber blade, a charging tube, or the like may be used. Known non contact-type charging devices such as a non contact-type roller charging device, scorotron or corotron charging devices utilizing corona discharge, or the like, may also be used.

Although not shown in the drawings, a heating member may be provided around the electrophotographic photoreceptor 7 in order to increase the temperature of the electrophotographic photoreceptor 7 to reduce the relative temperature thereof, thereby improving stability of the image.

Examples of the exposure device 9 include optical instruments which expose the surface of the electrophotographic photoreceptor 7 to light of a semiconductor laser, an LED, a liquid-crystal shutter light or the like in a pattern of desired image. The wavelength of the light source to be used is in the range of the spectral sensitivity region of the electrophotographic photoreceptor. As for the semiconductor laser beam, near-infrared light having an oscillation wavelength in the vicinity of 780 nm is mainly used. However, the wavelength of the light source is not limited to the above range, and lasers having an oscillation wavelength on the order of 600 nm and blue lasers having an oscillation wavelength in the vicinity of 400 nm to 450 nm may also be used. Surface-emitting type laser beam sources which are capable of multi-beam output are also effective in forming a color image.

As the developing device 11, for example, a common developing device that performs development by bringing or not bringing a magnetic or non-magnetic one- or two-component developer into contact may be used. Such developing device is not particularly limited as long as it has above-described functions, and may be appropriately selected according to the preferred use. Examples thereof include known developing device that performs development by attaching one- or two-component developer to the electrophotographic photoreceptor 7 using a brush or a roller.

Hereinafter, a toner that is used for the developing device 11 is described.

The toner has an average shape factor ($ML^2/A\times\pi/4\times100$, where ML is the maximum length of a toner particle, and A is a projection area of the toner particle) of preferably from 100 to 150 and more preferably from 100 to 140. Further, the toner preferably has a volume average particle diameter of from 2 μm to 12 μm, more preferably from 3 μm to 12 μm, and still more preferably from 3 μm to 9 μm. By using the toner that satisfies the above average shape factor and volume average particle diameter, as compared with the other toners, higher developing and transferring performances and higher quality images are obtained.

The method of producing the toner is not particularly limited as long as the obtained toner particles satisfy the above-described average shape factor and volume-average particle diameter. Examples of the method include a kneading and grinding method in which a binder resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion obtained by emulsifying and polymerizing a polymerizable monomer of a binder resin is mixed with a dispersion containing a coloring agent, a releasing agent, and optionally a charge control agent and other agents, then the mixture is subjected to aggregation, heating and fusing to obtain toner particles; a suspension polymerization method in which a polymerizable monomer used to obtain a binder resin and a solution containing a coloring agent, a releasing agent and optionally a charge control agent and other agents are suspended in an aqueous medium and subjecting the suspension to polymerization; and a dissolution-suspension method in which a binder resin and a solution containing a coloring agent, a releasing agent and optionally a charge control agent and other agents are suspended in an aqueous medium to form particles.

The method of producing the toner is not particularly limited as long as the obtained toner particles satisfy the above-described average shape factor and volume-average particle diameter. Examples of the method include a kneading and grinding method in which a binder resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion obtained by emulsifying and polymerizing a polymerizable monomer of a binder resin is mixed with a dispersion containing a coloring agent, a releasing agent, and optionally a charge control agent and other agents, then the mixture is subjected to aggregation, heating and fusing to obtain toner particles; a suspension polymerization method in which a polymerizable monomer used to obtain a binder resin and a solution containing a coloring agent, a releasing agent and optionally a charge control agent and other agents are suspended in an aqueous medium and subjecting the suspension to polymerization; and a dissolution-suspension method in which a binder resin and a solution containing a coloring agent, a releasing agent and optionally a charge control agent and other agents are suspended in an aqueous medium to form particles.

Moreover, known methods such as a method of producing toner particles having a core-shell structure in which aggregated particles are further attached to a core formed from the toner particles obtained by the above-described method, then heated and fused. As the method of producing toner particles, methods of producing a toner in an aqueous medium such as a suspension-polymerization method, an emulsion polymerization aggregation method, and a dissolution suspension method are preferable, and an emulsion polymerization aggregation method is most preferable from the viewpoint of controlling the shape and particle diameter distribution of the toner particles.

Toner mother particles are formed from a binder resin, a coloring agent and a releasing agent, and optionally silica or a charge control agent.

Examples of the binder resins used in the toner mother particles include monopolymers and copolymers of styrenes such as styrene and chlorostyrene, monoolefins such as ethylene, propylene, butylene and isoprene, vinyl esters such as vinyl acetate, vinyl propionate, vinyl benzoate, vinyl butyrate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and polyester resins synthesized by copolymerizing a dicarboxylic acid and a diol.

Examples of the typical binder resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and polyester resins. Other examples include polyurethane, epoxy resins, silicone resins, polyamide, modified rosin and paraffin wax.

Examples of the typical coloring agents include magnetic powder such as magnetite and ferrite, carbon black, aniline blue, Calco Oil blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Examples of the typical releasing agents include low-molecular polyethylene, low-molecular polypropylene, Fischer-Tropsch wax, montan wax, carnauba wax, rice wax and candelilla wax.

As the charge control agent, known agents such as azo metal-complex compounds, metal-complex compounds of salicylic acid, and resin-type charge control agents having polar groups can be used. When toner particles are produced by a wet method, it is preferred to use materials that do not readily dissolve in water from the viewpoint of controlling ion strength and reducing the amount of contamination by waste water. The toner may be either a magnetic toner which contains a magnetic material or a non-magnetic toner which contains no magnetic material.

The toner used for the developing device 11 is produced by mixing the mother toner particles and the external additives with a Henschel mixer or a V-blender mixer. When the toner mother particles are produced in a wet process, the external additives may be also mixed in a wet process.

Lubricant particles may be added to the toner used in the developing device 11. Examples of the lubricant particles include solid lubricants such as graphite, molybdenum disulfide, talc, fatty acids and metal salts of fatty acids, low molecular weight polyolefins such as polypropylene, polyethylene and polybutene, silicones having a softening point by heating, fatty-acid amides such as oleic acid amide, erucic acid amide, ricinoleic acid amide and stearic acid amide, vegetable waxes such as carnauba wax, rice wax, candelilla wax, Japan wax and jojoba oil, animal waxes such as beeswax, mineral and petroleum waxes such as montan wax, ozokerite, ceresine, paraffin wax, microcrystalline wax and Fischer-Tropsch wax, and modified products thereof. These may be used alone or in combination of two or more kinds thereof. The volume average particle diameter of the lubricant particles is preferably in a range of 0.1 μm to 10 μm, and those having the above-described chemical structure may be ground into particles having the same particle diameter. The content of the particles in the toner is preferably in a range of 0.05% by weight to 2.0% by weight, more preferably 0.1% by weight to 1.5% by weight.

Inorganic particles, organic particles, composite particles in which inorganic particles are attached to organic particles, or the like may be added to the toner particles used in the developing device 11 for the purpose of removing a deposition or a deterioration-inducing substance from the surface of the electrophotographic photoreceptor.

Examples of the appropriate inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The above-described inorganic particles may be treated with a titanium coupling agent or a silane coupling agent.

Examples of the titanium coupling agents include tetrabutyl titanate, tetraoctyl titanate, isopropyltriisostearoyl titanate, isopropyltridecylbenzenesulfonyl titanate and bis(dioctylpyrophosphate)oxyacetate titanate. Examples of the silane coupling agents include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane.

The above-described inorganic particles may be subjected to a hydrophobic treatment with silicone oil or a metal salt of higher fatty acids such as stearic acid aluminum, stearic acid zinc and stearic acid calcium.

Examples of the organic particles include styrene resin particles, styrene acrylic resin particles, polyester resin particles and urethane resin particles.

The diameter of the above-described particles based on the volume average particle diameter is preferably 5 nm to 1000 nm, more preferably 5 nm to 800 nm, further preferably 5 nm to 700 nm. When the volume average particle diameter is less than the lower limit, the particles may not have sufficient abrasive properties. On the other hand, when the volume average particle diameter exceeds the upper limit, the particles may form scratches on the surface of the electrophotographic photoreceptor. The total content of the above-described particles and the lubricant particles is preferably 0.6% by weight or more.

As the other inorganic oxides added to the toner, a small size inorganic oxide having a primary particle diameter of 40 nm or less is used considering fluidity of particles, charge control, and the like. In addition, an inorganic oxide having a larger particle diameter than the small size one is preferably added considering reduction in adhesion or charge control. As the particles of these inorganic oxides, known ones may be used, but silica and titanium oxide are preferably used in combination for the purpose of fine charge control. Regarding the particles of the small size inorganic oxide, surface treatment may provide a higher dispersibility and a higher effect of increasing the fluidity of the particles. Carbonates such as calcium carbonate or magnesium carbonate or inorganic minerals such as hydrotalcite may be also preferably added so as to remove the discharge products.

An electrophotographic color toner is used by mixing it with a carrier. As the carrier, iron powder, glass beads, ferrite powder, nickel powder, or a carrier that has a surface coating of resins on the surface of the foregoing powders or beads may be used. The mixing ratio with respect to the color toner and the carrier is selected arbitrarily.

Examples of the transfer device 40 include known transfer charging devices such as a contact type transfer charging devices using a belt, a roller, a film, a rubber blade, or a scorotron transfer charging device and a corotron transfer charging device utilizing corona discharge.

As the intermediate transfer body 50, a belt to which semiconductivity is imparted and made of polyimide, polyamide-imide, polycarbonate, polyarylate, polyester, rubber or the like (intermediate transfer belt) may be used. The intermediate transfer body 50 may also be in the form of a drum.

In addition to the above-described devices, the image forming apparatus 100 may further have, for example, a photodischarge device for photodischarging the electrophotographic photoreceptor 7.

Figure 5:
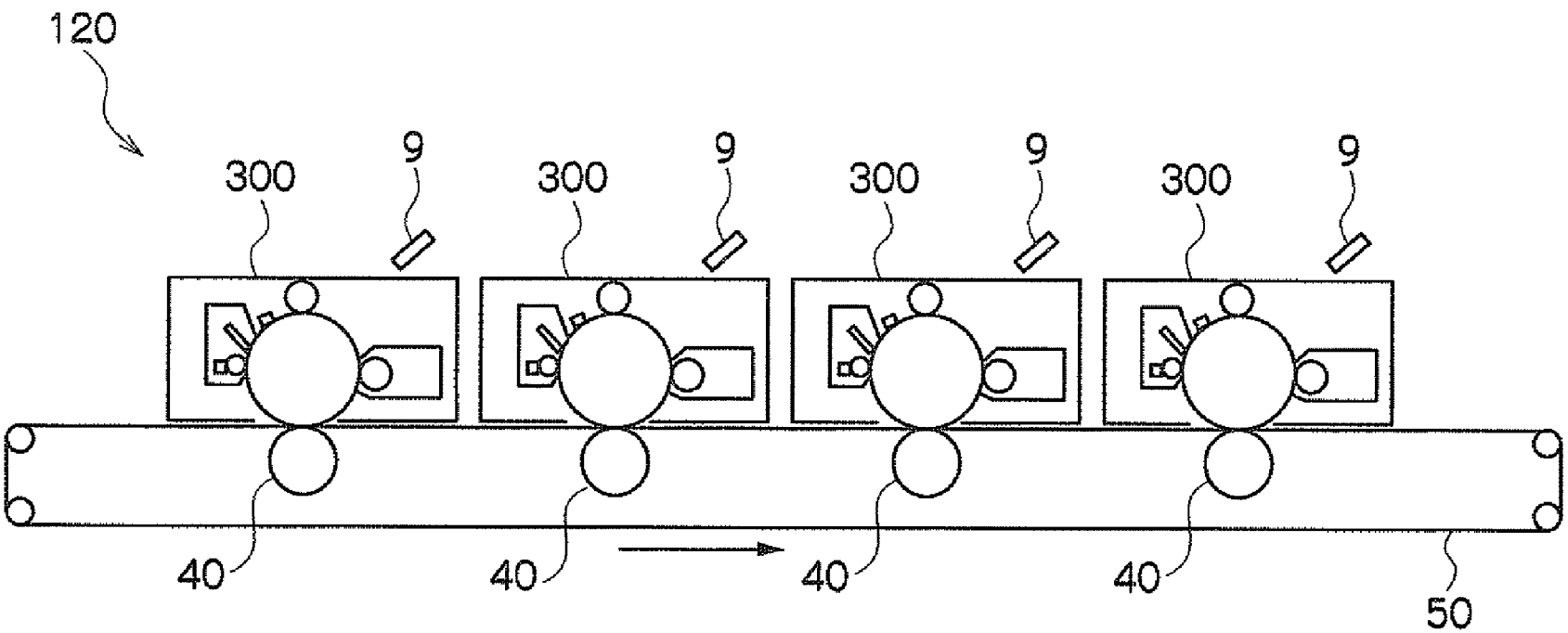
FIG. 5 is a schematic view showing an image forming apparatus according to another exemplary embodiment of the invention.

FIG. 5 is a schematic cross sectional view of an image forming apparatus 120 according to another exemplary embodiment of the invention. As shown in FIG. 5, the image forming apparatus 120 is a tandem-type full-color image forming apparatus including four process cartridges 300. In the image forming apparatus 120, four process cartridges 300 are disposed in parallel with each other on the intermediate transfer body 50, and one electrophotographic photoreceptor is used for each color. The image forming apparatus 120 has a similar constitution to the image forming apparatus 100, except that the apparatus is a tandem type.

When the electrophotographic photoreceptor of the invention is used in a tandem type image forming apparatus, electrical characteristics of the four electrophotographic photoreceptors can be stabilized, thereby enabling to obtain high image quality with excellent color balance over an even longer time.

In the image forming apparatus (process cartridge) according to the exemplary embodiments of the present invention, the developing device (developing unit) preferably has a developing roller that serves as a developer holding body moving in the reverse direction to the moving direction (rotating direction) of the electrophotographic photoreceptor. The developer roller has a cylindrical developer sleeve holding a developer on the surface thereof. The developing device may have a configuration that includes a limiting member regulating the amount of the developer supplied to the developer sleeve. By moving (rotating) the developing roller of the developing device in the reverse direction to the rotating direction of the electrophotographic photoreceptor, the surface of the electrophotographic photoreceptor is rubbed with the toner staying between the developing roller and the electrophotographic photoreceptor. Further, upon cleaning the toner remaining on the electrophotographic photoreceptor, for example, for the purpose of enhancing the cleaning performance against a toner having a quasi-spherical shape, the surface of the electrophotographic photoreceptor is strongly rubbed by increasing the pressing pressure of a blade or the like.

By these rubbing motions, conventional electrophotographic photoreceptors so far known receive strong damages, generating easily abrasion, scratches, or toner filming, thereby bringing about image degradation. However, the electrophotographic photoreceptors are reinforced with a crosslinked article of a specific charge transporting material according to the exemplary embodiments of the invention (in particular, a material providing a cured film having a high crosslink density, in which reactive functional groups are increased in number and are incorporated in high concentration), and a thick film is allowed to be formed on the surface of the electrophotographic photoreceptors because of the excellent electrical characteristics thereof, whereby a high image quality is allowed to be kept over a long time. The deposition of discharge products is considered to be markedly suppressed over a long time.

In the image forming apparatus according to the exemplary embodiments of the present invention, from the viewpoint of preventing the deposition of discharge products over a still longer period of time, the spacing between the developer sleeve and the photoreceptor is selected to be preferably from 200 μm to 600 μm and more preferably from 300 μm to 500 μm. From the similar viewpoint, the spacing between the developer sleeve and a limiting blade that is the above described limiting member regulating the amount of the developer is selected to be preferably from 300 μm to 1,000 μm and more preferably from 400 μm to 750 μm.

Furthermore, from the viewpoint of preventing the deposition of discharge products over a still longer period of time, the absolute value of the moving speed of the developing roller surface is selected to be preferably from 1.5 times to 2.5 times of the absolute value of the moving speed (process speed) of the photoreceptor surface and more preferably from 1.7 times to 2.0 times.

In the image forming apparatus (process cartridge) according to an exemplary embodiment of the invention, the developing device (developing unit) includes a developer retainer having a magnetic substance, and develops an electrostatic latent image with a developer, preferably a two-component developer containing a magnetic carrier and a toner. In this case, color images with a higher quality can be formed and a longer operating life can be achieved, as compared with the case in which a one-component developer, in particular a non-magnetic one-component developer, is used.

EXAMPLES

Hereinafter, the present invention is described in more detail with reference to examples, but the present invention is in no way limited to those examples.

Example 1

Preparation of Undercoating Layer

Zinc oxide (average particle diameter of 70 nm, specific surface area of 15 $m^2/g$, manufactured by TAYCA Corp.) in an amount of 100 parts by weight and tetrahydrofuran in an amount of 500 parts by weight are mixed; 1.3 parts by weight of a silane coupling agent (KBM503, trade name, manufactured by Shin-Etsu Chemical Co., Ltd.) are added; and then the resultant mixture is agitated for 2 hours. After that, toluene is removed by vacuum distillation, and then by baking at 120° C. for 3 hours, zinc oxide surface-treated with the silane coupling agent is obtained.

The surface-treated zinc oxide in an amount of 110 parts by weight and tetrahydrofuran in an amount of 500 parts by weight are mixed; a solution dissolving 0.6 parts by weight of alizarin in 50 parts by weight of tetrahydrofuran is added; and then the resultant mixture is agitated at 50° C. for 5 hours. After that, zinc oxide having alizarin applied thereto is filtered off by vacuum filtration, further dried under reduced pressure at 60° C. to obtain zinc oxide having alizarin applied thereto.

A solution in an amount of 39 parts by weight, that is prepared by mixing 60 parts by weight of the zinc oxide having alizarin applied thereto, 13.5 parts by weight of a curing agent (blocked isocyanate, SUMIDULE 3175, trade name, manufactured by Sumitomo Bayer Urethane Co., Ltd.), 15 parts by weight of a butyral resin (S-LEC BM-1, trade name, manufactured by Sekisui Chemical Co., Ltd.), and 85 parts by weight of methyl ethyl ketone, and methyl ethyl ketone in an amount of 25 parts by weight are mixed;

and then the resultant mixture is dispersed using a sand mill with glass beads having an average particle diameter of 1 mm for 2 hours to obtain a dispersion liquid.

To the resultant dispersion liquid, 0.005 parts by weight of dioctyl tin dilaurate serving as a catalyst and 40 parts by weight of silicone resin particles (TOSPEARL 145, trade name, manufactured by GE Toshiba Silicone Corp.) are added to obtain a coating solution for forming an undercoating layer. The coating solution is coated on an aluminum substrate 340 mm long and 1 mm thick by dip coating, and then dried and cured at 170° C. for 40 minutes to obtain a 19 μm thick undercoating layer.

Preparation of Charge Generating Layer:

A mixture of 15 parts by weight of hydroxygallium phthalocyanine that serves as a charge generating material and has diffraction peaks at positions with Bragg angles (2θ±0.2°) of at least 7.3°, 16.0°, 24.9°, and 28.0° in a Cukα characteristic X-ray diffraction spectrum, 10 parts by weight of a vinyl chloride-vinyl acetate copolymer resin (VMCH, trade name, Nippon Unicar Co., Ltd.) that serves as a binder resin, and 200 parts by weight of n-butyl acetate is dispersed using a sand mill with glass beads having an average particle diameter of 1 mm for 4 hours. n-Butyl acetate in an amount of 175 parts by weight and methyl ethyl ketone in an amount of 180 parts by weight are added to the resultant dispersion liquid, which is then agitated to obtain a coating solution for forming a charge generating layer. The coating solution for forming a charge generating layer is coated on the undercoating layer by dip coating, dried at ordinary temperature (25° C.) to form a 0.2 μm thick charge generating layer.

Preparation of Charge Transporting Layer:

N,N'-diphenyl-N,N'-bis(3-methylphenyl)-[1,1]biphenyl-4-4'-diamine in an amount of 45 parts by weight and a bisphenol Z polycarbonate resin (viscosity average molecular weight: 50,000) in an amount of 55 parts by weight are added and dissolved in 800 parts by weight of chlorobenzene so as to prepare a coating solution for forming a charge transporting layer. The coating solution is coated on the charge generating layer, dried at 130° C. for 45 minutes to obtain a 15 μm thick charge transporting layer.

Preparation of Protective Layer:

A compound (compound ii-18) represented by formula (I) in an amount of 132 parts by weight and an ethoxized bisphenol A diacrylate, as a monomer having no charge transportability, (ABE-300, trade name, manufactured by Shin-Nakamura Chemical Co., Ltd.) in an amount of 33 parts by weight are dissolved in 60 parts by weight of isopropanol (IPA) and 50 parts by weight of tetrahydrofuran (THF); further 3 parts by weight of a heat radical generating agent (AIBN, trade name, 10 hour half-life temperature: 65° C., manufactured by Otsuka Chemical Co., Ltd.) and 1 part by weight of a surfactant (KL-600, trade name, manufactured by KYOEISHA CHEMICAL Co., Ltd.) having (A) a structure obtained by polymerizing an acrylic monomer having a fluorine atom are dissolved so as to obtain a coating solution for forming a protective layer. The coating solution is coated on the charge transporting layer, heated in an atmosphere containing about 200 ppm of oxygen at 150° C. for 45 minutes to obtain a 5 μm thick protective layer.

In this way, an electrophotographic photoreceptor is obtained. The photoreceptor is referred to as a photoreceptor 1.

Evaluation

Image Quality Evaluation:

The electrophotographic photoreceptor prepared as described above is loaded on "700 Digital Color Press" (trade name) manufactured by Fuji Xerox Co., Ltd., and 10,000 sheets of a 5% half-tone image are printed under an environment of 10° C. and 15% RH. The image printed in the initial stage is subjected to an image evaluation test (1) under the same environment.

After 10,000 sheets are printed, an image evaluation test (2) is performed under the same environment. Further, after the image evaluation test (2), the image forming apparatus is left at 27° C. and 80% RH for 24 hours, an image evaluation test (3) is performed under the same environment. Note that, in the image evaluation test (2), images in the initial stage after 10,000 sheets are printed are evaluated, and in the image evaluation test (3), images in the initial stage after 24 hours leaving are evaluated.

Here, in the image evaluation test (1), in the image evaluation test (2), and in the image evaluation test (3), density unevenness, scores, image degradation, and ghosts are evaluated.

For an image forming test, P-paper (trade name, A4 size, cross-feed) manufactured by Fuji Xerox Office Supply Co., Ltd. is used.

Evaluation results are shown in Table 5.

Density Unevenness Evaluation:

Density unevenness is evaluated by visual observation using a 5% half-tone sample.

A: Good,

B: Unevenness is found parially, and

C: Unevenness causing problems on image quality is found.

Score Evaluation:

Scores are evaluated by visual observation using a 5% half-tone sample.

A: Good,

B: Scores are found partially, and

C: Scores causing problems on image quality are found.

Image Degradation Evaluation:

Further, along with the above evaluations, image degradation evaluation is performed as follows.

Image degradation is evaluated by visual observation using a 5% half-tone sample.

A: Good,

B: Problems are not found during continuous printing test, but are found after 24 hours leaving, and C: Problems are found even during continuous printing test.

Figure 6A:
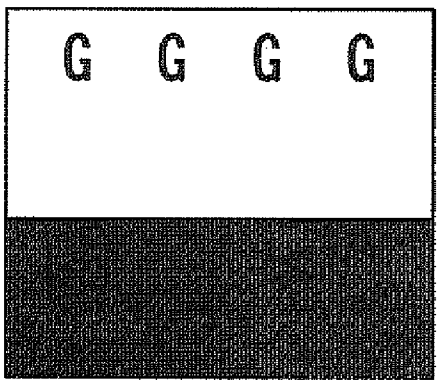
FIGS. 6A to 6C are explanatory drawings showing the criteria for evaluating ghosting.

Ghost Evaluation:

Ghost is evaluated by printing a chart having "G" letters and a black area shown in FIG. 6A and inspecting by visual observation the degree to which the "G" letters appear in the black area.

Figure 6B:
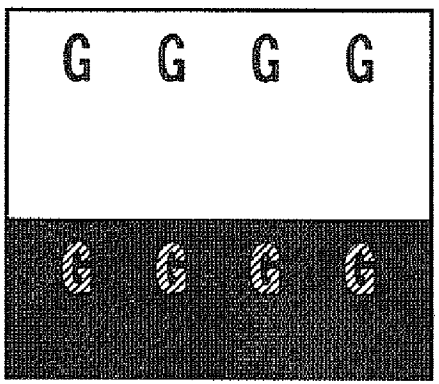

A: Good or minor as shown in FIG. 6A,

B: Somewhat noticeable as shown in FIG. 6B, and

Figure 6C:
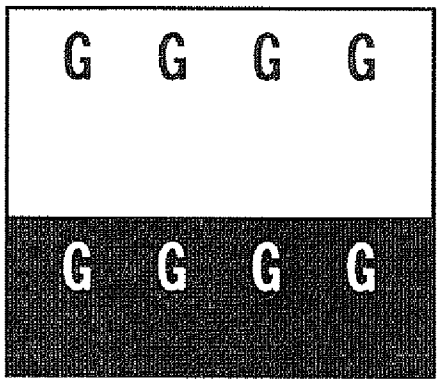

C: Clearly noticeable as shown in FIG. 6C.

Surface Observation:

After the electrophotographic photoreceptor is evaluated in the image quality test (2) and the image quality test (3), the surface thereof is observed and evaluated as follows, A: Good, no scars and depositions are found even at a magnification of 20 times, B: Scars and depositions are found only a little at a magnification of 20 times, and C: Scars and depositions are found even with the unaided eye.

Examples 2 to 27, Comparative Examples 1 and 2

Except that each material and the mixing amount thereof are changed in accordance with the following Tables 1 to 4, photoreceptors 2 to 27, C1, and C2 are prepared and evaluated in a similar manner to that in Example 1. Results are shown in Tables 5 to 8.

Note that, in Example 21, after a coating solution for forming a protective layer is coated on a charge transporting layer, using a metal halide lamp (manufactured by USHIO Inc.), the resultant coating is irradiated with UV light at an illuminance of 700 mW/cm$^2$ (at a reference wavelength of 365 nm) for 60 seconds. After that, the coating is heated at 150° C. for 45 minutes to form a 5 μm thick protective layer. In this way, an electrophotographic photoreceptor is obtained.

In Tables, each material and the mixing amount thereof used in Examples and Comparative Examples are also shown.

TABLE 1

| | Example 1 | Example 2 | Example 3 | Example 4 | Example 5 | Example 6 | Example 7 | Example 8 |
|---|---|---|---|---|---|---|---|---|
| Compound (1) represented by formula (I) | ii-18 | ii-18 | ii-18 | ii-18 | ii-18 | ii-19 | ii-19 | ii-23 |
| Addition amount (part(s) by weight) | 132 | 132 | 132 | 132 | 132 | 160 | 130 | 130 |
| Compound (2) represented by formula (I) | — | — | — | — | — | — | — | — |
| Addition amount (part(s) by weight) | — | — | — | — | — | — | — | — |
| Monomer having no charge transportability | ABE-300 | ABE-300 | ABE-300 | ABE-300 | THE-300 | — | ABE-300 | ABE-300 |
| Addition amount (part(s) by weight) | 33 | 33 | 33 | 33 | 33 | — | 30 | 30 |
| Solvent (1) | IPA | IPA | IPA | IPA | IPA | THF | THF | IPA |
| Addition amount (part(s) by weight) | 60 | 60 | 60 | 60 | 60 | 120 | 125 | 60 |
| Solvent (2) | THF | THF | THF | THF | THF | — | — | THF |
| Addition amount (part(s) by weight) | 50 | 50 | 50 | 50 | 50 | — | — | 50 |
| Heat radical generating agent | AIBN | AIBN | AIBN | AIBN | AIBN | AIBN | AIBN | AIBN |
| 10 hour half-life temperature | 65° C. | 65° C. | 65° C. | 65° C. | 65° C. | 65° C. | 65° C. | 65° C. |
| Addition amount (part(s) by weight) | 3 | 3 | 3 | 3 | 3 | 3 | 3 | 3 |
| Specific surfactant | POLYFLOW-KL-600 | FTERGENT 100 | KB-F2M | SURFYNOL 420 | POLYFLOW-KL-600 | POLYFLOW-KL-600 | POLYFLOW-KL-600 | POLYFLOW-KL-600 |
| Addition amount (part(s) by weight) | 1 | 1 | 1 | 1 | 1 | 1 | 1 | 1 |
| Photoreceptor No. | 1 | 2 | 3 | 4 | 5 | 6 | 7 | 8 |

TABLE 2

| | Example 9 | Example 10 | Example 11 | Example 12 |
|---|---|---|---|---|
| Compound (1) represented by formula (I) | ii-18 | ii-18 | iv-17 | iv-17 |
| Addition amount (part(s) by weight) | 65 | 65 | 160 | 160 |
| Compound (2) represented by formula (I) | ii-19 | iv-17 | — | — |
| Addition amount (part(s) by weight) | 65 | 65 | — | — |
| Monomer having no charge transportability | — | — | — | — |
| Addition amount (part(s) by weight) | — | — | — | — |
| Solvent (1) | THF | THF | THF | THF |
| Addition amount (part(s) by weight) | 120 | 130 | 130 | 130 |
| Solvent (2) | — | — | — | — |
| Addition amount (part(s) by weight) | — | — | — | — |
| Heat radical generating agent | AIBN | AIBN | LUPEROX 188 | LUPEROX 844 |
| 10 hour half-life temperature | 65° C. | 65° C. | 38° C. | 44° C. |
| Addition amount (part(s) by weight) | 3 | 3 | 3 | 3 |
| Specific surfactant | POLYFLOW-KL-600 | POLYFLOW-KL-600 | POLYFLOW-KL-600 | POLYFLOW-KL-600 |
| Addition amount (part(s) by weight) | 1 | 1 | 1 | 1 |
| Photoreceptor No. | 9 | 10 | 11 | 12 |

| | Example13 | Example14 | Example15 | Example16 |
|---|---|---|---|---|
| Compound (1) represented by formula (I) | iv-17 | iv-17 | iv-17 | iv-17 |
| Addition amount (part(s) by weight) | 160 | 160 | 160 | 160 |
| Compound (2) represented by formula (I) | — | — | — | — |
| Addition amount (part(s) by weight) | — | — | — | — |
| Monomer having no charge transportability | — | — | — | — |
| Addition amount (part(s) by weight) | — | — | — | — |
| Solvent (1) | THF | THF | THF | THF |
| Addition amount (part(s) by weight) | 130 | 130 | 130 | 130 |
| Solvent (2) | — | — | — | — |
| Addition amount (part(s) by weight) | — | — | — | — |

TABLE 2-continued

| | | | | |
|---|---|---|---|---|
| Heat radical generating agent | V-65 | $OT_{AZO}$-15 | AIBN | V-601 |
| 10 hour half-life temperature | 51° C. | 61° C. | 65° C. | 66° C. |
| Addition amount (part(s) by weight) | 3 | 3 | 3 | 3 |
| Specific surfactant | POLYFLOW-KL-600 | POLYFLOW-KL-600 | POLYFLOW-KL-600 | POLYFLOW-KL-600 |
| Addition amount (part(s) by weight) | 1 | 1 | 1 | 1 |
| Photoreceptor No. | 13 | 14 | 15 | 16 |

TABLE 3

| | Example 17 | Example 18 | Example 19 | Example 20 |
|---|---|---|---|---|
| Compound (1) represented by formula (I) | iv-17 | iv-17 | iv-17 | i-13 |
| Addition amount (part(s) by weight) | 160 | 160 | 160 | 60 |
| Compound (2) represented by formula (I) | — | — | — | — |
| Addition amount (part(s) by weight) | — | — | — | — |
| Monomer having no charge transportability | — | — | — | THE-330 |
| Addition amount (part(s) by weight) | — | — | — | 65 |
| Solvent (1) | THF | THF | THF | THF |
| Addition amount (part(s) by weight) | 130 | 130 | 130 | 130 |
| Solvent (2) | — | — | — | — |
| Addition amount (part(s) by weight) | — | — | — | — |
| Heat radical generating agent | LUPEROX 26 | LUPEROX 7 | Vam-110 | AIBN |
| 10 hour half-life temperature | 77° C. | 102° C. | 111° C. | 65° C. |
| Addition amount (part(s) by weight) | 3 | 3 | 3 | 3 |
| Specific surfactant | POLYFLOW-KL-600 | POLYFLOW-KL-600 | POLYFLOW-KL-600 | POLYFLOW-KL-600 |
| Addition amount (part(s) by weight) | 1 | 1 | 1 | 1 |
| Photoreceptor No. | 17 | 18 | 19 | 20 |
| | Example21 | Example22 | Example23 | Example24 |
| Compound (1) represented by formula (I) | iv-17 | iv-17 | ii-18 | ii-18 |
| Addition amount (part(s) by weight) | 160 | 160 | 105 | 115 |
| Compound (2) represented by formula (I) | — | — | iv-17 | iv-17 |
| Addition amount (part(s) by weight) | — | — | 25 | 15 |
| Monomer having no charge transportability | — | — | — | — |
| Addition amount (part(s) by weight) | — | — | — | — |
| Solvent (1) | THF | THF | THF | THF |
| Addition amount (part(s) by weight) | 130 | 130 | 130 | 130 |
| Solvent (2) | — | — | — | — |
| Addition amount (part(s) by weight) | — | — | — | — |
| Heat radical generating agent | Irganox 819 | LUPEROX 101 | AIBN | AIBN |
| 10 hour half-life temperature | — | 120° C. | 65° C. | 65° C. |
| Addition amount (part(s) by weight) | 3 | 3 | 3 | 3 |
| Specific surfactant | POLYFLOW-KL-600 | POLYFLOW-KL-600 | POLYFLOW-KL-600 | POLYFLOW-KL-600 |
| Addition amount (part(s) by weight) | 1 | 1 | 1 | 1 |
| Photoreceptor No. | 21 | 22 | 23 | 24 |

TABLE 4

| | Example 25 | Example 26 | Example 27 | Comparative Example 1 | Comparative Example 2 |
|---|---|---|---|---|---|
| Compound (1) represented by formula (I) | ii-22 | ii-2 | ii-18 | i-13 | iv-17 |
| Addition amount (part(s) by weight) | 105 | 105 | 132 | 65 | 160 |
| Compound (2) represented by formula (I) | iv-17 | iv-17 | — | — | — |
| Addition amount (part(s) by weight) | 25 | 25 | — | — | — |
| Monomer having no charge transportability | — | — | ABE-300 | THE-330 | — |
| Addition amount (part(s) by weight) | — | — | 33 | 65 | — |
| Solvent (1) | THF | THF | IPA | — | — |
| Addition amount (part(s) by weight) | 130 | 130 | 60 | — | — |
| Solvent (2) | — | — | THF | THF | THF |
| Addition amount (part(s) by weight) | — | — | 50 | 130 | 130 |
| Heat radical generating agent | AIBN | AIBN | AIBN | AIBN | AIBN |
| 10 hour half-life temperature | 65° C. | 65° C. | 65° C. | 65° C. | 65° C. |
| Addition amount (part(s) by weight) | 3 | 3 | 3 | 3 | 3 |
| Specific surfactant | POLYFLOW-KL-600 | POLYFLOW-KL-600 | Polyethylene glycol | — | — |
| Addition amount (part(s) by weight) | 1 | 1 | 1 | — | — |
| Photoreceptor No. | 25 | 26 | 27 | C1 | C2 |

Abbreviations in Tables 1 to 4 are resolved as follows.

ABE-300: monomer having no charge transportability, trade name, manufactured by Shin-Nakamura Chemical Co., Ltd., THE-300: monomer having no charge transportability, trade name, manufactured by Nippon Kayaku Co., Ltd., IPA: isopropanol, THF: tetrahydrofuran, AIBN: heat radical generating agent, trade name, manufactured by Otsuka Chemical Co., Ltd., LUPEROX 188: heat radical generating agent, trade name, manufactured by ARKEMA YOSHITOMI, LTD., LUPEROX 844: heat radical generating agent, trade name, manufactured by ARKEMA YOSHITOMI, LTD., V-65: heat radical generating agent, trade name, manufactured by Wako Pure Chemical Industries, Ltd., $OT_{AZO}$-15: heat radical generating agent, trade name, manufactured by Otsuka Chemical Co., Ltd., V-601: heat radical generating agent, trade name, manufactured by Wako Pure Chemical Industries, Ltd., LUPEROX 26: heat radical generating agent, trade name, manufactured by ARKEMA YOSHITOMI, LTD., LUPEROX 7: heat radical generating agent, trade name, manufactured by ARKEMA YOSHITOMI, LTD., LUPEROX 101: heat radical generating agent, trade name, manufactured by ARKEMA YOSHITOMI, LTD., Vam-110: heat radical generating agent, trade name, manufactured by Wako Pure Chemical Industries, Ltd., Irganox 819: photo radical generating agent, trade name, manufactured by Ciba Specialty Chemicals, FTERGENT: surfactant having the structure (B), manufactured by NEOS COMPANY LIMITED, KB-F2M: surfactant having the structure (B), manufactured by NEOS COMPANY LIMITED, SURFYNOL 420: surfactant having the structure (D), trade name, manufactured by Shin-Etsu Chemical Co., Ltd., POLYFLOW-KL-600: surfactant having the structure (A), trade name, manufactured by KYOEISHA CHEMICAL Co., Ltd., and Polyethyleneglycol (Mw: 200): surfactant having the structure (C), manufactured by Aldrich Corp.

Example 28

Up to the step of preparing the charge generating layer, preparation is carried out in a similar manner to that in Example 1.

A compound (compound ii-18) represented by formula (I) in an amount of 132 parts by weight and an ethoxized bisphenol A diacrylate (ABE-300, trade name, manufactured by Shin-Nakamura Chemical Co., Ltd.), serving as an acrylic monomer, in an amount of 33 parts by weight are dissolved in a mixed solvent of 60 parts by weight of isopropanol (IPA) and 50 parts by weight of tetrahydrofuran (THF); further 3 parts by weight of a heat radical generating agent (AIBN, trade name, 10 hour half-life temperature: 65° C., manufactured by Otsuka Chemical Co., Ltd.) and 1 part by weight of a surfactant (KL-600, trade name, manufactured by KYOEISHA CHEMICAL Co., Ltd.) having the structure (A) obtained by polymerizing an acrylic monomer having a fluorine atom are dissolved so as to obtain a coating solution for forming a charge transporting layer. The coating solution is coated on the charge generating layer, heated in an atmosphere containing about 200 ppm of oxygen at 150° C. for 45 minutes to obtain a 15 μm thick charge transporting layer (outermost surface layer).

In this way, an electrophotographic photoreceptor is obtained. The photoreceptor is referred to as a photoreceptor 28.

The photoreceptor is subjected to evaluation in a similar manner to that in Example 1. Results are shown in Table 8.

Example 29

Up to the step of preparing the charge generating layer, preparation is carried out in a similar manner to that in Example 1.

A compound (compound iv-17) represented by formula (I) in an amount of 132 parts by weight is dissolved in 100 parts by weight of monochlorobenzene; further 3 parts by weight of a heat radical generating agent (AIBN (2,2'-Azobis-isobutyronitrile), 10 hour half-life temperature: 65° C., manufactured by Otsuka Chemical Co., Ltd.) and 1 part by weight of a surfactant (KL-600, trade name, manufactured by KYOEISHA CHEMICAL Co., Ltd.) having the structure (A) obtained by polymerizing an acrylic monomer having a fluorine atom are dissolved so as to obtain a coating solution for forming a charge transporting layer. The coating solution is coated on the charge generating layer, heated in an atmosphere containing about 200 ppm of oxygen at 150° C. for 45 minutes to obtain a 15 μm thick charge transporting layer (outermost surface layer).

In this way, an electrophotographic photoreceptor is obtained. The photoreceptor is referred to as a photoreceptor 29.

The photoreceptor is subjected to evaluation in a similar manner to that in Example 1. Results are shown in Table 8.

TABLE 5

| | | Example 1 | Example 2 | Example 3 | Example 4 | Example 5 | Example 6 | Example 7 | Example 8 |
|---|---|---|---|---|---|---|---|---|---|
| Photoreceptor No. | | 1 | 2 | 3 | 4 | 5 | 6 | 7 | 8 |
| Density unevenness | Test (1) | A | A | A | A | A | A | A | A |
| | Test (2) | A | A | A | A | A | A | A | A |
| | Test (3) | A | A | A | B | A | A | A | A |
| Scores | Test (1) | A | A | A | A | A | A | A | A |
| | Test (2) | A | A | A | A | A | A | A | A |
| | Test (3) | B | B | B | B | A | B | B | B |
| Image degradation | Test (1) | A | A | A | A | A | A | A | A |
| | Test (2) | A | A | A | A | A | A | A | B |
| | Test (3) | A | A | A | A | A | A | A | B |
| Ghosts | Test (1) | A | A | A | A | A | A | A | A |
| | Test (2) | A | A | A | A | A | A | A | B |
| | Test (3) | A | A | A | A | B | A | A | B |
| Surface observation | Test (2) | A | A | A | A | A | A | A | A |
| | Test (3) | B | B | B | B | A | B | B | B |

TABLE 6

| | | Example 9 | Example 10 | Example 11 | Example 12 | Example 13 | Example 14 | Example 15 | Example 16 |
|---|---|---|---|---|---|---|---|---|---|
| Photoreceptor No. | | 9 | 10 | 11 | 12 | 13 | 14 | 15 | 16 |
| Density unevenness | Test (1) | A | A | A | A | A | A | A | A |
| | Test (2) | A | A | A | A | A | A | A | A |
| | Test (3) | A | A | B | A | A | A | A | A |
| Scores | Test (1) | A | A | A | A | A | A | A | A |
| | Test (2) | A | A | A | A | A | A | A | A |
| | Test (3) | B | A | B | B | A | A | A | A |
| Image degradation | Test (1) | A | A | A | A | A | A | A | A |
| | Test (2) | A | A | A | A | A | A | A | A |
| | Test (3) | A | A | B | B | A | A | A | A |
| Ghosts | Test (1) | A | A | A | A | A | A | A | A |
| | Test (2) | A | A | B | A | A | A | A | A |
| | Test (3) | A | A | B | B | B | A | A | A |
| Surface observation | Test (2) | A | A | A | A | A | A | A | A |
| | Test (3) | A | A | B | A | A | A | A | A |

TABLE 7

| | | Example 17 | Example 18 | Example 19 | Example 20 | Example 21 | Example 22 | Example 23 | Example 24 |
|---|---|---|---|---|---|---|---|---|---|
| Photoreceptor No. | | 17 | 18 | 19 | 20 | 21 | 22 | 23 | 24 |
| Density unevenness | Test (1) | A | A | A | A | A | A | A | A |
| | Test (2) | A | A | A | A | A | B | A | A |
| | Test (3) | A | A | A | B | B | B | A | A |
| Scores | Test (1) | A | A | A | A | A | A | A | A |
| | Test (2) | A | A | A | A | B | A | A | A |
| | Test (3) | A | A | A | B | B | A | A | B |
| Image degradation | Test (1) | A | A | A | A | A | A | A | A |
| | Test (2) | A | A | A | A | A | A | A | A |
| | Test (3) | A | A | B | B | B | B | A | A |
| Ghosts | Test (1) | A | A | A | A | A | A | A | A |
| | Test (2) | A | A | A | B | B | B | A | A |
| | Test (3) | B | B | B | B | A | A | A | A |
| Surface observation | Test (2) | A | A | A | A | A | A | A | A |
| | Test (3) | A | A | A | B | B | B | A | A |

TABLE 8

| | | Example 25 | Example 26 | Example 27 | Example 28 | Example 29 | Comparative Example 1 | Comparative Example 2 |
|---|---|---|---|---|---|---|---|---|
| Photoreceptor No. | | 25 | 26 | 27 | 28 | 29 | C1 | C2 |
| Density unevenness | Test (1) | A | A | B | A | B | B | B |
| | Test (2) | B | B | B | A | A | B | C |
| | Test (3) | B | B | B | A | A | C | C |
| Scores | Test (1) | A | A | A | A | A | B | B |
| | Test (2) | A | A | A | A | A | B | C |
| | Test (3) | A | B | A | B | A | C | C |
| Image degradation | Test (1) | A | A | A | A | A | B | B |
| | Test (2) | A | A | A | A | A | B | B |
| | Test (3) | A | B | A | A | A | C | C |
| Ghosts | Test (1) | A | B | A | B | A | B | B |
| | Test (2) | A | B | A | B | B | B | B |
| | Test (3) | A | A | A | A | A | B | B |
| Surface observation | Test (2) | A | A | A | A | A | B | B |
| | Test (3) | A | B | B | B | A | C | B |

As shown in Tables 5 to 8, in Examples, density unevenness, scores, image degradation, and ghosts, all of them are more adequately achieved as compared with Comparative Examples. In addition, the photoreceptors of Examples are shown to have more excellent surface properties as compared with Comparative Examples.

Evaluations of density unevenness and scores relate to existence or nonexistence of wrinkles of photoreceptors, and evaluations of density unevenness and ghosts relate to existence or nonexistence of irregularities of photoreceptors, so that, from the results shown in Tables 5 to 8, the photoreceptors of Examples are shown to have an outermost surface layer free of wrinkles and irregularities that effect electrical characteristics and image characteristics.

Furthermore, evaluation of scores relates to scratch resistance originated from mechanical strength, so that photoreceptors of Examples are shown to have excellent mechanical strength in the outermost surface layer thereof.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate, a photosensitive layer formed on the conductive substrate, and an outermost surface layer of the electrophotographic photoreceptor being composed of a cured material of a composition comprising at least one compound represented by the following formula (II)

(II)

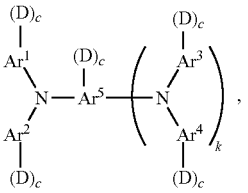

a surfactant having, in the molecule thereof, at least one structure selected from (B) a structure having a carbon-carbon double bond and a fluorine atom represented by the following formula (B1) or (B2), and (C) an alkylene oxide structure, (B1)

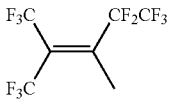

(B2)

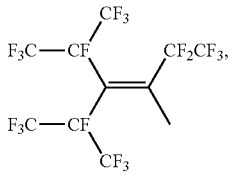

wherein in formula (II), $Ar^1$ to $Ar^4$ are, each independently, an aryl group represented by the following formula (3); $Ar^5$ is an arylene group represented by the following formula (7); D is $-(L)_j-O-CO-C(R)=CH_2$; the five c's are, each independently, 0 or 1; k is 1; the total number of D is from 2 to 20; L is a divalent organic group including an alkylene group having 2 or more carbon atoms; j is 1; and R is a hydrogen atom or a straight chain or branched chain alkyl group having from 1 to 5 carbon atoms;

(3)

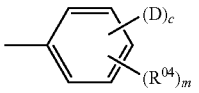

(7)

$$-Ar-(Z')_p-Ar-(D)_c,$$

wherein in formula (3), $R^{04}$ is a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, or a halogen atom: and m is an integer of from 1 to 3, wherein in formula (7), Ar is an arylene group represented by the following formula (8); and p is 0, (8)

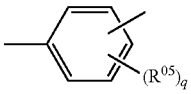

wherein in formula (8), $R^{05}$ is selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom; and q is an integer of from 1 to 3.

2. The electrophotographic photoreceptor according to claim 1, wherein the composition contains a heat radical generating agent.

3. The electrophotographic photoreceptor according to claim 2, wherein the heat radical generating agent has a 10 hour half-life temperature of from about 40° C. to about 110° C.

4. The electrophotographic photoreceptor according to claim 1, wherein the total content of the compound represented by formula (II) is about 40% by weight or more, with respect to the composition that is used when the outermost surface layer is formed.

5. The electrophotographic photoreceptor according to claim 1, wherein the total content of the surfactant is from about 0.01% by weight to about 1% by weight, with respect to the composition that is used when the outermost surface layer is formed.

6. The electrophotographic photoreceptor according to claim 1, wherein the total number of D in formula (II) is 4 or more.

7. The electrophotographic photoreceptor according to claim 1, wherein R in formula (II) is methyl group.

8. A process cartridge comprising the electrophotographic photoreceptor according to claim 1, and at least one unit selected from a charging unit that charges the electrophotographic photoreceptor, a developing unit that develops an electrostatic latent image formed on the electrophotographic photoreceptor with toner, and a toner removing unit that removes toner remaining on the surface of the electrophotographic photoreceptor.

9. An image forming apparatus comprising the electrophotographic photoreceptor according to claim 1, a charging unit that charges the electrophotographic photoreceptor, an electrostatic latent image forming unit that forms an electrostatic latent image on the charged electrophotographic photoreceptor, a developing unit that forms a toner image by developing the electrostatic latent image formed on the electrophotographic photoreceptor with toner, and a transfer unit that transfers the toner image to a transfer body.

* * * * *